US011608645B2

(12) United States Patent
Crenshaw

(10) Patent No.: US 11,608,645 B2
(45) Date of Patent: Mar. 21, 2023

(54) GAP COVER APPARATUS FOR MODULAR WALL SYSTEMS AND INSTALLATION METHODS

(71) Applicant: mfPHD, LLC, Lorena, TX (US)

(72) Inventor: Thomas Crenshaw, Lorena, TX (US)

(73) Assignee: mfPHD, LLC, Lorena, TX (US)

( * ) Notice: Subject to any disclaimer, the term of this patent is extended or adjusted under 35 U.S.C. 154(b) by 50 days.

(21) Appl. No.: 17/361,417

(22) Filed: Jun. 29, 2021

(65) Prior Publication Data

US 2021/0396022 A1 Dec. 23, 2021

Related U.S. Application Data

(63) Continuation of application No. 17/098,364, filed on Nov. 14, 2020, now Pat. No. 11,505,948.

(51) Int. Cl.

| | |
|---|---|
| ***E04F 13/12*** | (2006.01) |
| ***E04C 2/08*** | (2006.01) |
| ***E04F 13/08*** | (2006.01) |
| ***E04B 1/94*** | (2006.01) |
| ***E04F 13/21*** | (2006.01) |
| ***E04F 13/24*** | (2006.01) |

(52) U.S. Cl.

CPC ..... *E04F 13/12* (2013.01); *E04B 1/94* (2013.01); *E04C 2/08* (2013.01); *E04F 13/0898* (2013.01); *E04F 13/21* (2013.01); *E04F 13/24* (2013.01)

(58) Field of Classification Search

CPC . E04F 13/21; E04F 13/24; E04F 13/26; E04F 13/12; E04F 13/0898; E04B 1/94; E04C 2/08

See application file for complete search history.

(56) References Cited

U.S. PATENT DOCUMENTS

| | | | |
|---|---|---|---|
| 1,918,228 | A | 7/1933 | Spencer |
| 2,851,134 | A | 9/1958 | Robinson, Jr. |
| 3,906,696 | A | 9/1975 | Poter et al. |
| 3,989,397 | A | 11/1976 | Baker |
| 4,122,203 | A | 10/1978 | Stahl |
| 4,477,201 | A | 10/1984 | Yoshiyuji |
| 5,297,370 | A | 3/1994 | Greenstreet et al. |
| 5,592,786 | A | 1/1997 | Kamm |

(Continued)

FOREIGN PATENT DOCUMENTS

| | | |
|---|---|---|
| CN | 102383507 | 3/2012 |
| CN | 102383507 A | 3/2012 |

(Continued)

OTHER PUBLICATIONS

Non-Final Office Action dated Aug. 5, 2022 for U.S. Appl. No. 17/098,364.

(Continued)

*Primary Examiner* — Andrew J Triggs

(74) *Attorney, Agent, or Firm* — Patterson + Sheridan, LLP

(57) ABSTRACT

Aspects of the present disclosure relate to modular wall systems and methods of installing modular wall systems in hygienic environments. In one aspect, gap cover apparatus are disclosed. In one aspect, backplate arrangements are disclosed. In one aspect, non-progressive installation methods are disclosed. The modular wall systems can eliminate protruding ledges while maintaining structural integrity and hygienic properties.

15 Claims, 37 Drawing Sheets

(56) References Cited

U.S. PATENT DOCUMENTS

| | | | | |
|---|---|---|---|---|
| 5,816,003 | A | 10/1998 | Larsson et al. | |
| 6,070,377 | A | 6/2000 | Guevara Guzman | |
| 6,792,727 | B2 | 9/2004 | Krieger | |
| 7,303,358 | B1 | 12/2007 | Fuller | |
| 7,805,899 | B2 | 10/2010 | Montgomery | |
| 8,033,066 | B2 | 10/2011 | Griffiths | |
| 8,063,116 | B2 | 11/2011 | Trogolo et al. | |
| 8,245,467 | B2 | 8/2012 | Lewis et al. | |
| 8,484,931 | B2 | 7/2013 | Gleeson et al. | |
| 8,596,000 | B2 | 12/2013 | Mitchell et al. | |
| 9,003,737 | B2 | 4/2015 | Solomon et al. | |
| 9,010,068 | B2 * | 4/2015 | Sullivan | E04F 13/0803 52/391 |
| 9,169,641 | B2 | 10/2015 | Wickstrom | |
| 9,499,978 | B2 | 11/2016 | Glancy | |
| 9,523,205 | B2 * | 12/2016 | Vigouroux | E04F 13/12 |
| D784,560 | S | 4/2017 | D'Anglade | |
| 9,635,941 | B2 | 5/2017 | Bates et al. | |
| 9,874,026 | B2 * | 1/2018 | Bilge | E04F 13/0891 |
| 10,011,997 | B1 * | 7/2018 | Bilge | E04F 13/0801 |
| 10,072,411 | B1 | 9/2018 | Moran et al. | |
| 10,267,045 | B1 | 4/2019 | Knight, Jr. et al. | |
| 10,316,525 | B1 * | 6/2019 | Bilge | E04F 13/0814 |
| 10,858,167 | B2 | 12/2020 | D'Anglade | |
| 11,098,477 | B2 * | 8/2021 | Crenshaw | E04B 1/38 |
| 2004/0211127 | A1 | 10/2004 | Wiechecki et al. | |
| 2006/0000176 | A1 | 1/2006 | Taylor | |
| 2007/0227089 | A1 | 10/2007 | Lewis et al. | |
| 2010/0095624 | A1 | 4/2010 | Lewis et al. | |
| 2012/0304568 | A1 | 12/2012 | Aboukhalil | |
| 2013/0326987 | A1 | 12/2013 | Krieger | |
| 2014/0259970 | A1 | 9/2014 | Shapiro | |
| 2015/0020468 | A1 | 1/2015 | Wickstrom | |
| 2016/0273217 | A1 | 9/2016 | Huntzinger et al. | |
| 2018/0274231 | A1 | 9/2018 | Epstein et al. | |
| 2020/0149270 | A1 | 5/2020 | Crenshaw | |
| 2021/0372119 | A1 * | 12/2021 | Crenshaw | E04B 2/78 |
| 2021/0396020 | A1 * | 12/2021 | Crenshaw | E04F 13/0898 |
| 2021/0396021 | A1 * | 12/2021 | Crenshaw | E04F 13/12 |
| 2021/0396022 | A1 * | 12/2021 | Crenshaw | E04B 1/94 |

FOREIGN PATENT DOCUMENTS

| | | | |
|---|---|---|---|
| CN | 110439204 | | 11/2019 |
| CN | 110439204 | A | 11/2019 |
| CN | 111101673 | | 5/2020 |
| CN | 111101673 | A | 5/2020 |
| DE | 2650886 | A1 | 5/1977 |
| KR | 20100021852 | A | 2/2010 |
| RU | 2494198 | | 9/2013 |
| RU | 2494198 | C1 | 9/2013 |
| WO | 2012041331 | A1 | 4/2012 |
| WO | 2017201578 | A1 | 11/2017 |

OTHER PUBLICATIONS

Non-Final Office Action dated Aug. 15, 2022 for U.S. Appl. No. 17/401,036.

Non-Final Office Action dated Jun. 11, 2020 for U.S. Appl. No. 16/677,449.

Final Office Action dated Oct. 27, 2020 for U.S. Appl. No. 16/677,449.

Non-Final Office Action dated Mar. 19, 2021 for U.S. Appl. No. 16/677,449.

Final Office Action dated May 14, 2021 for U.S. Appl. No. 16/677,449.

International Search Report and Written Opinion dated Jun. 1, 2022 for Application No. PCT/US2021/055564.

"Nexor Modular Cladding", Nexor, pp. 1-11, https://meditek.no/wp-content/uploads/2018/10/NEXOR-Cladding-rev.01-min.pdf, Last accessed Apr. 9, 2021.

"Stainless Steel Walls", IntegroMed, p. 1, https://www.integromed.de/en/products/wall-system/stainless-steel.html, Last accessed Apr. 9, 2021.

"Wallsand ceiling panel system", Infimed, p. 1, http://www.infimed.pl/en/walls-and-ceiling-panel-system,25.html, Last accessed Apr. 9, 2021.

"Modular Room System for Operating Theatres", Infimed, pp. 1-20, http://www.infimed.pl/zdjecia/a/zal/ot-rooms-en-2020-high_202101201158.pdf. Last accessed Apr. 9, 2021.

"Modular Walls", Skytron, pp. 1-4, https://www.skytron.com/products/architectural/modular-walls/#, Last accessed Apr. 9, 2021.

"EASE Modular Systems", Skytron, pp. 1-4, https://www.skytron.com/wp-content/uploads/documentation/Modular-Walls-Brochure-WEB.pdf, Last accessed Apr. 9, 2021.

"MEDglas™ Prefabricated OR Walls", Steris, pp. 1-7, https://www.steris.com/healthcare/products/or-environment/medglas-prefabricated-or-walls, Last accessed Apr. 9, 2021.

"Stainless steel modular walls", Vistamedikal, pp. 1-5, http://hospital-tech.com/solutions/stainless-steel-modular-walls/, Last accessed Apr. 9, 2021.

"Modular Wall System", Axis medical construction, pp. 1-5, https://www.axismedical.gr/modular-wall-system/, Last accessed Apr. 9, 2021.

"WPS-12 Stainless Steel Wall Covering", ProTek Systems Inc, pp. 1-6, https://www.proteksystem.com/product/wps-12-stainless-steel-wall-system/, Last accessed Apr. 9, 2021.

"Modular Operation Theater", Creative Health Tech Pvt. Ltd., pp. 1-5, https://www.creativemodularot.co.in/modular-operationtheater.html, Last accessed Apr. 9, 2021.

"Walling for healthcare", Altro, pp. 1-4, https://www.altro-me.com/Walls-and-doors/Sector/Healthcare, Last accessed Apr. 9, 2021.

Song, Jin-Hee et al., "Evaluation of alternatives for reducing thermal bridges in metal panel curtain wall systems", Elsevier, 2016, pp. 138-158, https://www.researchgate.net/publication/303534203_Evaluation_of_Alternatives_for_Reducing_Thermal_Bridges_in_Metal_Panel_Curtain_Wall_Systems, Last accessed Apr. 9, 2021.

"Drywall Handbook", Gyproc Saint-Gobain, pp. 1-44, https://www.gyproc.in/pdf/Drywall-Handbook.pdf, Last accessed Apr. 9, 2021.

Major, Maciej et al., "Effect of Steel Framing for Securing Drywall Panels on Thermal and Humidity Parameters of the Outer Walls", De Gruyter Open, vol. 13, Issue Feb. 2017, pp. 86-91, https://sciendo.com/article/10.1515/cee-2017-0011. Last accessed Apr. 9, 2021.

"Modular wall, door and ceiling system", Medifa, pp. 1-13, https://www.medifa.com/modular-room-systems/lang=en, Last accessed Apr. 9, 2021.

"Insulated metal installation guide", Ceco Building Systems, pp. 1-84, https://www.cecobuildings.com/wp-content/uploads/2018/10/Insulated-Panels-Installation-Manual.pdf, Last accessed Apr. 9, 2021.

Gypsum Board Assemblies, Erie Construction Council Inc, pp. 1-124, http://www.erieconstructioncouncil.com/plan_room_documents/Div%2009.pdf, Last accessed Apr. 9, 2021.

Teal, Derrick, "Insulated metal wall and roof panels for sustainability and energy efficiency", Jul. 10, 2014, pp. 1-7, https://www.slideshare.net/DerrickTeal/insulated-metal-wall-and-roof-panels-for-sustainability-and-energy-efficiency-edc1, Last accessed Apr. 9, 2021.

Crandall, Brianna, "Metl-Span white paper lists benefits of insulated metal panels", FMLink, Jan. 18, 2016, pp. 1-3, https://www.fmlink.com/articles/metl-span-white-paper-lists-benefits-of-insulated-metal-panels/, Last accessed Apr. 9, 2021.

Invitation to Pay Additional Fees dated Feb. 2, 2022 for Application No. PCT/US2021/055476.

International Search Report and Written Opinon dated May 23, 2022 for Application No. PCT/US2021/055476.

Non-Final Office Action dated Oct. 13, 2022 for U.S. Appl. No. 17/361,398.

* cited by examiner

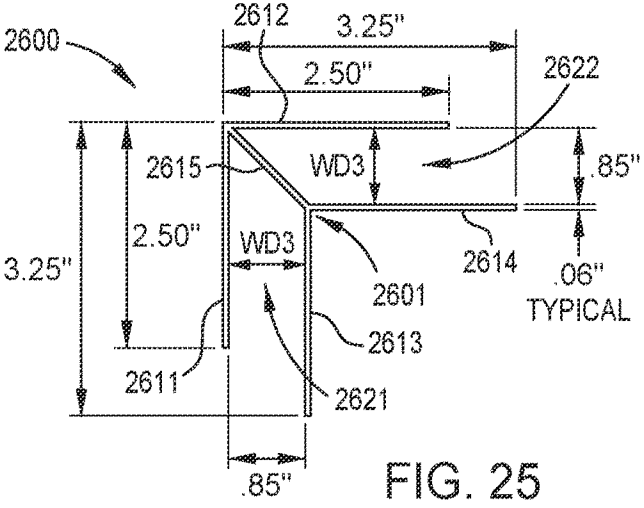
FIG. 25
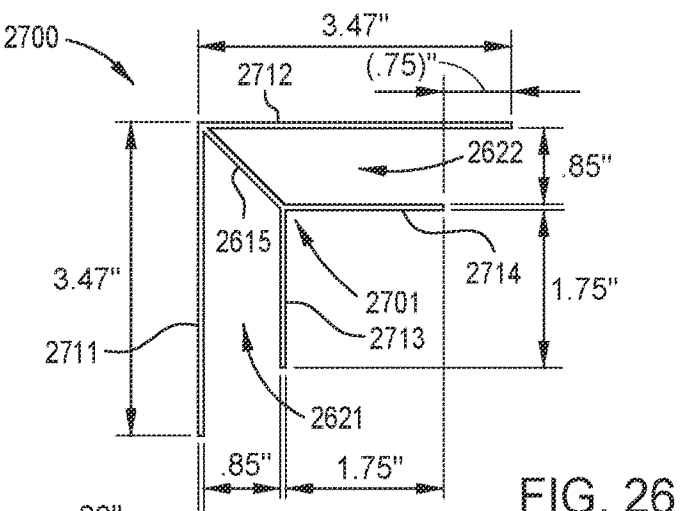
FIG. 26
FIG. 27
FIG. 28

FIG. 36
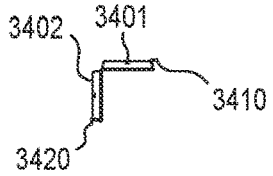
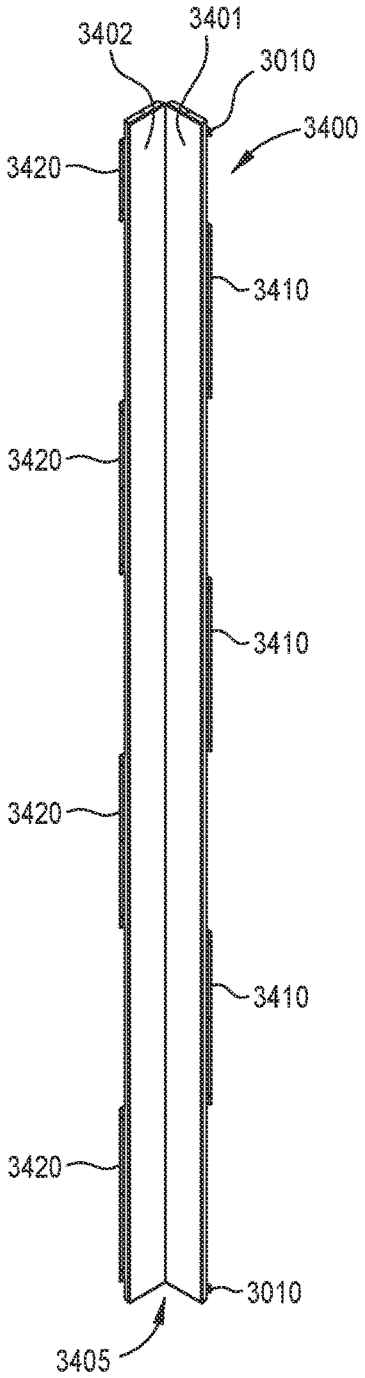
FIG. 33
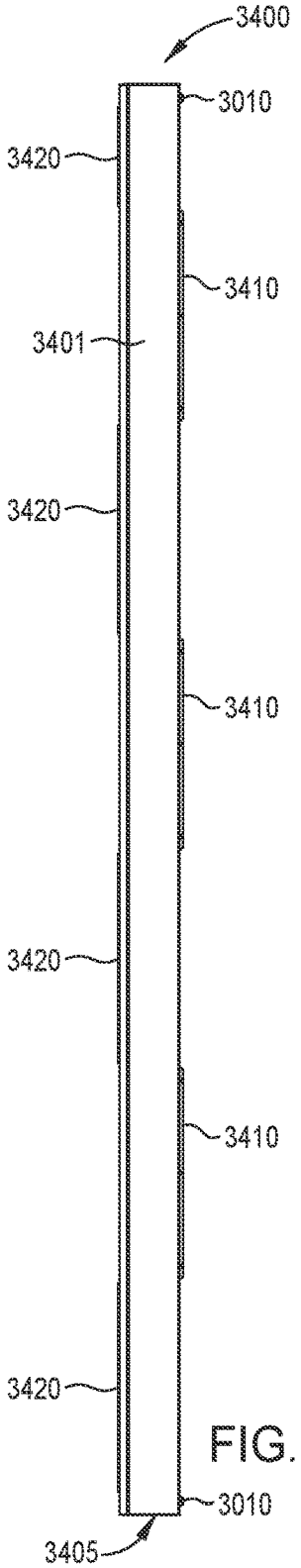
FIG. 34
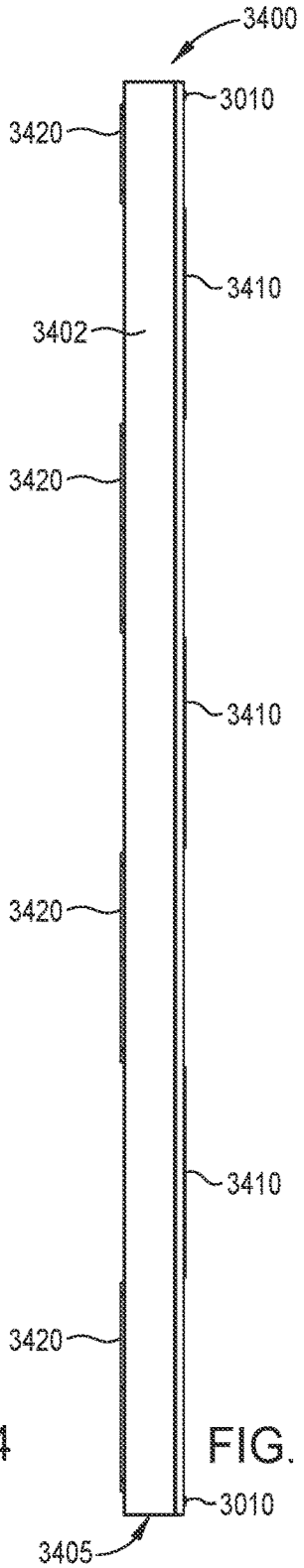
FIG. 35

FIG. 40
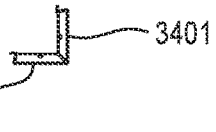
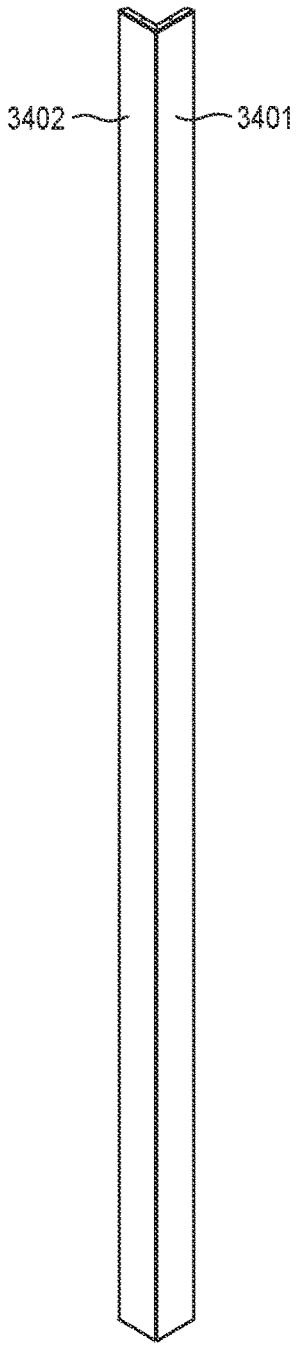
FIG. 37
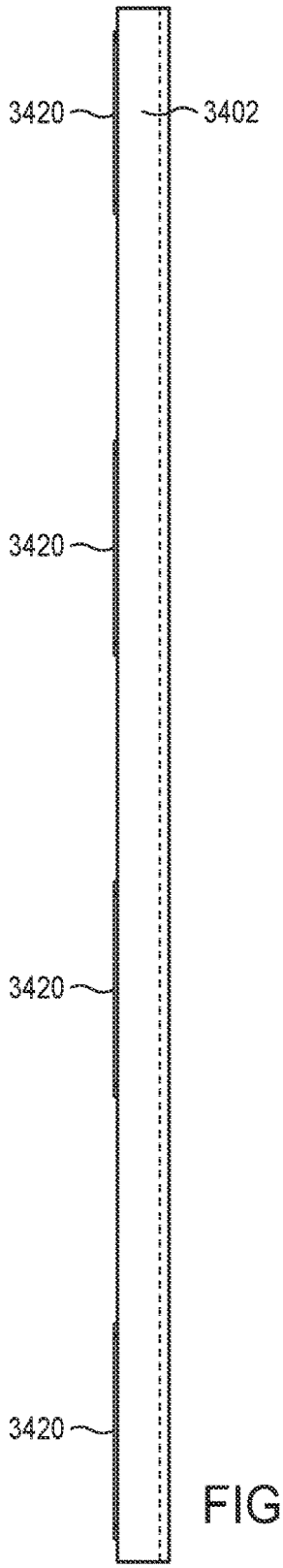
FIG. 38
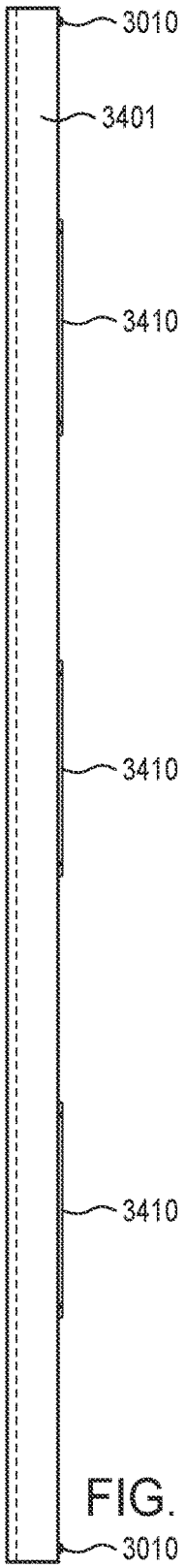
FIG. 39

FIG. 48
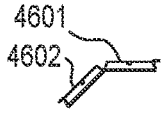
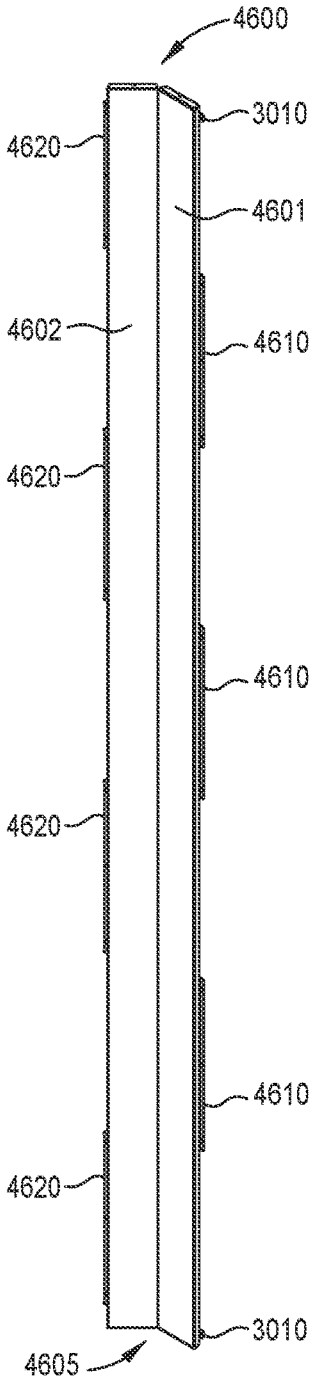
FIG. 45
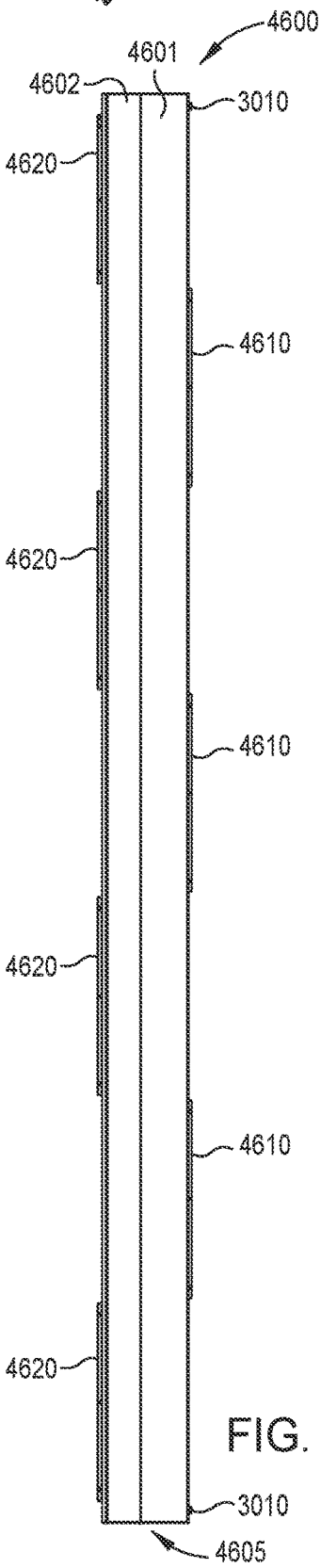
FIG. 46
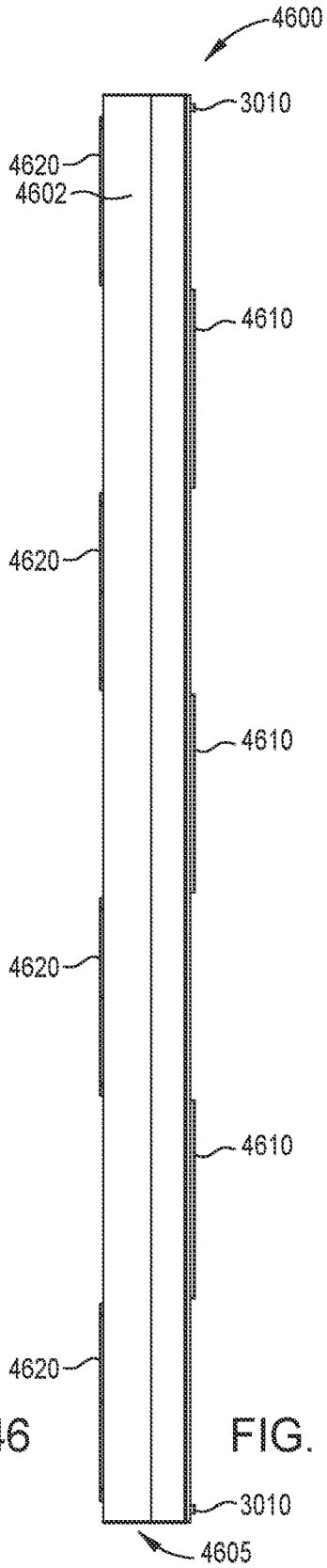
FIG. 47

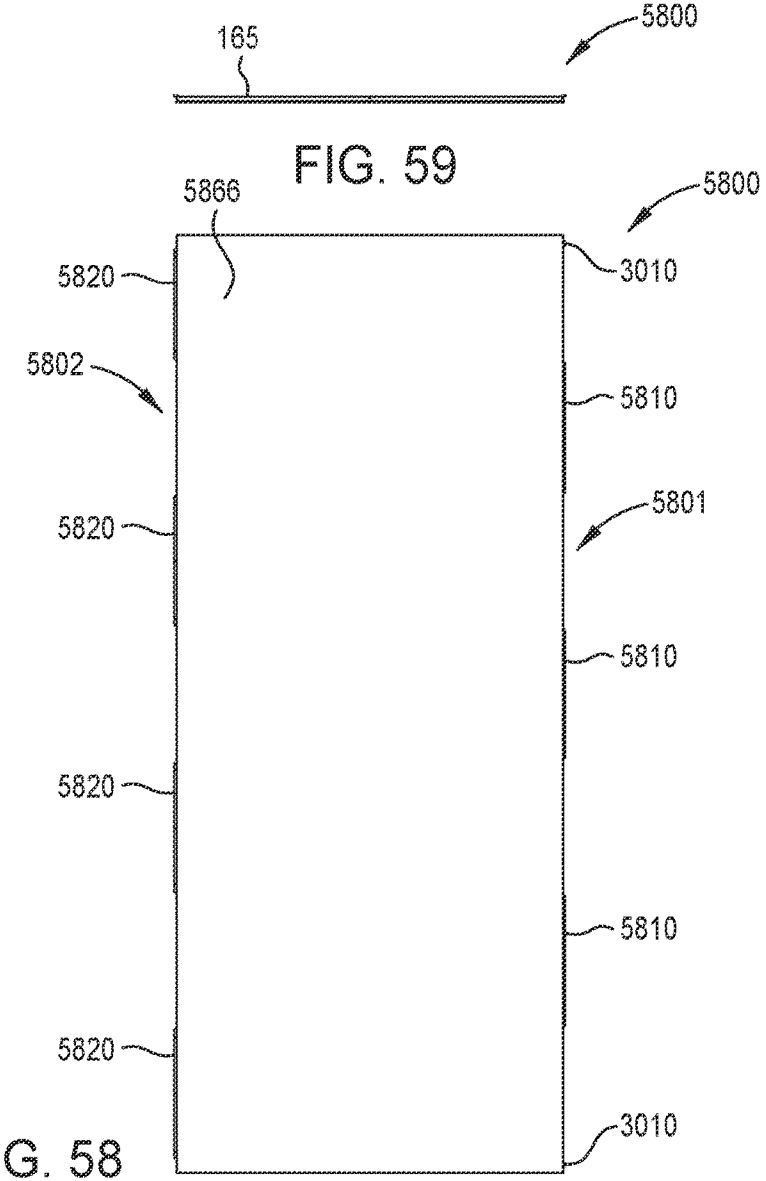
FIG. 59
FIG. 58
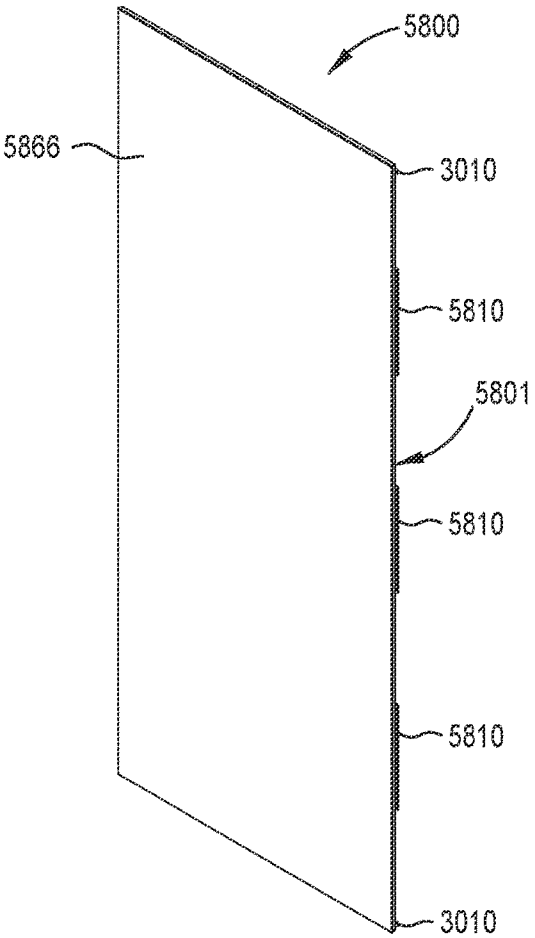
FIG. 57

GAP COVER APPARATUS FOR MODULAR WALL SYSTEMS AND INSTALLATION METHODS

CROSS-REFERENCE TO RELATED APPLICATIONS

This application is a continuation of U.S. patent application Ser. No. 17/098,364, filed Nov. 14, 2020, which is herein incorporated by reference in its entirety.

BACKGROUND

Field

Aspects of the present disclosure relate to modular wall systems and methods of installing modular wall systems in hygienic environments. In one aspect, gap cover apparatus are disclosed. In one aspect, backplate arrangements are disclosed. In one aspect, non-progressive installation methods are disclosed. The modular wall systems can eliminate protruding ledges while maintaining structural integrity and hygienic properties.

Description of the Related Art

During installation of wall panels for a wall system, the wall panels may not all align with studs such that the wall panels can be fastened to the studs, which can result in re-forming of the wall panels. The re-forming can cause installation delays and increased installation costs.

Additionally, gaps can occur in the wall system near wall panels, such as between panels, near an edge of the wall system, and/or near a corner of the room. The gaps can not only hinder aesthetics of the room, but can compromise the hygiene of the room. For example, the gaps can be areas in which bacteria grows. The gaps can also be difficult to sanitize. The gaps can also be non-uniform, thereby hindering ease of installation and hindering aesthetics of the room. The gaps can define protrusions that protrude into the room relative other portions of the wall.

Moreover, wall systems can involve progressive installation where a first panel is installed in a corner of an area, and subsequent panels are installed from the location of the first panel. The progressive installation can make installation complicated, expensive, and time-delayed. Additionally, progressive installation can make it difficult to remove individual installed panels from the wall system, rendering maintenance and further work on the wall system difficult and expensive.

Therefore, there is a need for improved modular wall systems and methods of installation thereof that facilitate panel alignment, covering gaps, and non-progressive installation to reduce installation time, installation costs, and installation complexity while maintaining enhanced aesthetics and hygiene of the hygienic environment.

SUMMARY

Aspects of the present disclosure relate to modular wall systems and methods of installing modular wall systems in hygienic environments. In one aspect, gap cover apparatus are disclosed. In one aspect, backplate arrangements are disclosed. In one aspect, non-progressive installation methods are disclosed. The modular wall systems can eliminate protruding ledges while maintaining structural integrity and hygienic properties.

In one implementation, a modular wall system for medical treatment environments includes a plurality of modular wall units configured to be arranged together as a wall. Each of the plurality of modular wall units includes a non-metallic inner panel, and an outer panel disposed about a front face of the non-metallic inner panel. The modular wall system includes a gap cover apparatus configured to cover one or more gaps of the wall. The gap cover apparatus includes one or more brackets configured to interface with one or more of the plurality of modular wall units. The one or more brackets define a retaining opening that at least partially receives the one or more of the plurality of modular wall units therein. The gap cover apparatus includes a plurality of first fasteners configured to fasten the one or more brackets to a support structure.

In one implementation, a method of installing a modular wall system for a medical treatment environment includes fastening a plurality of modular wall units to a support structure to form a wall. The wall includes one or more gaps. The method include positioning a gap cover apparatus in the one or more gaps, the positioning including disposing a modular wall unit partially in a retaining opening of the gap cover apparatus. The method includes fastening the gap cover apparatus to the support structure, and abutting a front flange of the gap cover apparatus against the modular wall unit.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of scope, as the disclosure may admit to other equally effective embodiments.

FIG. 25 is a top cross-sectional view of a corner apparatus, according to one implementation.

FIG. 26 is a top cross-sectional view of a corner apparatus, according to one implementation.

FIG. 27 is a top cross-sectional view of a corner apparatus, according to one implementation.

FIG. 28 is a top cross-sectional view of a corner apparatus, according to one implementation.

FIG. 33 is a schematic front isometric view of a gap cover apparatus, according to one implementation.

FIG. 34 is a schematic front view of first portion of the gap cover apparatus shown in FIG. 33, according to one implementation.

FIG. 35 is a schematic front view of the second portion of the gap cover apparatus shown in FIG. 33, according to one implementation.

FIG. 36 is a schematic top view of the gap cover apparatus shown in FIG. 34, according to one implementation.

FIG. 37 is a schematic back isometric view of the gap cover apparatus shown in FIG. 33, according to one implementation.

FIG. 38 is a schematic back view of second portion of the gap cover apparatus shown in FIG. 37, according to one implementation.

FIG. 39 is a schematic back view of the first portion of the gap cover apparatus shown in FIG. 37, according to one implementation.

FIG. 40 is a schematic top view of the gap cover apparatus shown in FIG. 38, according to one implementation.

FIG. 45 is a schematic front isometric view of a gap cover apparatus, according to one implementation.

FIG. 46 is a schematic front view of first portion of the gap cover apparatus shown in FIG. 45, according to one implementation.

FIG. 47 is a schematic front view of the second portion of the gap cover apparatus shown in FIG. 45, according to one implementation.

FIG. 48 is a schematic top view of the gap cover apparatus shown in FIG. 46, according to one implementation.

FIG. 57 is a schematic front isometric view of a modular wall unit, according to one implementation.

FIG. 58 is a schematic front view of the modular wall unit shown in FIG. 57, according to one implementation.

FIG. 59 is a schematic top view of the modular wall unit shown in FIG. 58, according to one implementation.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Aspects of the present disclosure relate to modular wall systems and methods of installing modular wall systems in hygienic environments. In one aspect, gap cover apparatus are disclosed. In one aspect, backplate arrangements are disclosed. In one aspect, non-progressive installation methods are disclosed. The modular wall systems can eliminate protruding ledges while maintaining structural integrity and hygienic properties.

Figure 1:
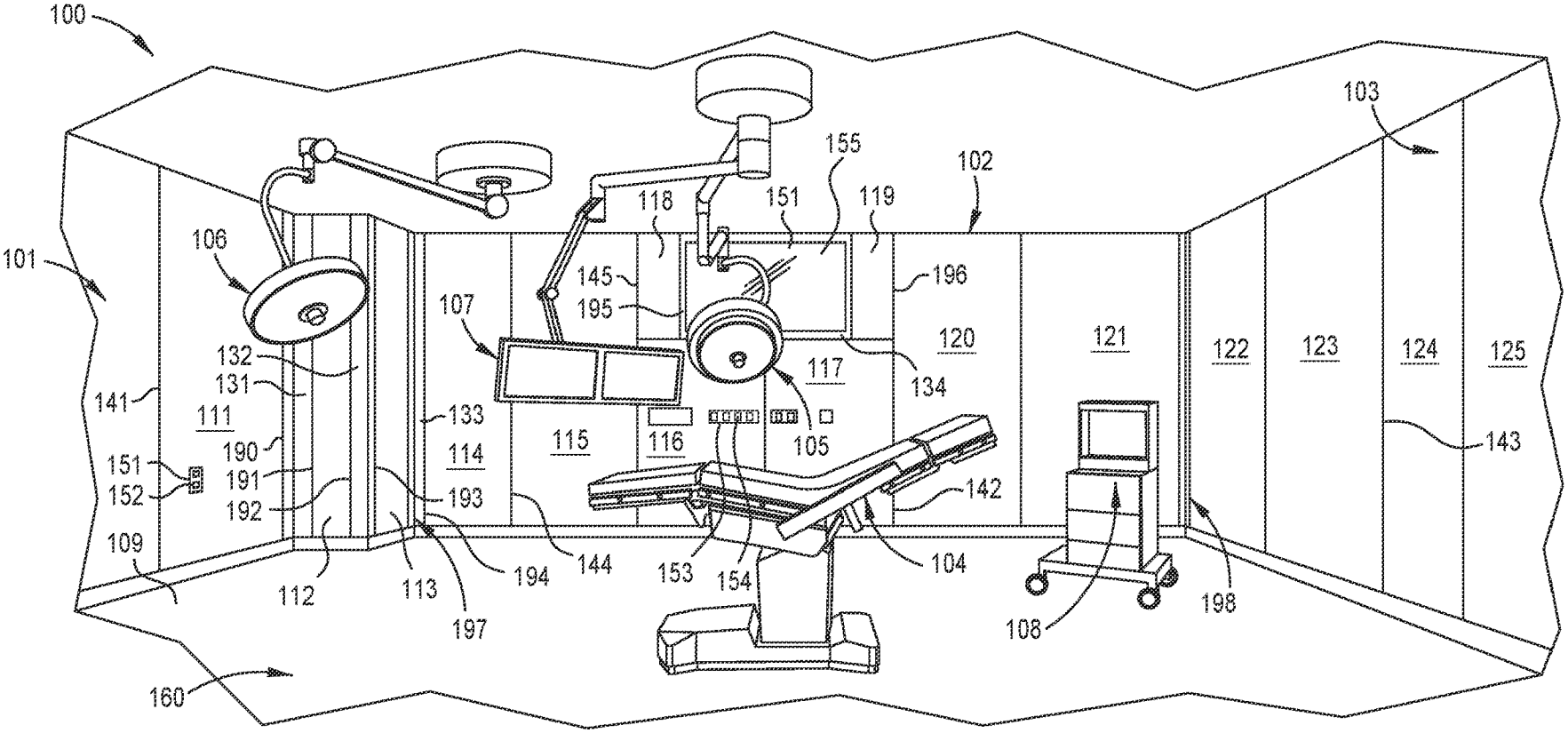
FIG. 1 is a schematic isometric view of a modular wall system installed in a hygienic environment, according to one implementation.

FIG. 1 is a schematic isometric view of a modular wall system 100 installed in a hygienic environment, according to one implementation. The hygienic environment is a medical treatment environment. The medical treatment environment is shown as an operating room 160 in FIG. 1. The medical treatment environment can be, for example, a sterilizing processing area. Although medical treatment environments are described herein, the present disclosure contemplates that aspects described can be used in other hygienic environments and other environments, including but not limited to public corridors and hallways, common areas, hospitals, clean rooms, pharmacies, cafeterias, radiological environments, and other environments or settings.

Three walls 101, 102, 103 of the modular wall system 100 are shown in FIG. 1. The operating room 160 includes equipment, such as medical treatment equipment, disposed therein. The equipment includes a patient chair 104, movable lights 105, 106, movable screens 107, and surgical equipment 108 disposed on a flooring material 109 of the operating room 160. The walls 101-103 include a plurality of modular wall units 111-125 arranged together as the walls 101-103.

The modular wall system 100 also includes a first gap cover apparatus 131, a second gap cover apparatus 132, and a third gap cover apparatus 133 disposed at three corners of a first wall 101. A fourth gap cover apparatus 134 is disposed along the second wall 102. A plurality of seals 141-145 are disposed between adjacent modular wall units 111-125. A plurality of seals 190-196 are disposed between the gap cover apparatus 131-134 and adjacent modular wall units. The seals 190-196 can be gaskets, and can be formed of a silicone material. The seals 190-196 can include flat gaskets, caulk (such as a single line of caulk), and/or foam. The seals 190-196 can be formed of an elastomeric material. The seals 190-196 can be formed of ethylene propylene diene monomer (EPDM) (M-Class) rubber and have a watertight seal. The watertight seal can make the seams of the seals 190-196 monolithic. The seals 190-196, in a set position, can seal gaps that are within a range of 6 mm to 10 mm, for example. The seals 190-196 can be compression-only seals. The seals 190-196 can be pushed in manually between installed modular wall units 111-125 and/or installed gap cover apparatus 131-134 to create the watertight seals.

One or more openings are formed in the plurality of modular wall units 111-125 and/or the gap cover apparatus 131-134. One or more first openings 151 are formed in a first modular wall unit 111 to receive one or more utility modules 152, such as electrical modules, therein. One or more second openings 153 are formed in a second modular wall unit 116 to receive one or more utility modules 154, such as gas supply modules. The openings may also receive control panels. The fourth gap cover apparatus 134 includes an opening 155 to receive a viewing window, such as a glass viewing window, therein. The viewing window can allow viewing of a television screen 156, a white board, another room or hallway, and/or a supplies storage unit that has supplies stored therein. The modular wall system 100 can have one or more doors formed therein. The doors can include flush-mounted doors and/or fully integrated solid core doors for increased infection control and durability. The doors are not only durable and easy to clean but are built to fit active spaces. The doors may be provided in both swing and slide styles.

Figure 2:
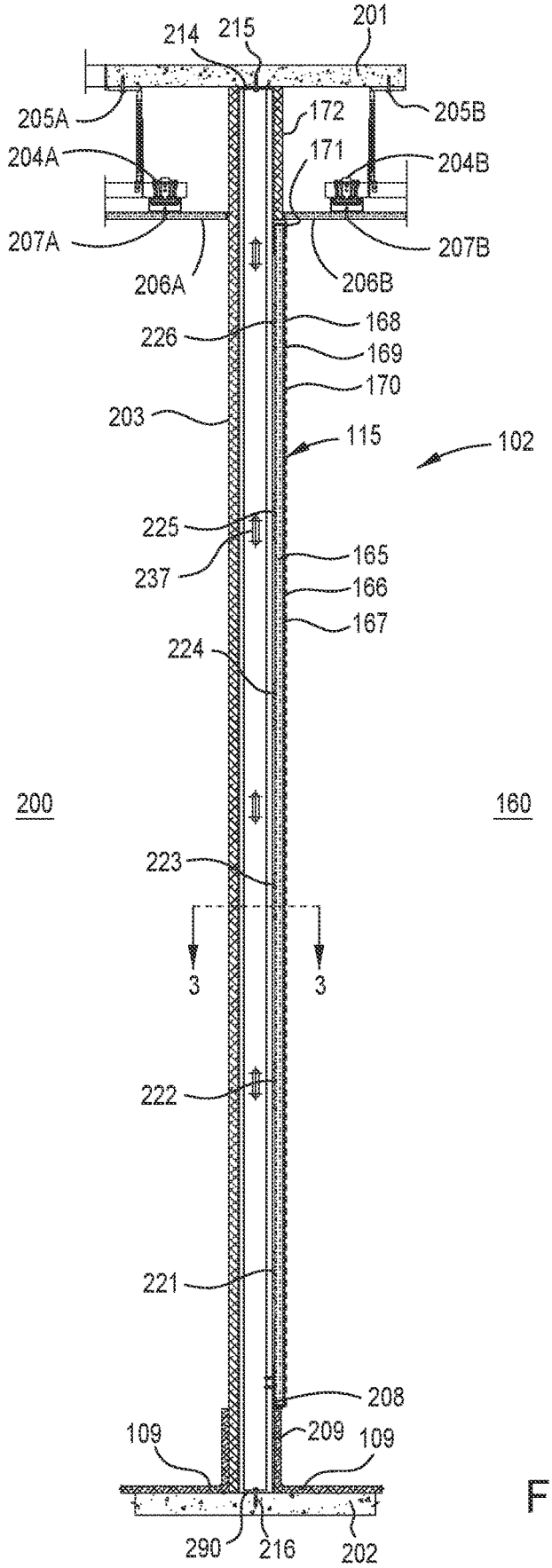
FIG. 2 is a side cross-sectional view of the second wall shown in FIG. 1, with the view running parallel to the second wall, according to one implementation.

FIG. 2 is a side cross-sectional view of the second wall 102 shown in FIG. 1, with the view running parallel to the second wall 102, according to one implementation. The second wall 102 separates the operating room 160 from a second area 200. The second area 200, can be for example, a second operating room, a hallway, or a patient waiting room.

A ceiling slab 201 is disposed above a floor slab 202. Each of the ceiling slab 201 and the floor slab 202 is a concrete slab. The ceiling slab 201 can be considered a floor slab for a floor above the operating room 160. The floor slab 202 can be considered a ceiling slab for a floor below the operating room 160. A first piece of drywall 203 extends between the ceiling slab 201 and the floor slab 202. A plurality of ceiling support assemblies 204A, 204B are disposed on opposing sides of the second wall 102 and the first piece of drywall 203. The ceiling support assemblies 204A, 204B are fastened to the ceiling slab 201 using fasteners 205A, 205B. The ceiling support assemblies 204A, 204B define a ceiling profile for the second wall 102. A plurality of ceiling panels 206A, 206B are fastened to the respective ceiling support assemblies 204A, 204B using fasteners 207A, 207B. Lower flanges 290 of the studs 213 are fastened to the floor slab 202 using a plurality of fasteners 216. One or more base frames 208 are fastened to the studs 213 and define a floor profile for the second wall 102. A single base frame 208 is shown in FIG. 2.

Terms such as "fasten(s)," "fastener(s)," "fastened," and "fastening," may include use of bolts, nuts, studs, clamps, threaded connections, screws, and/or other fasteners. Terms such as "fasten(s)," "fastener(s)," "fastened," and "fastening," may include use of interference fitting, such as friction interference fitting, guide and slot interference fitting, and/or dovetail interference fitting. Terms such as "fasten(s)," "fastener(s)," "fastened," and "fastening," may include direct fastening and/or indirect fastening.

A lower backplate 209 is fastened to the studs 213. The lower backplate 209 is formed of a wood material. The flooring material 109 is formed on the floor slab 202 and an inner face of the lower backplate 209. A plurality of studs 213 are disposed between the first piece of drywall 203 and the second wall 102. The studs 213 are formed of a metal. The studs 213 are fastened to the ceiling slab 201 using a plurality of upper flanges 214 of the studs 213. The upper flanges 214 are fastened to the ceiling slab 201 using fasteners 215. The studs 213 have a plurality of openings 237 formed therein. The openings 237 can be longitudinal slots. The openings 237 can be through-holes. The openings 237 can have a diameter of 4 mm, for example.

A plurality of backplates 221-226 are fastened to the studs 213. The plurality of backplates 221-226 are disposed above the lower backplate 209. A gap cover apparatus 171 and the one or more base frames 208 are formed of a metal. The modular wall units 114-121 are arranged together as the second wall 102 and fastened to backplates that are fastened to the studs 213. FIG. 2 shows a modular wall unit 115 as fastened to the plurality of backplates 221-226, the gap cover apparatus 171, and the one or more base frames 208, each of which are fastened to the studs 213. Each of the modular wall units 114-121 includes a non-metallic inner panel 165 and an outer panel 166 disposed about a front face 167 of the non-metallic inner panel 165. In one embodiment, which can be combined with other embodiments, a glass panel 168 is adhered, using a first adhesive, to a front face 169 of the outer panel 166 of each of the modular wall units 114-121. In one example, which can be combined with other examples, the first adhesive includes silicone, such as a silicone rubber sealant. In one example, which can be combined with other examples, the first adhesive includes a material meeting the ASTM C920, Class 50 standard. An aesthetic design is printed (e.g., painted) on a front exterior surface 170 of the glass panel 168 that faces the operating room 160. The glass panel 168 is a second outer panel that is adhered to the outer panel 166 (which is a first outer panel).

The modular wall unit 115 is disposed at least partially in the gap cover apparatus 171. The gap cover apparatus 171 covers a ceiling corner gap disposed above the modular wall unit 115. A second piece of drywall 172 extends between the gap cover apparatus 171 and the ceiling slab 201.

Figure 3:
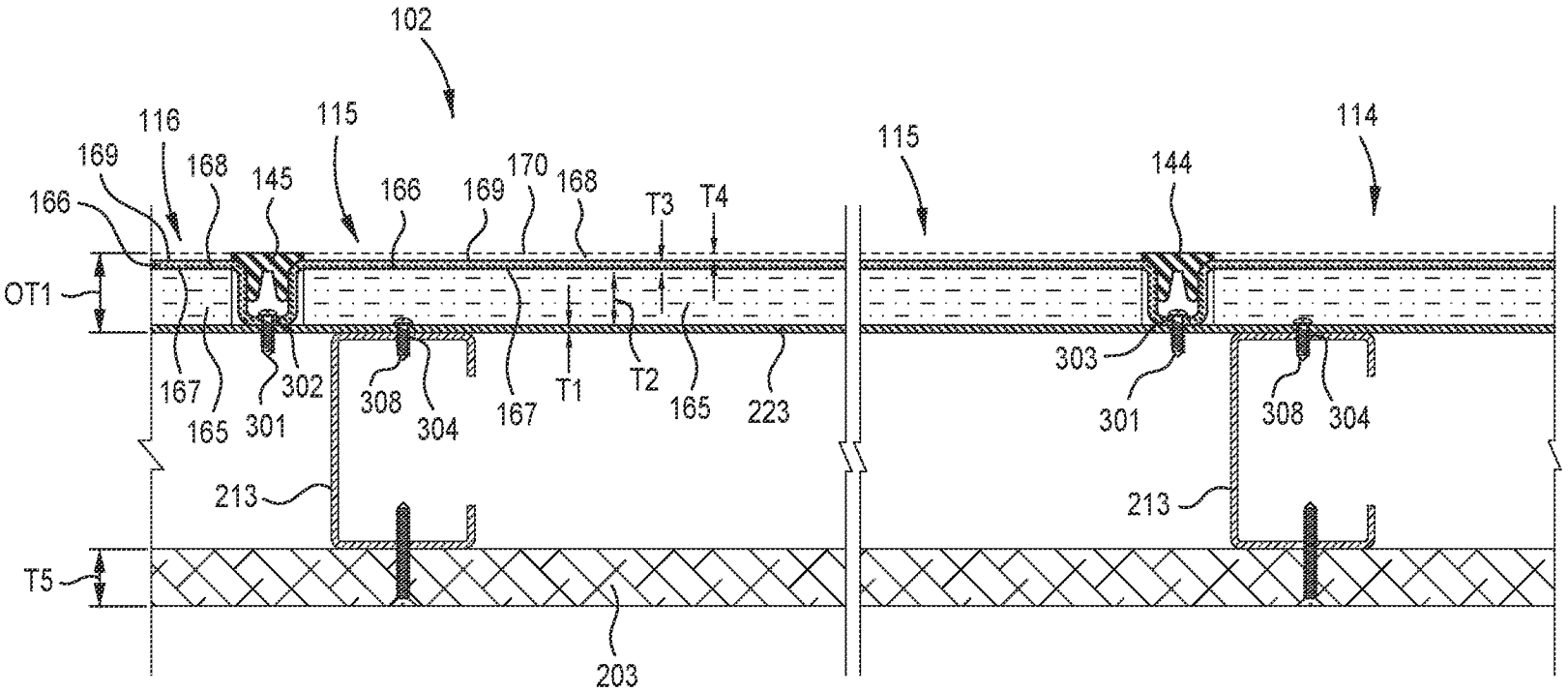
FIG. 3 is a top cross-sectional view of the second wall and the first piece of drywall shown in FIG. 2, along Section 3-3, according to one implementation.

FIG. 3 is a top cross-sectional view of the second wall 102 and the first piece of drywall 203 shown in FIG. 2, along Section 3-3, according to one implementation. The outer panel 166 of each of the modular wall units 114-116 is fastened to the same backplate 223 using a plurality of first fasteners 301 extending through a plurality of first fastener openings 302 and a plurality of second fasteners extending through a plurality of second fastener openings 303 (shown in FIG. 4). The plurality of second fasteners are similar to the plurality of first fasteners 301. The first fasteners 301 and the second fasteners can be screws, such as T-10 stainless steel screws. Other fasteners, such as bolts, nuts, and/or studs, are contemplates. Each of the modular wall units 114-116 includes an overall thickness OT1 that ⅞ inches (22.225 mm) relative to a front face of the studs 213, including a thickness T1 of the backplate 223. The thickness T1 of the backplate 223 is within a range of 1 mm to 2 mm, such as 1 mm (0.0394 inches). The non-metallic inner panel 165 of each modular wall unit 114-116 includes a thickness T2 that is ¼ inches (6.35 mm). The outer panel 166 of each modular wall unit 114-116 includes a thickness T3 that is ⅜ inches (9.525 mm). The present disclosure contemplates that the thickness T3 can be within a range of 1 mm to 2 mm. The glass panel 168 of each modular wall unit 114-116 includes a thickness T4 that is ¾ inches (19.05 mm). In an implementation where the glass panels 168 are omitted from the modular wall units 114-116, the thickness T2 of each non-metallic inner panel 165 is ⅝ inches (15.875 mm), and the thickness T3 of each outer panel 166 is ¾ inches (19.05 mm). The first piece of drywall 203 and the second piece of drywall 172 each has a thickness T5 that is ⅝ inches (15.875 mm).

The backplate 223 includes one or more first fastener openings 304 configured to fasten to one or more first studs (two are shown in FIG. 3) of the studs 213.

Figure 4:
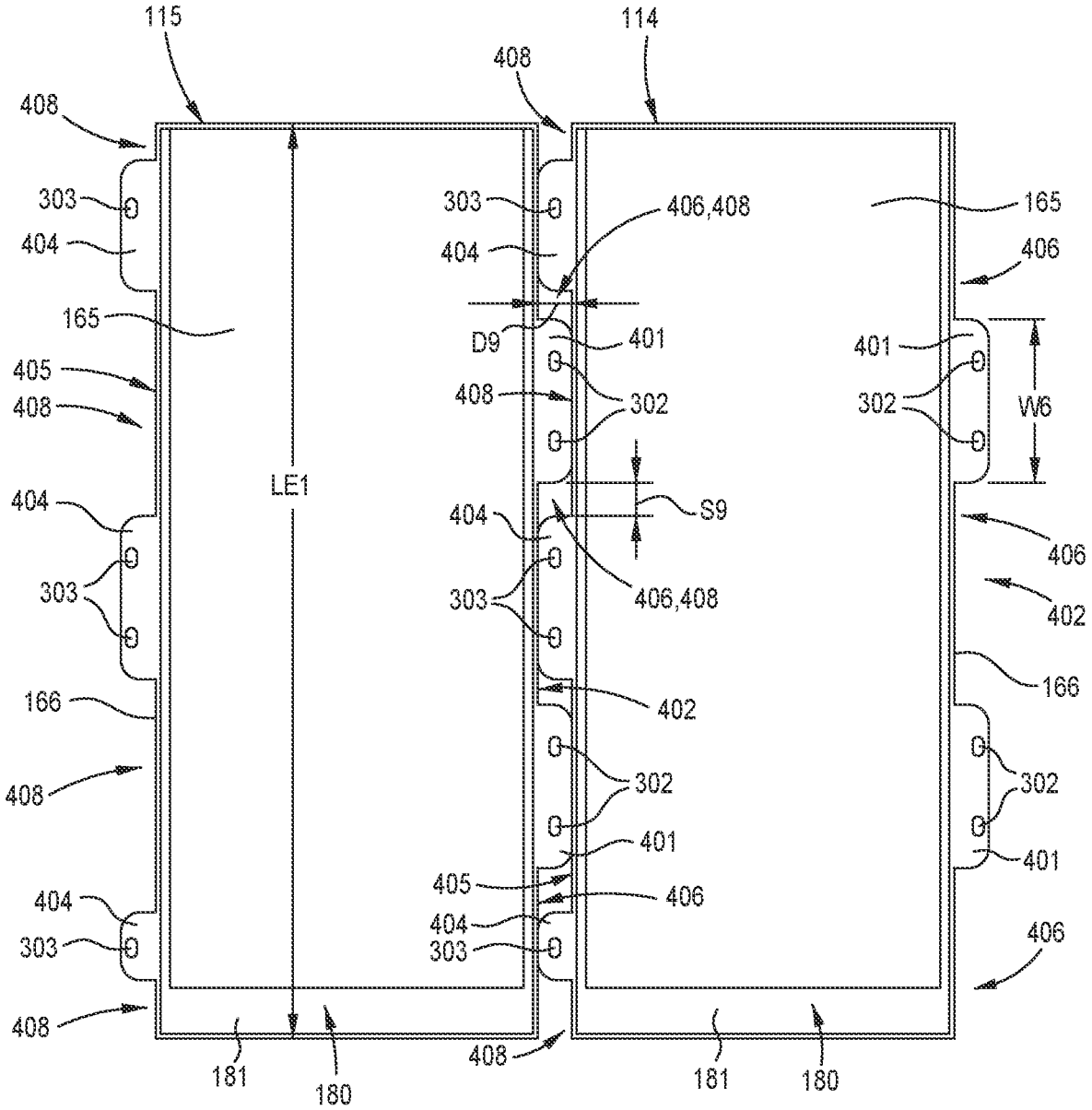
FIG. 4 is a schematic back view of the modular wall units shown in FIG. 3, according to one implementation.

FIG. 4 is a schematic back view of the modular wall units 114, 115 shown in FIG. 3, according to one implementation. The respective outer panel 166 of each modular wall unit 114, 115 includes five walls (a front wall and four side walls) disposed about the front face 167 of the respective non-metallic inner panel 165. During a method of forming the modular wall units 114, 115, the outer panel 166 is a flat sheet of metal having the thickness T3, and flat sheet of metal is bent into the shape of a rectangular prism that has the front wall and the four side walls. The non-metallic inner panel 165 is adhered, using a second adhesive, to an inner surface 181 of a back face 180 of the respective outer panel 166. The second adhesive includes one or more hydrofluoroolefins, such as trans-1,3,3,3-Tetrafluoroprop-1-ene (HFO-1234ze), and the second adhesive is water based. The second adhesive is pressure sensitive. In one example, which can be combined with other examples, the second adhesive is applied with a spray-gun and the second adhesive dries and tacks in less than 1 minute, such as about 20 seconds. Each of the modular wall units 114, 115 includes one or more first flanges 401 (two are shown) extending relative to a first side 402 of the outer panel and having the plurality of first fastener openings 302 formed in the one or more first flanges 401. The modular wall units 114, 115 each include one or more second flanges 404 (three are shown) extending relative to a second side 405 of the respective outer panel 166 and having the plurality of second fastener openings 303 formed in the one or more second flanges 404. For each modular wall unit 114, 115 the second side 405 opposes the first side 403.

The one or more first flanges 401 include a plurality of first flanges 401 spaced from each other along a first pattern having first gaps 406. The first gaps 406 are disposed between the first flanges 401 and outside of the first flanges 401. The one or more second flanges 404 include a plurality of second flanges 404 spaced from each other along a second pattern having second gaps 408. The second gaps 408 are disposed between the second flanges 404 and outside of the second flanges 404. The plurality of first flanges 401 are aligned with the second gaps 408 and the plurality of second flanges 404 are aligned with the first gaps 406.

The first pattern (of the first flanges 401 and the first gaps 406) is configured to interleave with the second pattern (of the second flanges 404 and the second gaps 408) in an alternating arrangement. In FIG. 4, the first pattern of the modular wall unit 115 is shown as interleaved with the second pattern of the modular wall unit 114 in the alternating arrangement. Each of the modular wall units 111-125 shown in FIG. 1 is arranged and fastened to a plurality of backplates for the respective wall 101-103 with first and second flanges 401, 404 in the alternating arrangement described for the modular wall units 114, 115 shown in FIG. 4. The interleaving and alternating arrangement is used for the modular wall units 111-125 such that each modular wall unit 111-125 is independently detachable from the respective plurality of backplates by removing the first fasteners 301 and second fasteners from the first fastener openings 302 and the second fastener openings 303 of the respective modular wall unit 111-125. For example, the modular wall unit 115 can be independently detached from the backplates 221-226, the one or more base frames 208, and/or the gap cover apparatus 171 of the second wall 102 without first removing any of the other modular wall units 114 or 116-121 of the second wall 102. The independent detachment of individual modular wall units 111-125 from the backplates 221-226 of the modular wall system 100 facilitates ease of replacement of modular wall units 111-125, and ease of maintenance for the modular wall system 100. As an example, one of the modular wall units 111-125 can be independently replaced in a time that is less than 1 hour, such as 30 minutes. The independent detachment of individual modular wall units 111-125 also facilitates ease of conducting further installation of equipment. As an example, a modular wall unit 111-125 can be replaced with a modular wall unit that has a differing opening to receive equipment therein.

The interleaving and alternating arrangement also facilitates a non-progressive installation of the modular wall units 111-125 as the walls 101-103. For example, the first modular wall unit need not necessarily be installed at a corner of the operating room 160. For example, the first modular wall unit installed for the second wall 102 could be the modular wall unit 115 or the modular wall unit 117 such that the modular wall unit 115 or the modular wall unit 117 is fastened to one or more of the backplates 221-226 before the other modular wall units of the second wall 102. Each of the modular wall units 115, 117 is fastened and installed at a distance from each corner 197, 198 (shown in FIG. 1) of the second wall 102. Non-progressive installation simplifies the installation and saves time and money compared to operations that use progressive installation. The interleaving and alternating arrangement of the first and second flanges 401, 404 can be used for the gap cover apparatus 131-134 to facilitate the non-progressive installation and independent detachment thereof.

Each of the first and second flanges 401, 404 includes a width W6. The width W6 can be 6 mm or more, for example. In one embodiment, which can be combined with other embodiments, adjacent flanges 401, 404 are spaced from each other by a spacing S9 in the interleaving and alternating arrangement. The spacing S9 can be 10 mm, for example. In one embodiment, which can be combined with other embodiments, each of the first and second fastener openings 302, 303 is a longitudinal slot having two semi-circular end sections and a rectangular middle section. A length of the rectangular middle section can be 6 mm, for example, and a radius of the two semi-circular end sections can be 1.78 mm, for example. Each first and second fastener opening 302, 303 can be positioned at a distance from all sides of the respective flange 401, 404, and the distance can be 3 mm, for example. In the interleaving and alternating arrangement, adjacent outer panels 166 can be disposed at a distance D9 from each other, and the distance D9 can be 6 mm, for example.

Figure 5:
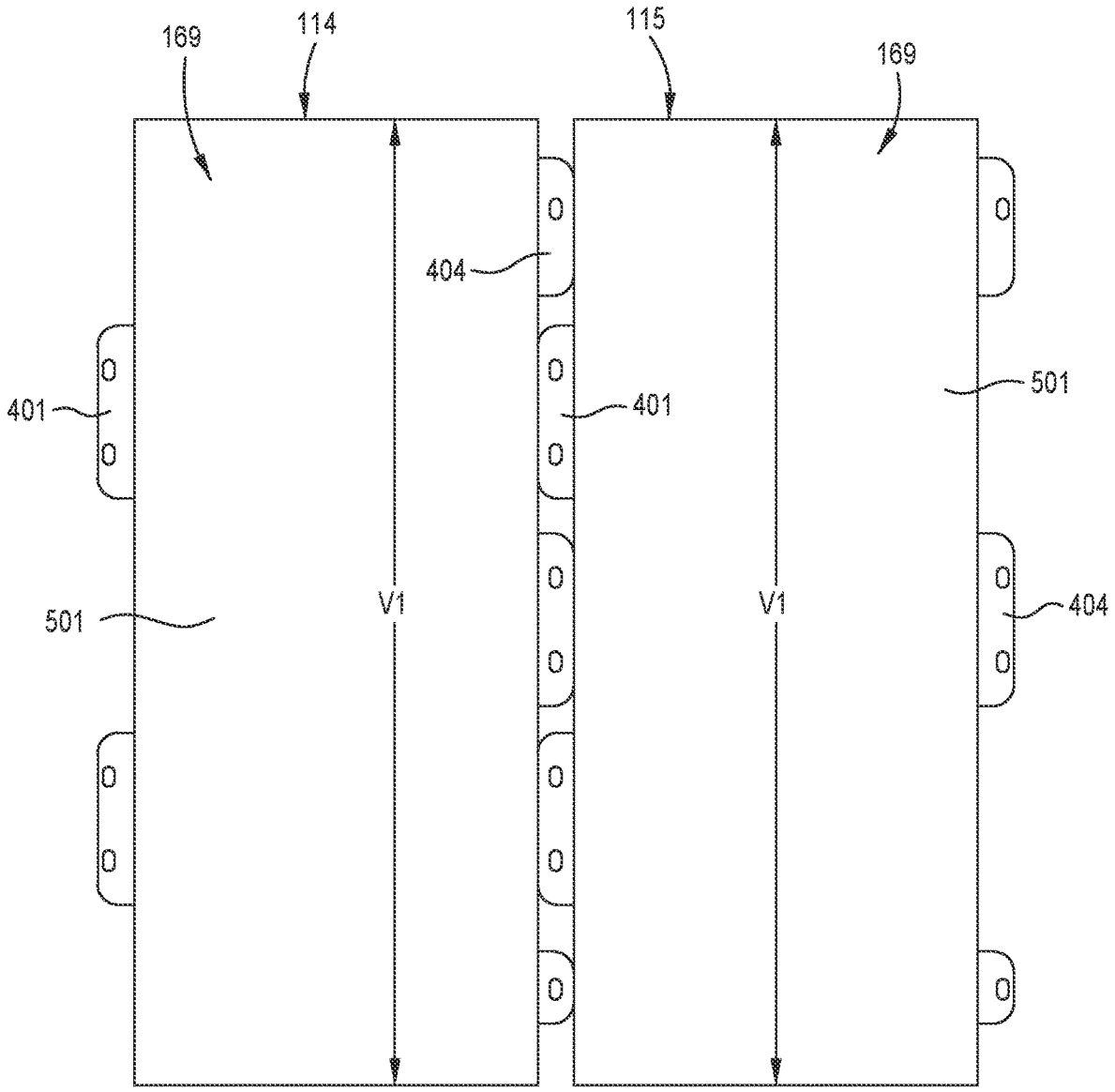
FIG. 5 is a schematic front view of the modular wall units shown in FIG. 4, according to one implementation.

FIG. 5 is a schematic front view of the modular wall units 114, 115 shown in FIG. 4, according to one implementation. Each modular wall unit 114, 115 includes a front face 169. The front face 169 of each modular wall unit 114, 115 includes a front exterior surface 501. The front exterior surface 501 of each outer panel 166 has an average surface roughness that is less than an average surface roughness of a front exterior surface 630 (shown in FIG. 6) of each of the plurality of backplates 221-226. A surface hardness of the front exterior surfaces 501 is approximately 750 HV. The outer panels 166 have a minimum breaking torque of 16 kg-cm, and can be bent using a minimum bending angle of 5 degrees or more.

Each outer panel 166 (including the front exterior surface 501) is formed of stainless steel. In one embodiment, which can be combined with other embodiments, each outer panel 166 (including the front exterior surface 501) is formed of 304 stainless steel, such as ASTM A666 304 (304L) stainless steel. The front exterior surfaces 501 have a Level 4 vertically brushed finish for a vertical grain. The vertical grain is applied in a vertical direction V1 on the front exterior surfaces 501.

The front exterior surfaces 501 facilitate hygienic properties of the operating room 160 and durability. For example, the modular wall units 111-125 can be used for several years (such as 3 years) without needing repair or replacement. As an example, the front exterior surfaces 501 can withstand impacts that occur during medical treatment operations conducted in the operating room 160. The present disclosure contemplates that other materials (such as extruded aluminum) may be used for each outer panel 166 (including the front exterior surface 501). In one embodiment, which can be combined with other embodiments, a powder coating and/or a galvanized finish is applied to the front exterior surfaces 501. The finish and/or the powder coating can include one or more different colors. An antimicrobial powder coating may be used. Other finishes and/or coatings are contemplated. Each non-metallic inner panel 165 is formed of drywall, such as gypsum board. The present disclosure contemplates that other moisture-resistant and mold-resistant materials can be used for the non-metallic inner panels 165, such as a fiberglass-reinforced (e.g., fiberglass-backed) drywall or a honeycomb structural material. The backplates 221-226 are each formed of a metal, such as steel, for example 16 gauge steel. The metal of the backplates 221-226 can be stainless steel or carbon steel, for example. Other gauges of steel and other materials (such as aluminum) are contemplated for the backplates 221-226. The first piece of drywall 203 and the second piece of drywall 172 are each formed of drywall, such as gypsum board.

The drywall referred to in the present disclosure can include Type X paneling for use on walls; can comply with ASTM C1177, C1396, C1658 and D3273; and/or can include USG Sheetrock Brand Mold Tough Panels, Firecode X, USG Brand UltraLight Panels Mold Tough Firecode X, and/or Georgia-Pacific ToughRock Fireguard X Mold-Guard Gypsum Board, for example.

The glass panels 168, if used, include front exterior surfaces 170 (shown in FIG. 3). The front exterior surface 170 of each glass panel 168 has an average surface roughness that is less than an average surface roughness of the front exterior surface 630 (shown in FIG. 6) of each of the plurality of backplates 221-226. A surface hardness of the front exterior surfaces 170 is approximately 750 HV.

Each of the walls 101-103 including the modular wall units 111-125 shown in FIG. 1 has a fire rating that is 1 hour or more. As an example, the second wall 102 and the piece of drywall 203 together form a separating wall having a fire rating that is 1 hour or more. For example, the separating wall can be fire resistant against temperatures of up to 1700 degrees for at least 60 minutes. The outer panels 166 of the modular wall units 111-125 have a Class A fire rating. The outer panels 166 have a flame spread index that is less than 10 and a smoke-developed index that is less than or equal to 25. The outer panels 166 can be tested in accordance with ASTM E84 for surface burning characteristics. The outer panels 166 can have a stretcher-leveled standard of flatness.

Figure 6:
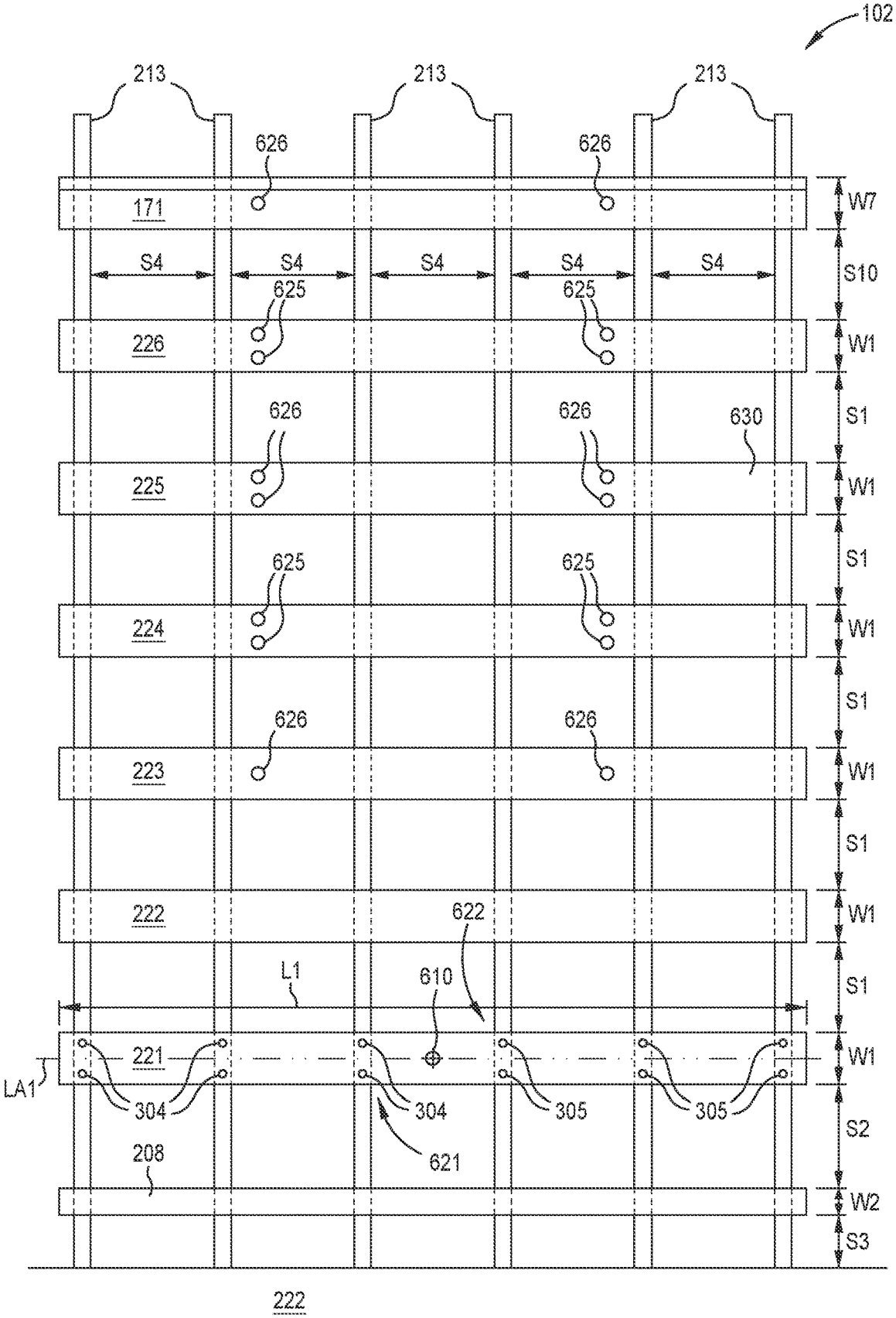
FIG. 6 is a schematic front view of the plurality of backplates of the second wall shown in FIG. 2, according to one implementation.

FIG. 6 is a schematic front view of the plurality of backplates 221-226 of the second wall 102 shown in FIG. 2, according to one implementation. In FIG. 6, the second wall 102 is shown with the backplates 221-226 fastened to the studs 213, before the modular wall units 114-121 are fastened to the backplates 221-226. Each of the plurality of backplates 221-226 includes a length L1 that is larger than a width W1, and a longitudinal axis LA1 extending along the length L1. Each of the plurality of backplates 221-226 has a four-sided rectangular cross-section that includes the width W1 and the thickness T1. The four-sided rectangular cross-section having the width W1 and the T1 is continuous across the respective length L1 for each backplate 221-226. The longitudinal axis LA1 includes a center 610. The width W1 is larger than the thickness T1 of the backplates 221-226. The width W1 can be about 150 mm (5.906 inches). A backplate spacing S1 between the backplates 221-226 can be the same across the backplates 221-226 or can vary across the backplates 221-226. The backplate spacing S1 is about 260 mm (10.236 inches). A width W2 of the one or more base frames 208 is about 77 mm (3.032 inches). A spacing S2 between the one or more base frames 208 and the lowermost backplate 221 is about 298 mm (11.732 inches), and a spacing S3 between the one or more base frames 208 and the floor slab 202 is about 152 mm (5.984 inches). The gap cover apparatus 171 has a width W7 and is disposed at a spacing S10 from the backplate 226. The width W7 can be the same as the width W1, and the spacing S10 can be the same as the spacing S1.

Each of the plurality of backplates 221-227 includes one or more first fastener openings 304 disposed on a first side 621 of the center 610 and configured to fasten to one or more first studs 213 of the studs 213. Each of the plurality of backplates 221-227 includes one or more second fastener openings 305 disposed on a second side 622 of the center 610 and configured to fasten to one or more second studs 213 of the studs 213.

One or more of backplates 221-227 includes a plurality of third fastener openings 625, 626. One or more of the plurality of third fastener openings 625 are configured to align with one or more of the plurality of first fastener openings 302 formed in the one or more first flanges 401 of one of the plurality of modular wall units 111-125. One or more of the plurality of third fastener openings 626 are configured to align with one or more of the plurality of second fastener openings 303 formed in the one or more second flanges 404 of one of the plurality of modular wall units 111-125. In one embodiment, which can be combined with other embodiments, the fastener openings 304, 305, 625, 626 are not yet formed in the backplates 221-227 when the backplates 221-227 arrive at the operating room 160 for installation. In such an embodiment, the backplates 221-227 arrive at the operating room 160 as flat sheet metal. The fastener openings 304, 305, 625, 626 can be formed in the respective backplates 221-227 at the operating room 160 by drilling through the backplates 221-227 with a drill bit and/or by drilling a fastener through the backplates 221-227. In one embodiment, which can be combined with other embodiments, the first fastener openings 302 and the second fastener openings 303 are already formed in the first and second flanges 401, 404 upon arriving at the operating room 160 for installation.

The third fastener openings 625 receive the first fasteners 301 therethrough, the third fastener openings 626 receive the second fasteners therethrough, and the first and second fastener openings 304, 305 receive a plurality of third fasteners 308 therethrough to fasten the backplates 221-227 to the studs 213. A spacing S4 between the studs 213 can be constant across the studs 213. The modular wall units 111-125 each can be fastened to the backplates 221-227. Although the spacing S4 is constant, the first and second fastener openings 302, 303 may not necessarily align with one of the studs 213 for fastening depending on the configuration of the operating room 160. The backplates 221-227 facilitate quickly and accurately fastening the modular wall units 111-125 for installation in a variety of configurations for hygienic environments. As an example, the same modular wall unit designs can be used for differing configurations of the operating room 160.

Figure 7:
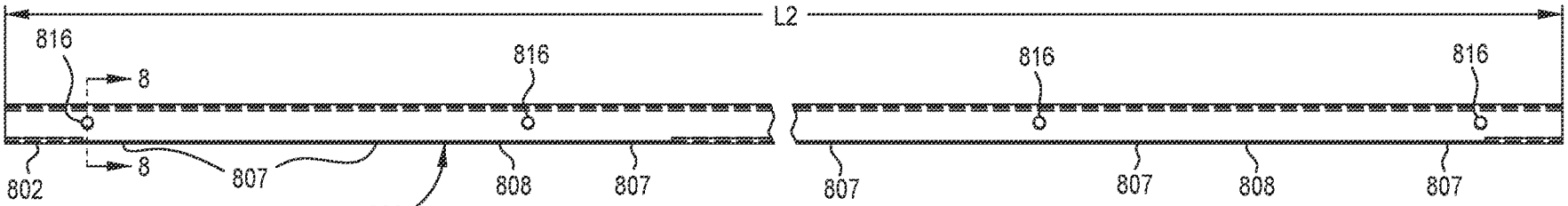
FIG. 7 is a schematic back view of a gap cover apparatus, according to one implementation.

FIG. 7 is a schematic back view of a gap cover apparatus 800, according to one implementation. The gap cover apparatus 800 includes a length L2. The length is 2,888 mm (113.701 inches). The gap cover apparatus 800 can be referred to as an edge trim for the respective modular wall unit 111-125 against which the gap cover apparatus 800 abuts. The gap cover apparatus 131-134 can be referred to as edge trim for adjacent modular wall units 111-125.

Figure 8:
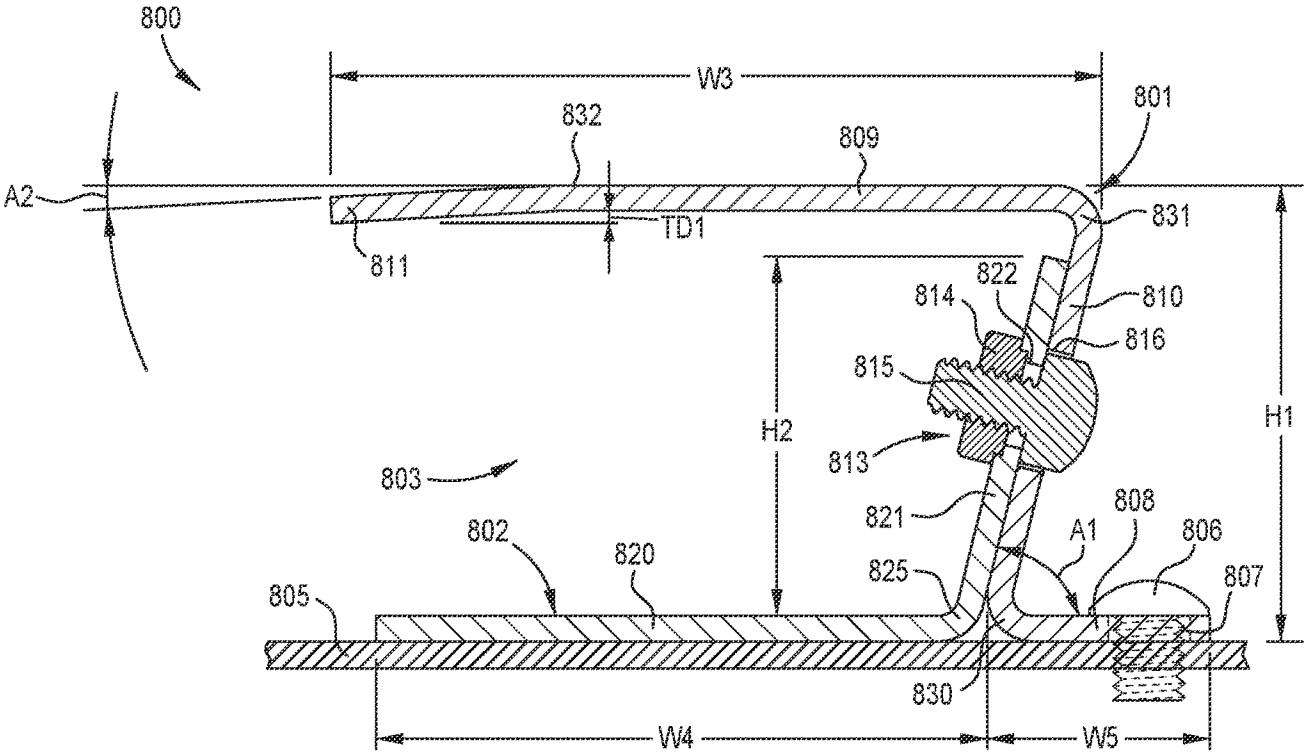
FIG. 8 is a schematic cross-sectional view of the gap cover apparatus shown in FIG. 7, along Section 8-8, according to one implementation.

FIG. 8 is a schematic cross-sectional view of the gap cover apparatus 800 shown in FIG. 7, along Section 8-8, according to one implementation. The gap cover apparatus 800 can be used as the gap cover apparatus 131-134 of the modular wall system 100 shown in FIG. 1. The gap cover apparatus 800 is configured to cover one or more gaps of the walls 101-103. The gaps can be between modular wall units 111-125 and/or can be disposed at outer edges of the modular wall units 111-125. The gaps can be disposed at corners and/or outer sides of the walls 101-103.

The gap cover apparatus 800 includes one or more brackets 801, 802 (two are shown) configured to interface with one or more of the plurality of modular wall units 111-125. The one or more brackets 801, 802 define a retaining opening 803 that at least partially receives the one or more of the plurality of modular wall units 111-125 therein. The gap cover apparatus 800 includes a plurality of first fasteners 806 configured to fasten the one or more brackets 801, 802 to a support structure 805. The support structure 805 can include one or more of the backplates 221-227, the one or more base frames 208, and/or one or more of the studs 213.

A first bracket 801 is configured to interface with the front face(s) 169 of the one or more of the plurality of modular wall units 111-125. The first bracket 801 includes a plurality of first fastener openings 807 configured to receive the plurality of first fasteners 806 therein. The first bracket 801 includes one or more back flanges 808, a front flange 809 parallel to the one or more back flanges 808, and a middle portion 810 extending between the one or more back flanges 808 and the front flange 809. The plurality of first fastener openings 807 are formed in the one or more back flanges 808. The middle portion 810 of the first bracket 801 intersects the one or more back flanges 808 and the front flange 809 at an oblique angle A1. The oblique angle is less than 90 degrees, such as 76 degrees. The front flange 809 of the first bracket 801 includes a tapered section 811 that tapers away from the front flange 809 and toward the one or more back flanges 808 at a taper angle A2. The taper angle A2 is 5 degrees or less, such as 3 degrees. The tapered section 811 at least partially defines the retaining opening 803 in which the one or more of the modular wall units 111-125 are received. The tapered section 811 can taper toward the one or more back flanges 808 by a taper distance TD1 relative to the front flange 809. The taper distance TD1 can be 1 mm or less, such as within a range of 0.5 mm to 0.7 mm.

A second bracket 802 is fastened to the first bracket 801 using a plurality of second fasteners 813. The first bracket 801 includes a plurality of second fastener openings 816 formed in the middle portion 810 and configured to receive the plurality of second fasteners 813 therein. The second bracket 802 includes a base 820 and an extending flange 821 extending relative to the base 820. The extending flange 821 of the second bracket 802 extends relative to the base 820 at the oblique angle A1. The extending flange 821 includes a plurality of fastener openings 822 to align with the plurality of second fastener openings 816 formed in the middle portion 810 of the first bracket 801. The first bracket 801 includes a height H1, and the height H1 is 0.887 inches (22.5 mm). The front flange 809 has a width W3, and the width W3 is 1.5 inches (38.1 mm). Each of the second fasteners 813 includes a PEM nut 814 at least partially received in the respective fastener opening 822, and a screw 815 disposed through the respective second fastener opening 816 and through the respective fastener opening 822. Threaded bolts may be used in place of the screws 815. The second bracket 802 includes a height H2, and the height H2 is 0.75 inches (19.05 mm). The base 820 includes a width W4, and the width W4 is 1.164 inches (29.57 mm). Each of the fastener openings 822 has a diameter within a range of 0.166 inches to 0.169 inches. The one or more back flanges 808 have a width W5 that is 0.433 inches (11 mm).

Each of the first bracket 801 and the second bracket 802 of the gap cover apparatus 800 is formed of a metal. The first bracket 801 and/or the second bracket 802 can be formed of the same material as the outer panel 166. A front face of the front flange 809 having the tapered section 811 can include a finish and/or a coating similar to the finish and/or the coating of the front exterior surfaces 501. The first bracket 801 and/or the second bracket 802 can be formed of extruded aluminum, such as ASTM B221/B221M aluminum.

Figure 9:
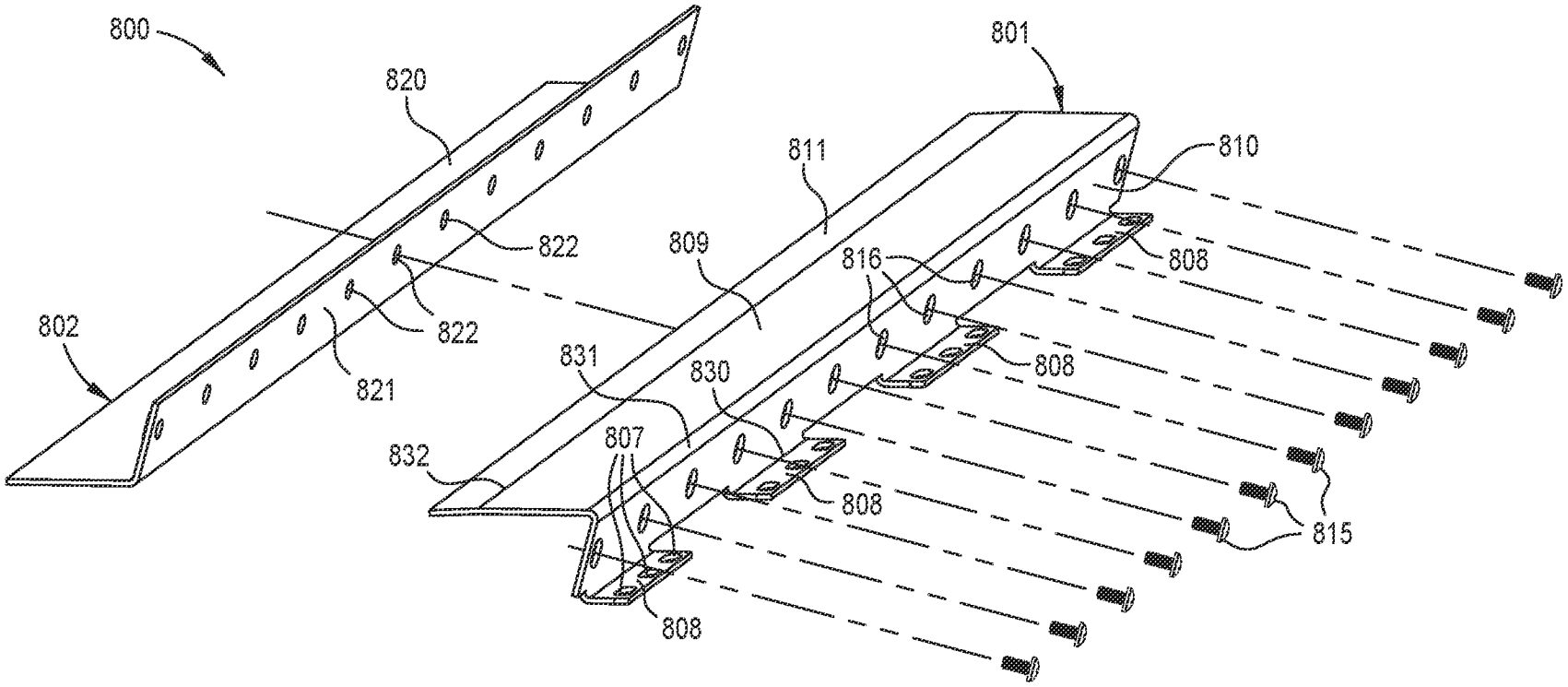
FIG. 9 is a schematic isometric exploded view of the gap cover apparatus shown in FIG. 8, according to one implementation.

FIG. 9 is a schematic isometric exploded view of the gap cover apparatus 800 shown in FIG. 8, according to one implementation. The one or more back flanges 808 of the first bracket 801 include a plurality of back flanges 808 (four back flanges 808 are shown in FIG. 9) protruding from the middle portion 810 and spaced from each other along the length L2 of the middle portion 810. Each of the back flanges 808 includes three first fastener openings 807 formed therein.

Figure 10:
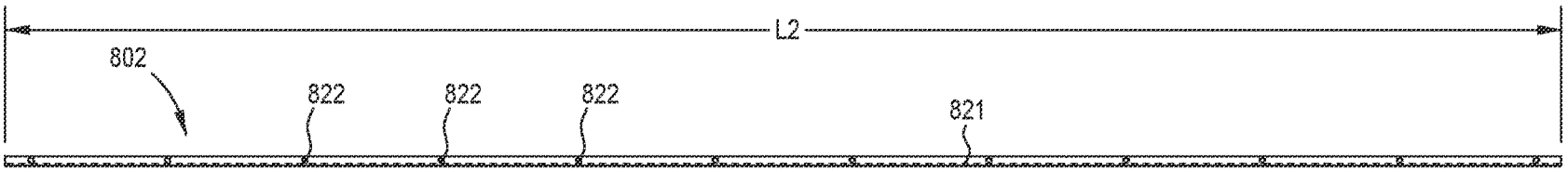
FIG. 10 is a schematic back view of the second bracket shown in FIG. 9, according to one implementation.

FIG. 10 is a schematic back view of the second bracket 802 shown in FIG. 9, according to one implementation. The view of the second bracket 802 shown in FIG. 10 is from the first bracket 801 shown in FIG. 8 and toward the extending flange 821 of the second bracket 802.

Figure 11:
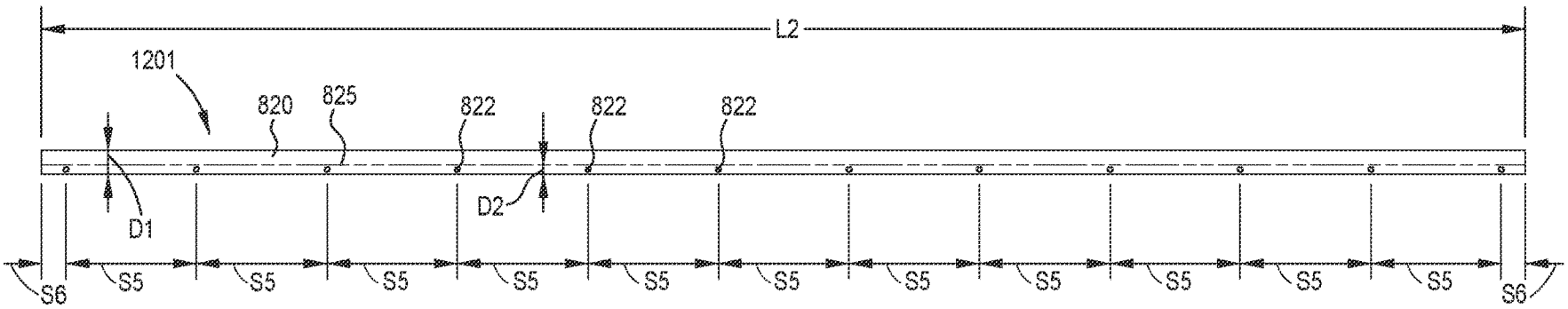
FIG. 11 is a schematic partial top view of a piece of flat sheet metal that can be used to form the second bracket shown in FIG. 8, according to one implementation.

FIG. 11 is a schematic partial top view of a piece of flat sheet metal 1201 that can be used to form the second bracket 802 shown in FIG. 8, according to one implementation. To form the second bracket 802, a bend 825 is formed between the base 820 and the extending flange 821. The fastener openings 822 are spaced from each other along the length L2 by a spacing S5. The spacing S5 is 10 inches (254 mm). The two outer fastener openings 822 nearest the two ends of the second bracket 802 are spaced by a spacing S6 from the respective ends of the second bracket 802. The spacing S6 is 1.85 inches (87 mm).

A distance D1 (before the second bracket 802 is formed, while the second bracket 802 is in the form of the flat sheet metal 1201) between an edge of what will be the base 820 and an edge of what will be the extending flange 821 is 1.859 inches (47.22 mm). A distance D2 between the edge of what will be the extending flange 821 and the bend 825 is 0.728 inches (18.49 mm).

Figure 12:
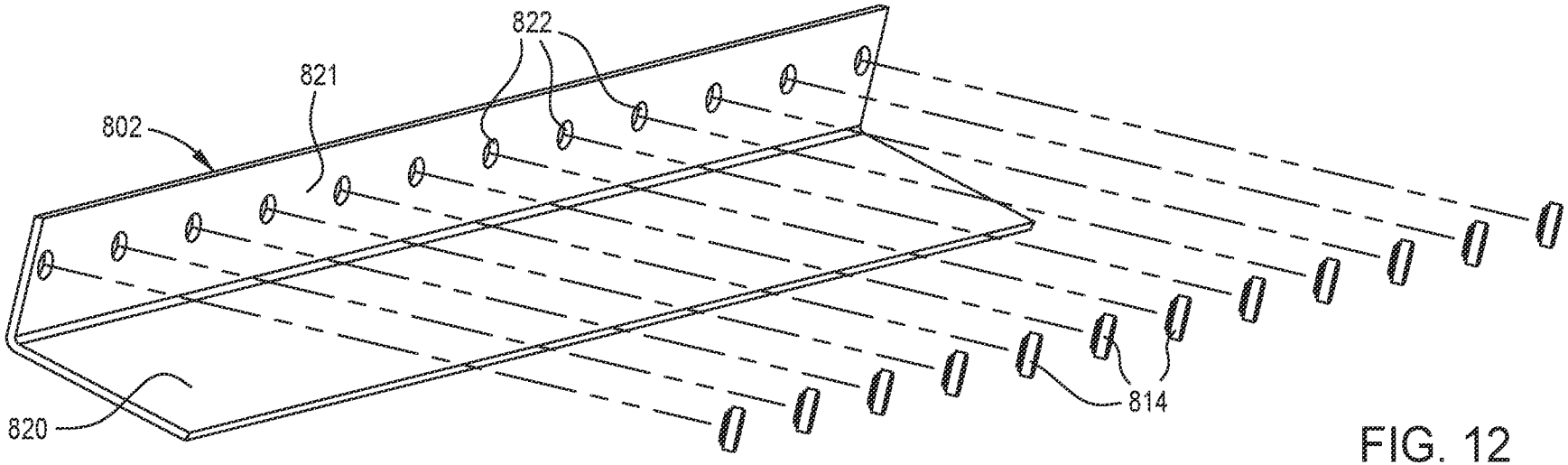
FIG. 12 is a schematic isometric exploded view of the second bracket shown in FIG. 8 and a plurality of PEM nuts, according to one implementation.

FIG. 12 is a schematic isometric exploded view of the second bracket 802 shown in FIG. 8 and a plurality of PEM nuts 814, according to one implementation. As described in relation to FIG. 11, the second bracket 802 can be formed by bending the piece of flat sheet metal 1201 into the second bracket 802. After forming the second bracket 802, the PEM nuts 814 can be received into the plurality of fastener openings 822.

Figure 13:
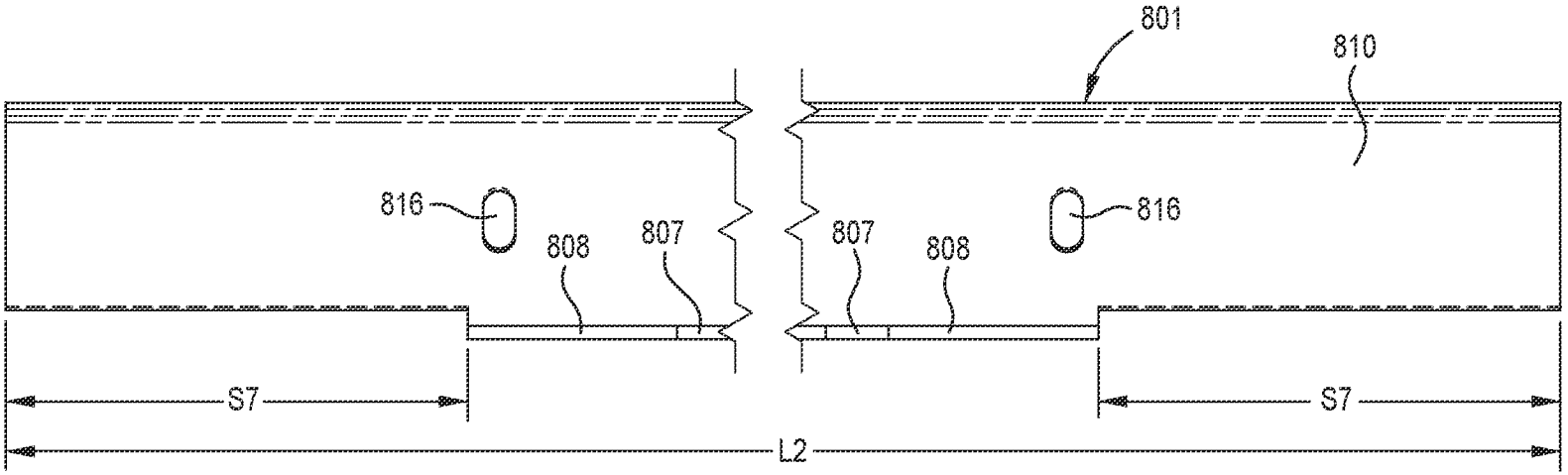
FIG. 13 is a schematic partial side view of the first bracket shown in FIG. 8, according to one implementation.

FIG. 13 is a schematic partial side view of the first bracket 801 shown in FIG. 8, according to one implementation. The side view in FIG. 13 is from the right of the first bracket 801 shown in FIG. 8. In the implementation shown in FIG. 13, the two end back flanges 808 are disposed at a spacing S7 from the two respective ends of the first bracket 801. The spacing S7 is 1.732 inches (44 mm).

Figure 14:
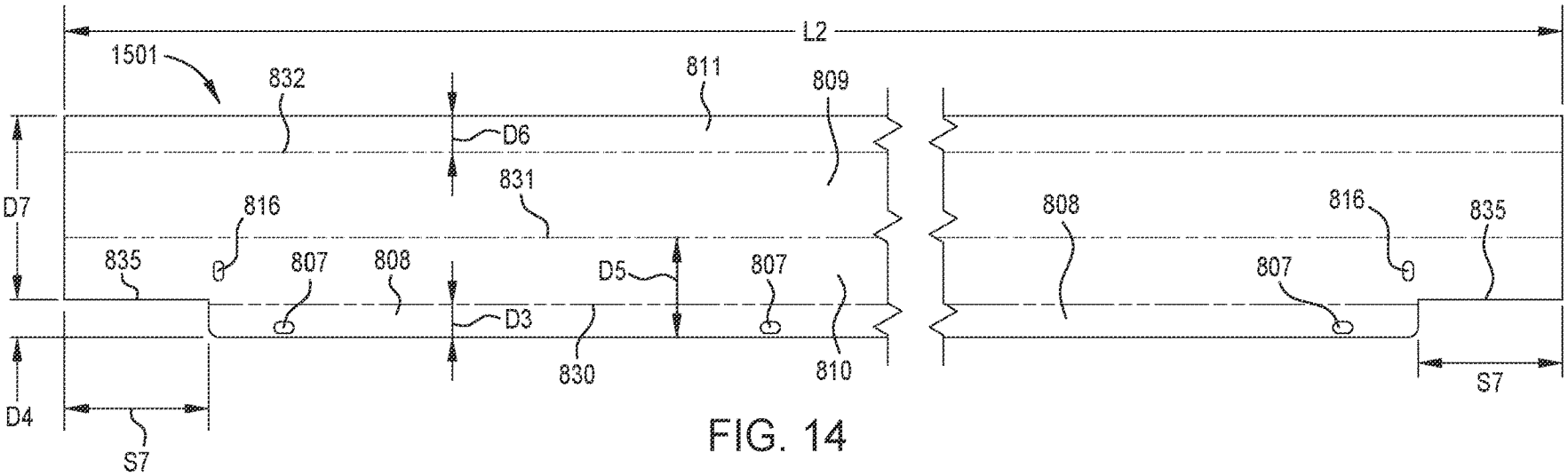
FIG. 14 is a schematic partial top view of a piece of flat sheet metal that can be used to form the first bracket shown in FIG. 8, according to one implementation.

FIG. 14 is a schematic partial top view of a piece of flat sheet metal 1501 that can be used to form the first bracket 801 shown in FIG. 8, according to one implementation. A first bend 830 is formed between the plurality of back flanges 808 and the middle portion 810. A second bend 831 is formed between the middle portion 810 and the front flange 809. A third bend 832 is formed to form the tapered section 811 of the front flange 809. Each of the first bend 830, the second bend 831, and the third bend 832 has a radius, and the radius can be 0.04 inches, for example. The bend 825 has a radius, and the radius can be 0.04 inches, for example.

A distance D3 (before the first bracket 801 is formed, while the first bracket 801 is in the form of the flat sheet metal 1501) between edges of the back flanges 808 and the first bend 830 is 0.395 inches (10.02 mm). A distance D4 between the edges of the back flanges 808 and recessed edges 835 of the piece of flat sheet metal 1501 is 0.457 inches (11.6 mm). A distance D5 between the edges of the back flanges 808 and the second bend 831 is 1.194 inches (30.32 mm). A distance D6 between the third bend 832 and an edge of what will be the tapered section 811 is 0.438 inches (11.11 mm). A distance D7 between the recessed edges 835 and the edge of what will be the tapered section 811 is 2.198 inches (55.83 mm).

Figure 15:
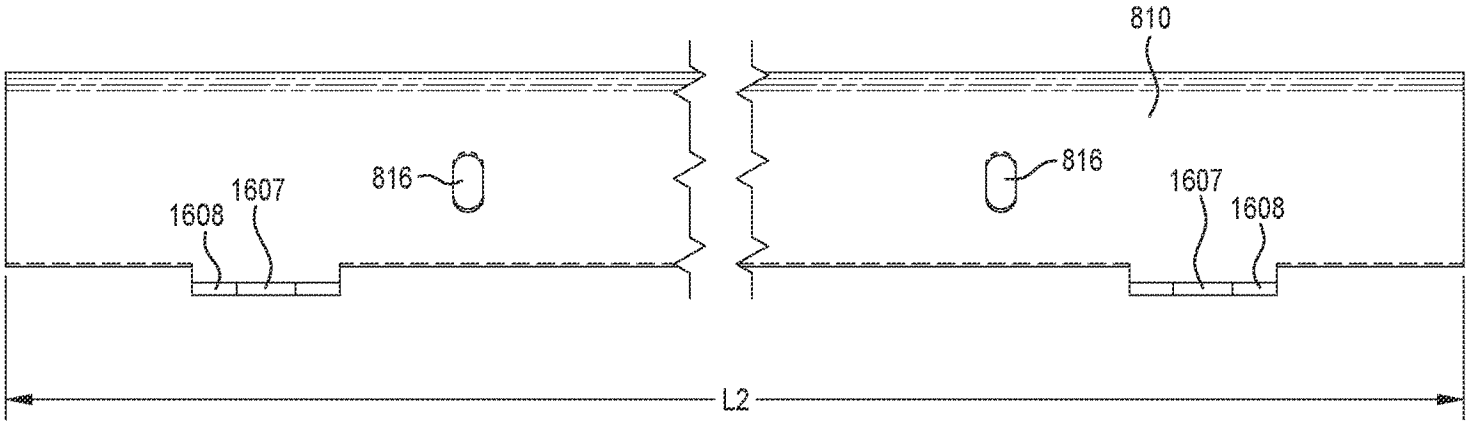
FIG. 15 is a schematic partial side view of a first bracket that may be used as the first bracket shown in FIG. 8, according to one implementation.

FIG. 15 is a schematic partial side view of a first bracket 1601 that may be used as the first bracket 801 shown in FIG. 8, according to one implementation. The first bracket 1601 is similar to the first bracket 801, and includes one or more of the aspects, features, components, and/or properties thereof. The first bracket 1601 includes a plurality of back flanges 1608 spaced from each other along the length L2 of the first bracket 1601. Each of the back flanges 1608 includes one or more first fastener openings 1607 formed in the respective back flange 1608 (one first fastener opening 1607 is shown as formed in each back flange 1608 in FIG. 15).

Figure 16:
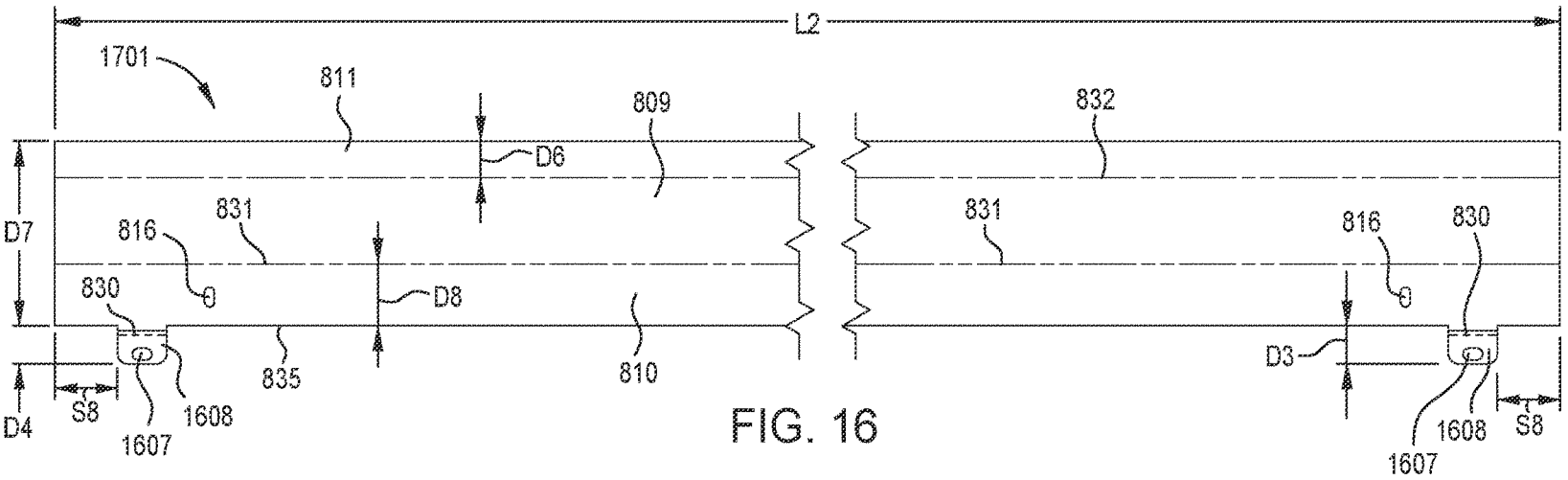
FIG. 16 is a schematic partial top view of a piece of flat sheet metal that can be used to form the first bracket shown in FIG. 15 according to one implementation.

FIG. 16 is a schematic partial top view of a piece of flat sheet metal 1701 that can be used to form the first bracket 1601 shown in FIG. 15 according to one implementation. The first bend 830 is formed between the plurality of back flanges 1608 and the middle portion 810.

A distance D8 (before the first bracket 1601 is formed, while the first bracket 1601 is in the form of the flat sheet metal 1701) between the recessed edges 835 and the second bend 831 is 0.737 inches (18.72 mm). In the implementation shown in FIG. 16, the two end back flanges 1608 are disposed at a spacing S8 from the two respective ends of what will be the first bracket 1601. The spacing S8 is 0.748 inches (19 mm).

Figure 17:
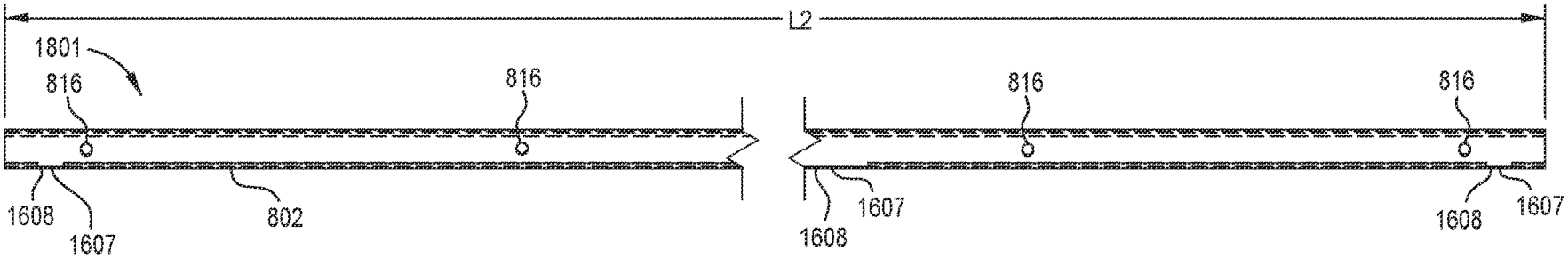
FIG. 17 is a schematic back view of a gap cover apparatus, according to one implementation.

FIG. 17 is a schematic back view of a gap cover apparatus 1800, according to one implementation. The gap cover apparatus 1800 is similar to the gap cover apparatus 800 shown in FIG. 7, and includes one or more of the aspects, features, components, and/or properties thereof. The gap cover apparatus 1800 includes the second bracket 802 shown in FIG. 8 and the first bracket 1601 shown in FIG. 15.

Figure 18:
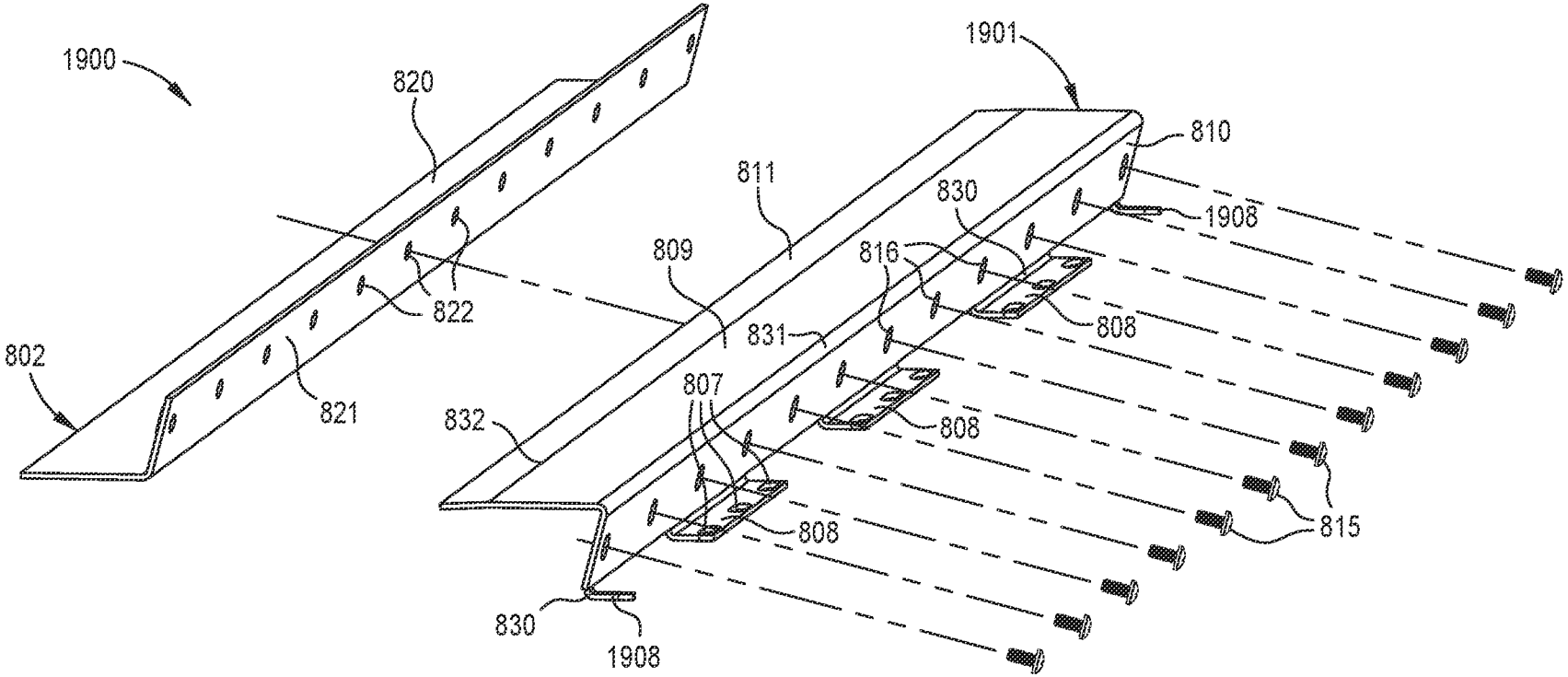
FIG. 18 is a schematic isometric exploded view of a gap cover apparatus, according to one implementation.

FIG. 18 is a schematic isometric exploded view of a gap cover apparatus 1900, according to one implementation. The gap cover apparatus 1900 is similar to the gap cover apparatus 800 shown in FIG. 9, and includes one or more of the aspects, features, components, and/or properties thereof. The gap cover apparatus 1900 includes a first set of back flanges 808 (three are shown) and a second set of back flanges 1908 (two are shown) disposed outside of the first set of back flanges 808.

Figure 19:
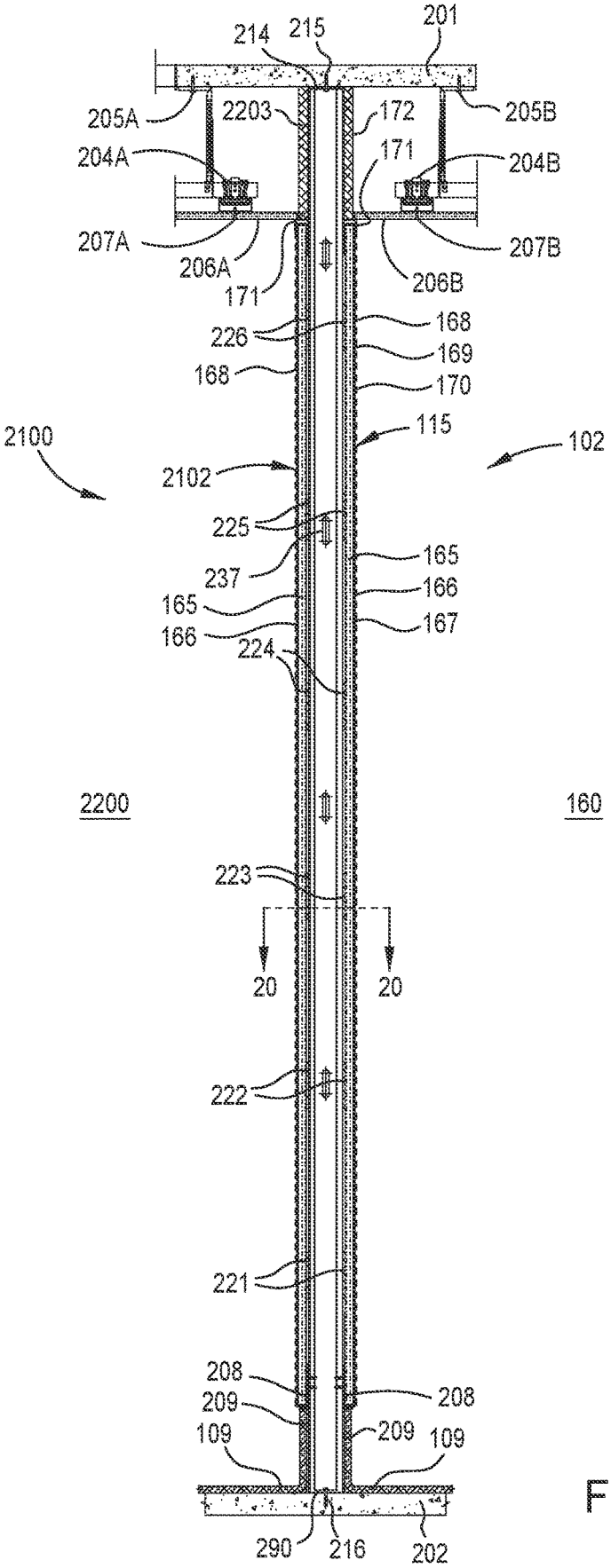
FIG. 19 is a side cross-sectional view of the second wall shown in FIG. 1, with the view running parallel to the second wall, according to one implementation.

FIG. 19 is a side cross-sectional view of the second wall 102 shown in FIG. 1, with the view running parallel to the second wall 102, according to one implementation. The second wall 102 separates the operating room 160 from a second area 2200. The second area 2200 is similar to the second area 200 shown in FIG. 2, and includes one or more of the aspects, features, components, and/or properties thereof. The second area 2200 includes a modular wall system 2100 that is similar to the modular wall system 100 and includes one or more of the aspects, features, components, and/or properties thereof. The modular wall system 2100 includes a wall 2102. The wall 2102 is similar to the second wall 102 shown in FIG. 2, and includes one or more of the aspects, features, components, and/or properties thereof. A first piece of drywall 2203 is used in addition to the second piece of drywall 172.

The wall 2102 and the second wall 102 together form a demising wall that separates the operating room 160 and the second area 2200. The wall 2102 and the second wall 102 together form a demising wall having a fire rating that is 1 hour or more.

Figure 20:
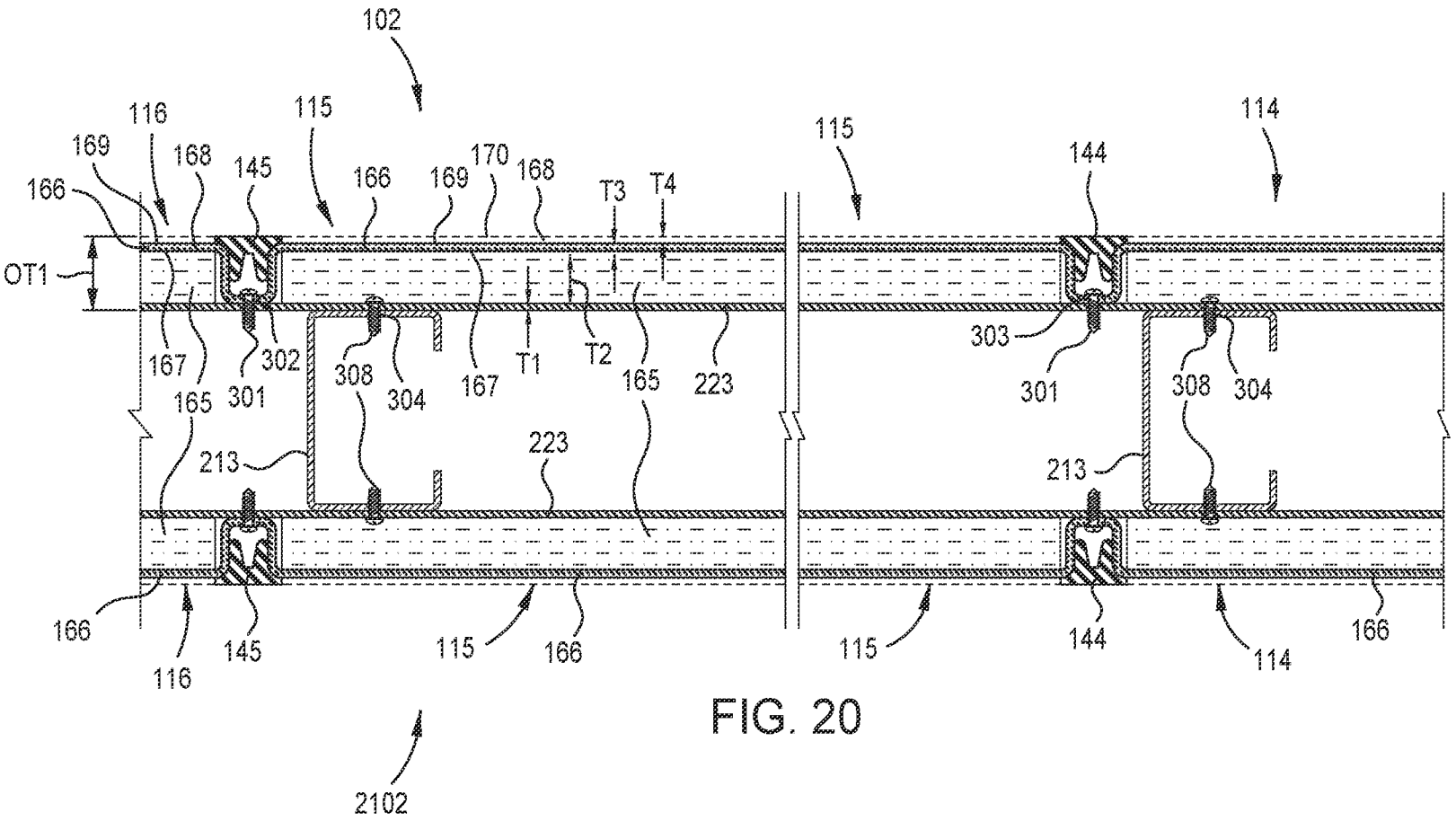
FIG. 20 is a top cross-sectional view of the wall and the second wall shown in FIG. 19, along Section 20-20, according to one implementation.

FIG. 20 is a top cross-sectional view of the wall 2102 and the second wall 102 shown in FIG. 19, along Section 20-20, according to one implementation.

Figure 21:
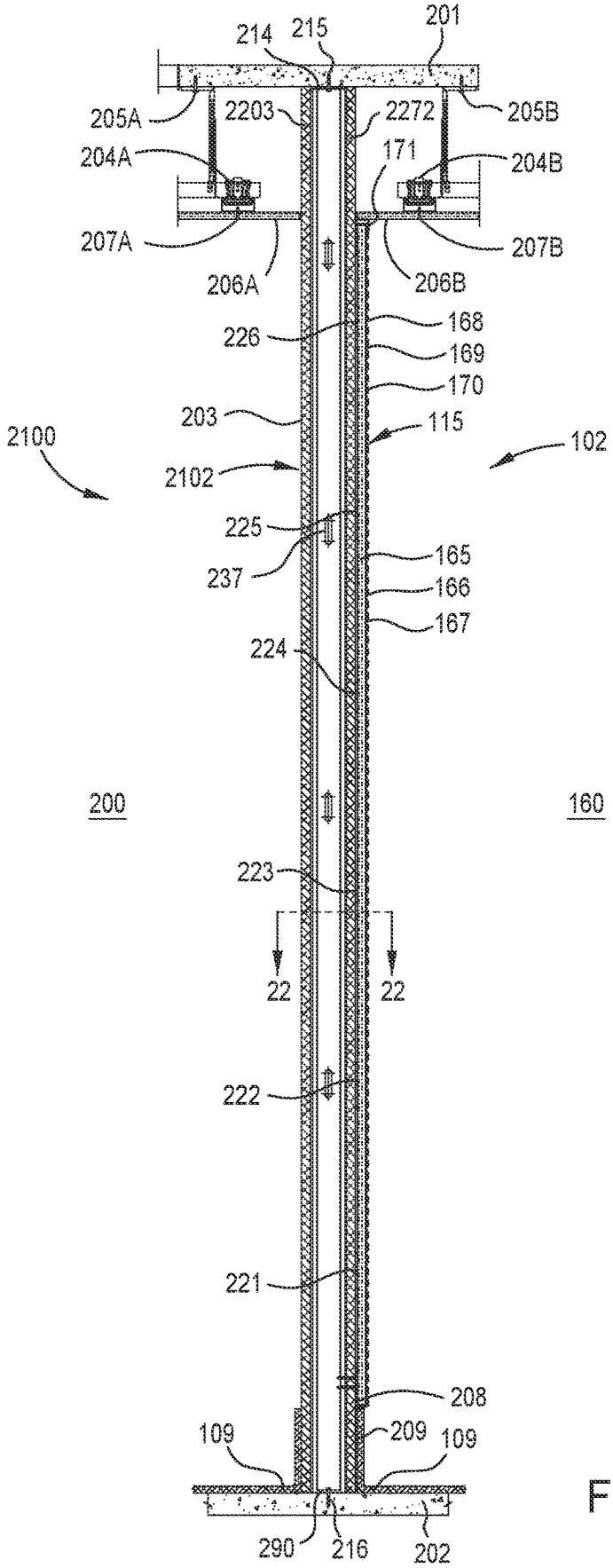
FIG. 21 is a side cross-sectional view of the second wall shown in FIG. 1, with the view running parallel to the second wall, according to one implementation.

FIG. 21 is a side cross-sectional view of the second wall 102 shown in FIG. 1, with the view running parallel to the second wall 102, according to one implementation. The second wall 102 separates the operating room 160 from a second area 2200. The first piece of drywall 203 is used, and a second piece of drywall 2272 is disposed on an opposing side of the studs 213 relative to the first piece of drywall 203. The outer panels 166 of the modular wall units 114-121 are fastened to the studs 213 through the second piece of drywall 2272.

The second wall 102, the first piece of drywall 203, the second piece of drywall 2272, and the studs 213 together form a separating wall having a fire rating that is 1 hour or more.

Figure 22:
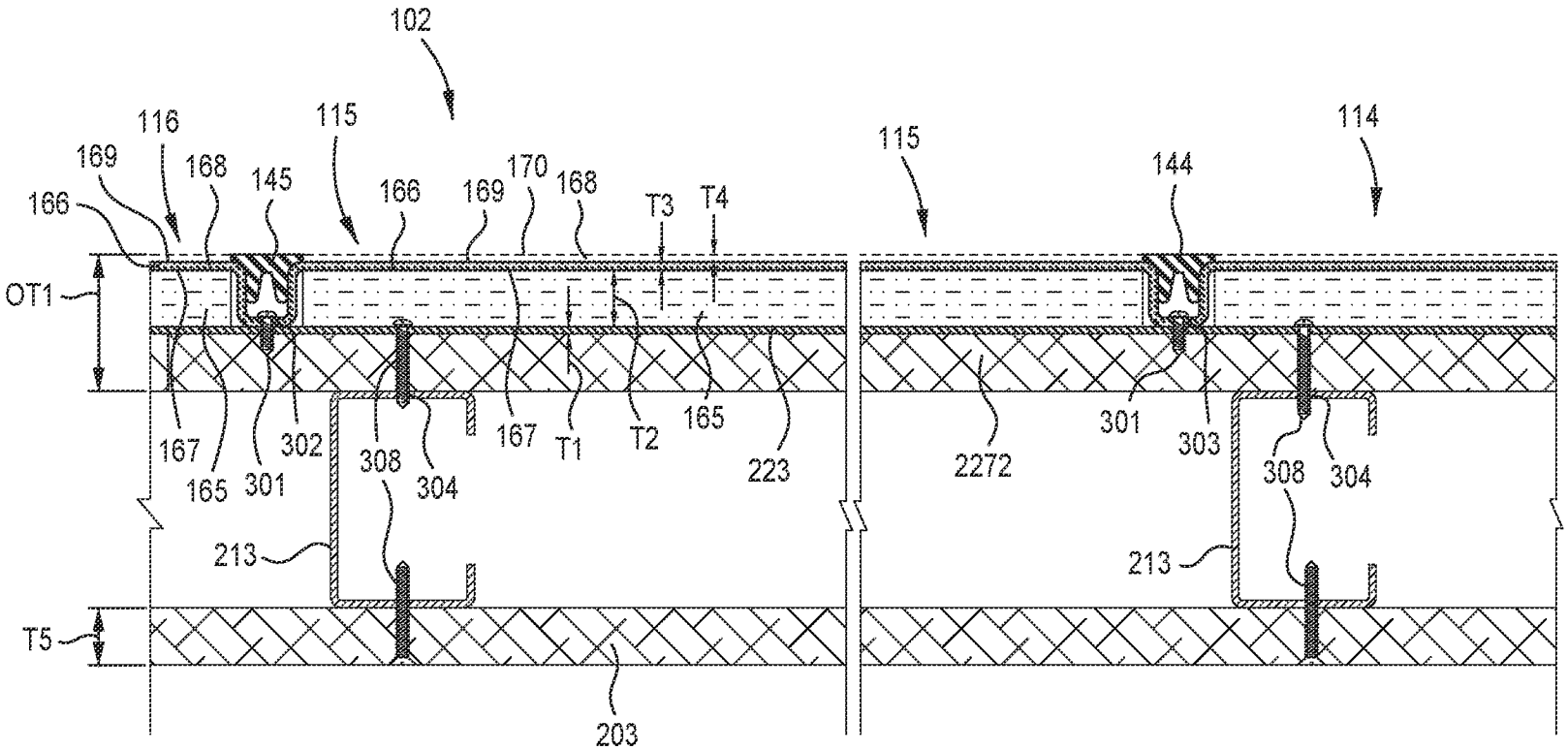
FIG. 22 is a top cross-sectional view of the second wall, the first piece of drywall, and the second piece of drywall shown in FIG. 21, along Section 22-22, according to one implementation.

FIG. 22 is a top cross-sectional view of the second wall 102, the first piece of drywall 203, and the second piece of drywall 2272 shown in FIG. 21, along Section 22-22, according to one implementation.

Figure 23:
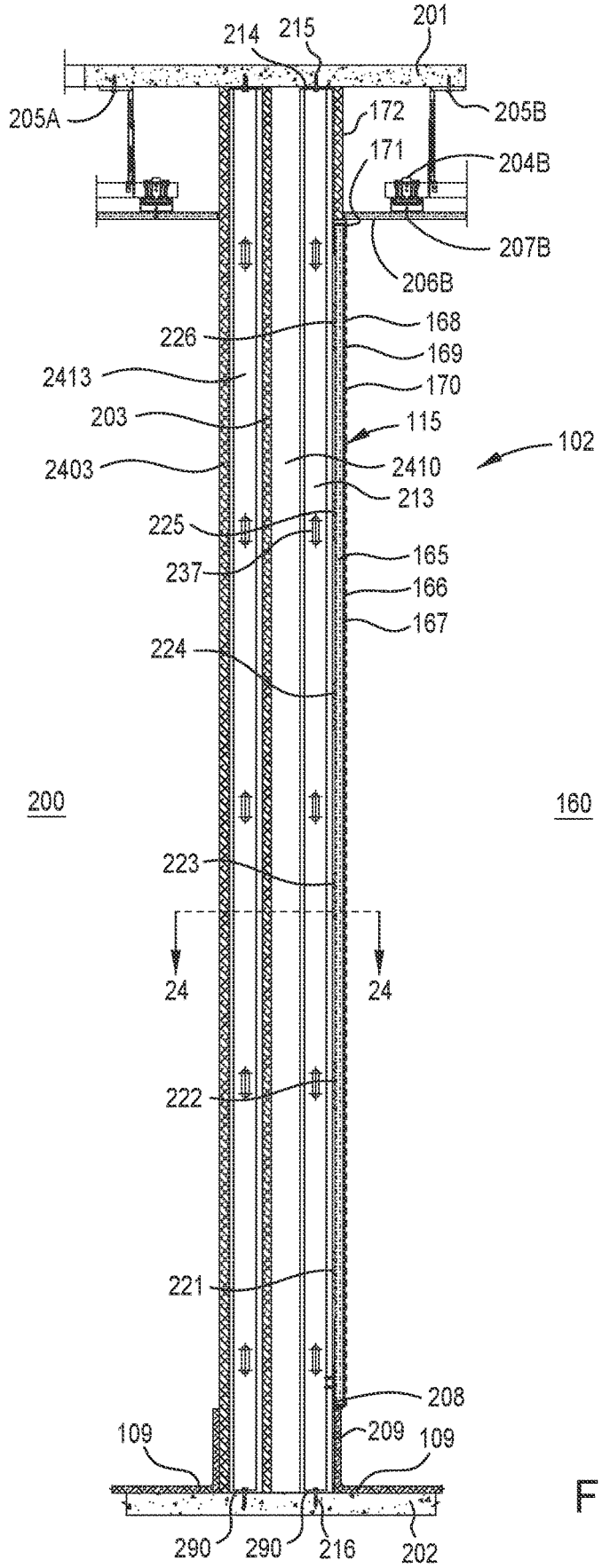
FIG. 23 is a side cross-sectional view of the second wall shown in FIG. 1, with the view running parallel to the second wall, according to one implementation.

FIG. 23 is a side cross-sectional view of the second wall 102 shown in FIG. 1, with the view running parallel to the second wall 102, according to one implementation. The first piece of drywall 203 is disposed at a gap 2410 from the studs 213. A plurality of second studs 2413 are disposed between the first piece of drywall 203 and a third piece of drywall 2403.

The second wall 102, the first piece of drywall 203, the studs 213, the second studs 2413, and the third piece of drywall 2403 together form a separating wall having a fire rating that is 1 hour or more.

Figure 24:
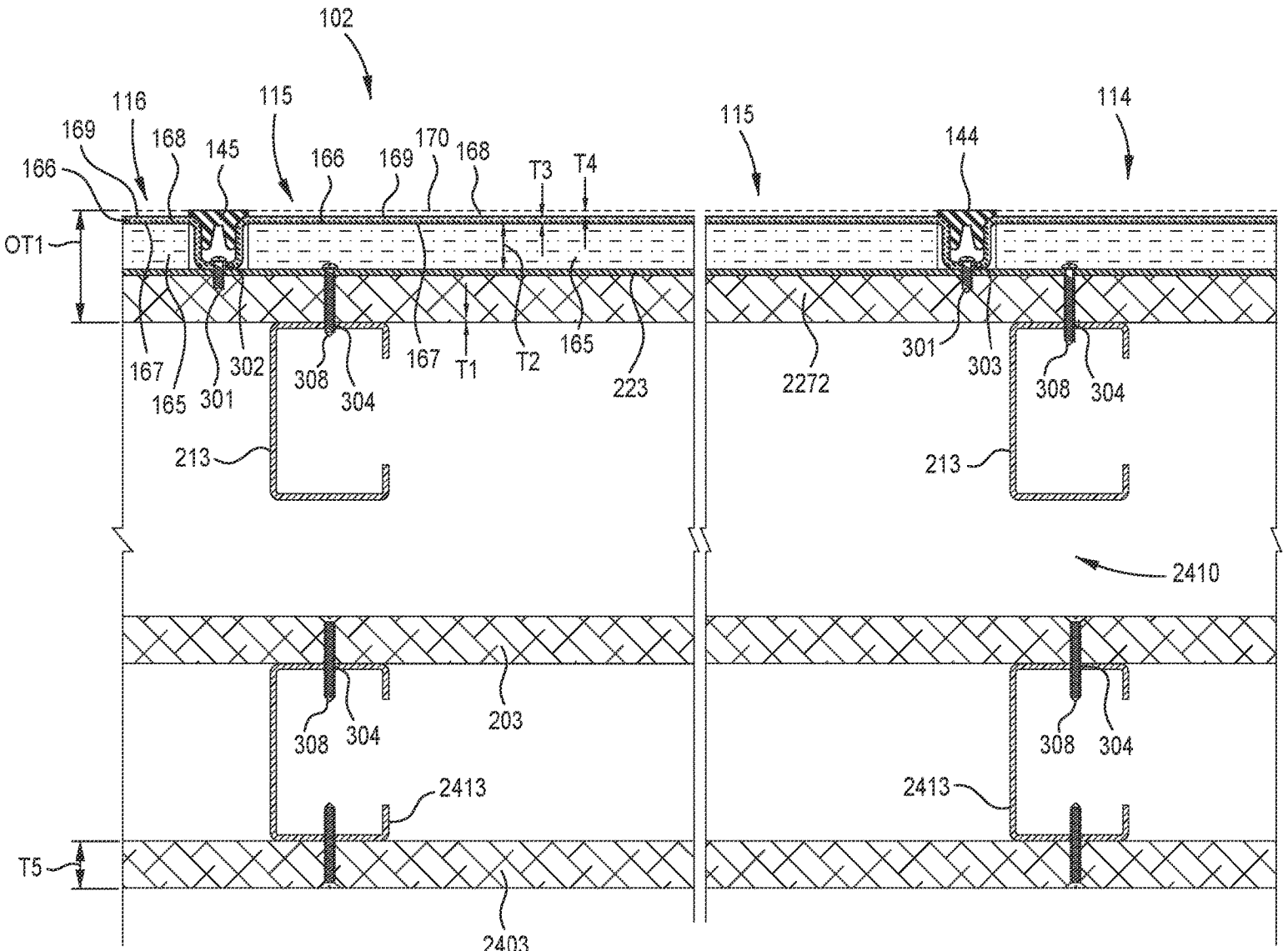
FIG. 24 is a top cross-sectional view of the second wall, the first piece of drywall, and the third piece of drywall shown in FIG. 23, along Section 24-24, according to one implementation.

FIG. 24 is a top cross-sectional view of the second wall 102, the first piece of drywall 203, and the third piece of drywall 2403 shown in FIG. 23, along Section 24-24, according to one implementation.

FIG. 25 is a top cross-sectional view of a corner apparatus 2600, according to one implementation. The corner apparatus 2600 includes a body 2601. The body 2601 is a single monolithic body that is integrally formed. The body 2601 includes a first leg 2611 intersecting a second leg 2612 perpendicularly, and a third leg 2613 intersecting a fourth leg 2614 perpendicularly. The body 2601 includes a middle wall 2615 that intersects each of the first leg 2611, the second leg 2612, the third leg 2613, and the fourth leg 2614 at an oblique angle, such as 45 degrees. The third leg 2613 is longer than the first leg 2611, and the fourth leg 2614 is longer than the second leg 2612. The third leg 2613 being longer than the first leg 2611 facilitates quickly fastening the third leg 2613 to a support structure (such as a support structure having backplates, base frames, and/or studs) in a manner that facilitates bacteria resistance prior to disposing a modular wall unit in a first opening 2621. In one example, one or more fasteners are disposed through a portion of the third leg 2613 that extends past the first leg 2611, and into the support structure. The fourth leg 2614 being longer than the second leg 2612 facilitates quickly fastening the fourth leg 2614 to a support structure (such as a support structure having backplates, base frames, and/or studs) in a manner that facilitates bacteria resistance prior to disposing a modular wall unit in a second opening 2622. In one example, one or more fasteners are disposed through a portion of the fourth leg 2614 that extends past the second leg 2612, and into the support structure.

The first opening 2621 is disposed between the first leg 2611 and the third leg 2613, and the second opening 2622 is disposed between the second leg 2612 and the fourth leg 2614. The first opening 2621 and the second opening 2622 can be referred to as a first throat and a second throat, respectively. A width WD3 of the first and second throats can be plus or minus 0.5 mm relative to a thickness of the modular wall units (such as the overall thickness OT1 of the modular wall unit 115 shown in FIG. 3). In one example, which can be combined with other examples, the width WD3 can be plus 0.5 mm relative to the thickness, and adhesive can be disposed between the corner apparatus 2600 and the respective modular wall units. In one example, which can be combined with other examples, the width WD3 can be minus 0.5 mm relative to the thickness to create a seal using an interference fit between the corner apparatus 2600 and the modular wall units without use of a separate seal (such as caulk, foam, or a gasket). The present disclosure contemplates that a separate seal can be used in addition to the seal created by the width WD3. The present disclosure contemplates that an overall thickness of the corner apparatus 2600 can be 1.6 inches, for example.

Modular wall units can be received in the openings 2621, 2622 of the corner apparatus 2600. The corner apparatus 2600 is configured to encapsulate end portions of modular wall units in the openings 2621, 2622. The corner apparatus 2600 can be a single and solid monolithic receiver that receives and secures modular wall units. Modular wall units can be fastened into positions adjacent the legs 2611, 2614. A first seal can be positioned between the third leg 2613 and the outer panel 166 of a first adjacent modular wall unit, and a second seal can be positioned between the fourth leg 2614 and a second adjacent modular wall unit. The first and second seals can each include caulk (such as a single line of caulk), a flat gasket, and/or foam. The corner apparatus 2600 forms a corner of the first adjacent modular wall unit and the second adjacent modular wall unit. The outer panel 166, the gap cover apparatus 800, and/or the corner apparatus can be formed of a material that is resistant to bacteria. The corner apparatus 2600 is a pre-fabricated monolithic corner that can provide flexibility to adjust a connected modular wall unit or a plurality of modular wall units for any room size. The plurality of modular wall units can use the same monolithic corner apparatus 2600.

FIG. 26 is a top cross-sectional view of a corner apparatus 2700, according to one implementation. The corner apparatus 2600 includes a body 2701. The body 2701 is similar to the body 2601 shown in FIG. 25, and includes one or more of the aspects, features, components, and/or properties thereof. A first leg 2711 is longer than a third leg 2713, and a second leg 2712 is longer than a fourth leg 2714.

FIG. 27 is a top cross-sectional view of a corner apparatus 2800, according to one implementation. The corner apparatus 2800 includes a body 2801. The body 2801 is a single monolithic body that is integrally formed. The body 2801 includes a first leg 2811 intersecting a second leg 2812 perpendicularly, and a third leg 2813 intersecting a fourth leg 2814 perpendicularly.

The body 2801 includes a first middle wall 2815 that intersects each of the first leg 2811 and the third leg 2813 perpendicularly, and a second middle wall 2816 that intersects each of the second leg 2812 and the fourth leg 2814 perpendicularly. The third leg 2813 is longer than the first leg 2811, and the fourth leg 2814 is longer than the second leg 2812. A first opening 2821 is disposed between the first leg 2811 and the third leg 2813, and a second opening 2822 is disposed between the second leg 2812 and the fourth leg 2814.

FIG. 28 is a top cross-sectional view of a corner apparatus 2900, according to one implementation. The corner apparatus 2900 includes a body 2901. The body 2901 is similar to the body 2801 shown in FIG. 27, and includes one or more of the aspects, features, components, and/or properties thereof. A first leg 2911 is longer than a third leg 2913, and a second leg 2912 is longer than a fourth leg 2914.

Dimensions and thicknesses are shown in FIGS. 25-28 for the corner apparatus 2600-2900. The present disclosure contemplates other dimensions and thicknesses.

Figure 30A:
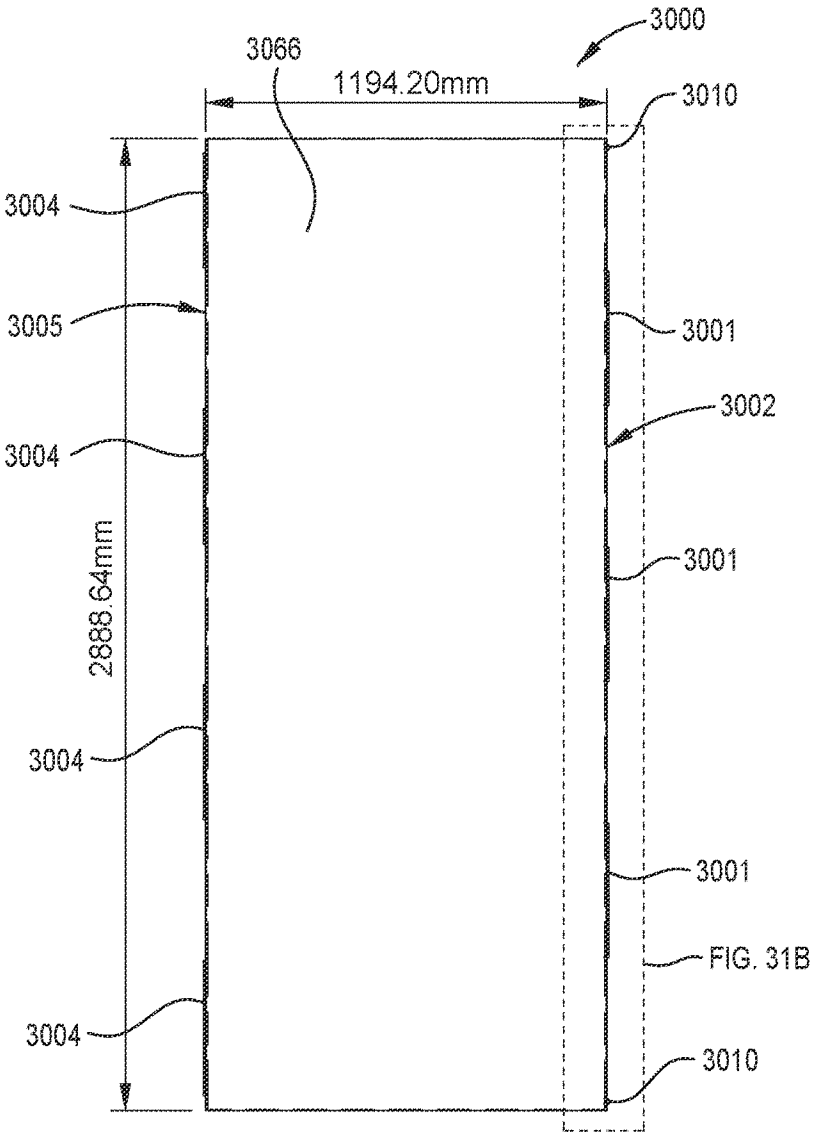
FIG. 30A is a schematic front view of the modular wall unit shown in FIG. 29, according to one implementation.
Figure 29:
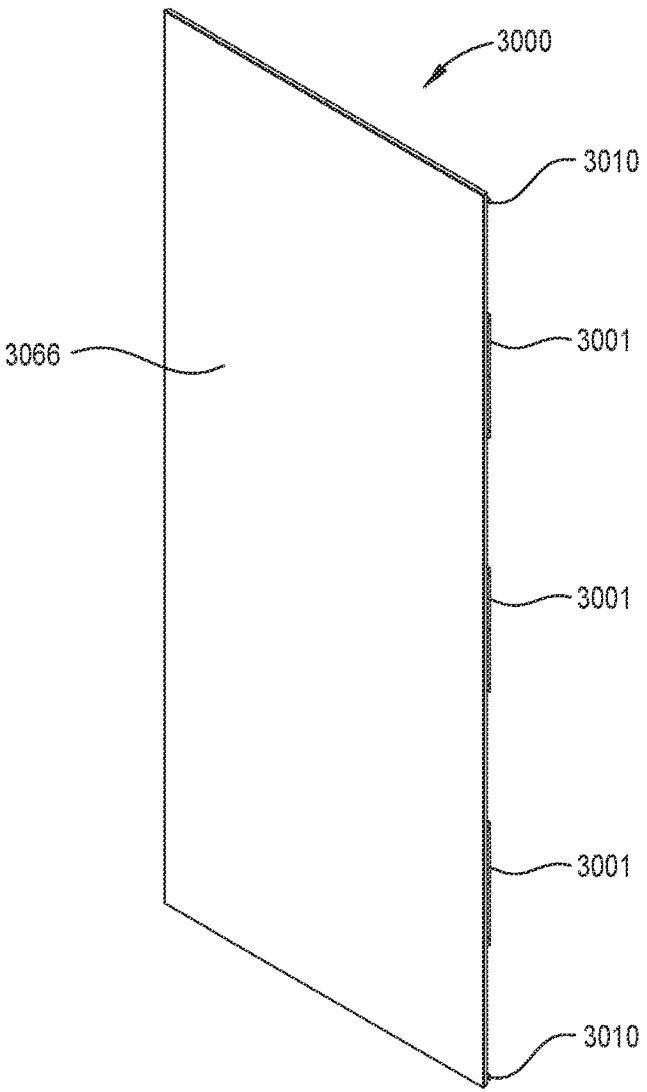
FIG. 29 is a schematic isometric front view of a modular wall unit, according to one implementation.
Figure 30B:
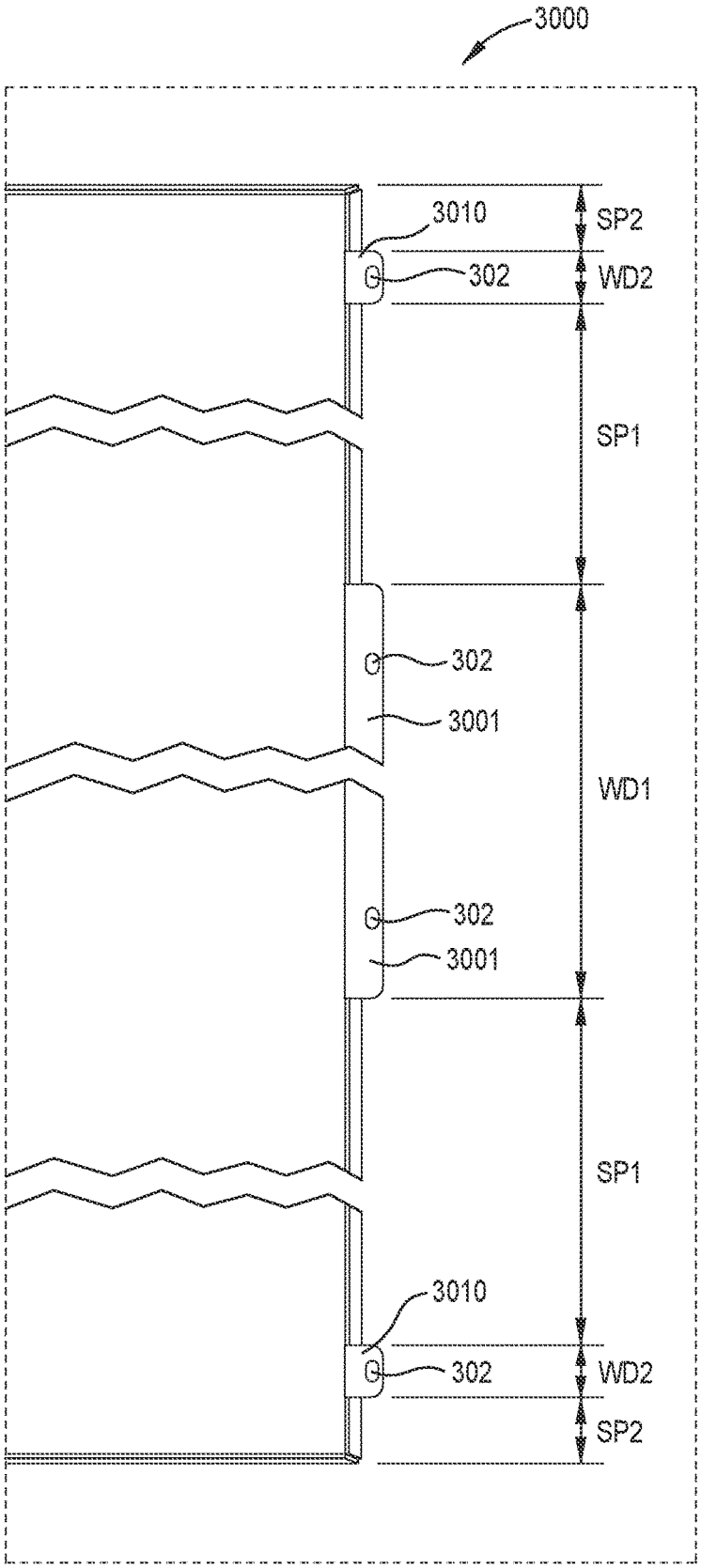
FIG. 30B is a schematic enlarged view of the modular wall unit shown in FIG. 30A, according to one implementation.

FIG. 29 is a schematic isometric front view of a modular wall unit 3000, according to one implementation. FIG. 30A is a schematic front view of the modular wall unit 3000 shown in FIG. 29, according to one implementation. FIG. 30B is a schematic enlarged view of the modular wall unit 3000 shown in FIG. 30A, according to one implementation. The modular wall unit 3000 includes an outer panel 3066 that is similar to the outer panel 166, and includes one or more of the aspects, features, components, and/or properties thereof. The outer panel 3066 is formed about the front face 167 of the non-metallic inner panel 165.

The outer panel 3066 includes one or more first flanges 3001, 3010 (five are shown) extending relative to a first side 3002 of the outer panel 3066 and having the plurality of first fastener openings 302 formed in the one or more first flanges 3001, 3010. A second set of first flanges 3010 are disposed outside of the first set of first flanges 3001. The outer panel 3066 includes one or more second flanges 3004 (four are shown) extending relative to a second side 3005 of the respective outer panel 3066 and having the plurality of second fastener openings 303 formed in the one or more second flanges 3004. Each of the first set of first flanges 3001 includes a width WD1. The width WD1 can be 400 mm, for example. Each of the second set of first flanges 3010 includes a width WD2. The width WD2 can be 15 mm, for example. The first flanges 3001, 3010 are spaced from each other by a flange spacing SP1. The flange spacing SP1 can be 420 mm, for example. In one embodiment, which can be combined with other embodiments, the width WD1 is equal to or greater than a value, the value being equal to the width W1 and the backplate spacing S1 of one or more of the backplates 221-227 added together. The present disclosure contemplates that the width WD1 can be lesser than the value. In one embodiment, which can be combined with other embodiments, the width WD1 has a difference relative to the value, and the difference is less than 4% of the value. In one embodiment, which can be combined with other embodiments, the flange spacing SP1 of first flanges 3001, 3010 is equal to or greater than the value (which is equal to the width W1 and the backplate spacing S1 of one or more of the backplates 221-227 added together).

The second set of first flanges 3010 are each disposed at a spacing SP2 from the top and bottom ends of the outer panel 3066. The spacing SP2 can be 19 mm, for example.

Figure 31B:
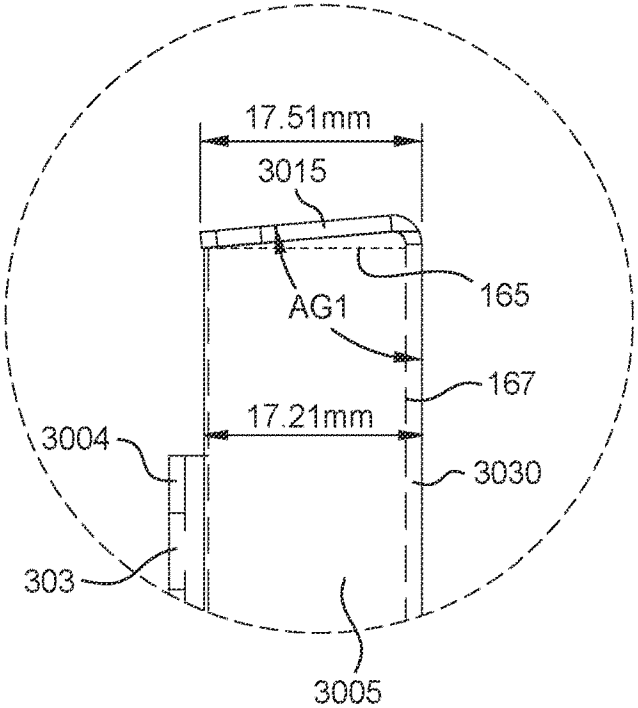
FIG. 31B is a schematic enlarged view of the modular wall unit shown in FIG. 31A, according to one implementation.
Figure 31A:
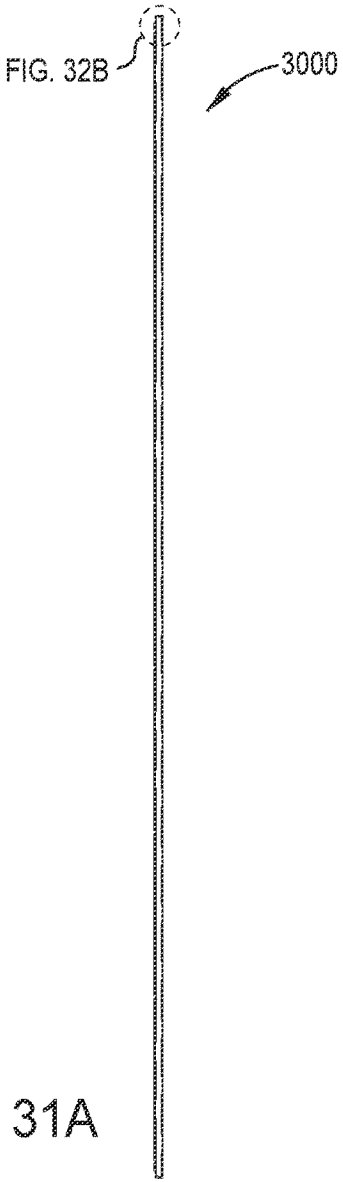
FIG. 31A is a schematic partial side view of the modular wall unit shown in FIG. 30A, according to one implementation.

FIG. 31A is a schematic partial side view of the modular wall unit 3000 shown in FIG. 30A, according to one implementation. FIG. 31B is a schematic enlarged view of the modular wall unit 3000 shown in FIG. 31A, according to one implementation. Top and bottom sides (of the four sides) of the outer panel 3066 are bent about sides of the non-metallic inner panel 165 at an oblique angle AG1 relative to a front side 3030 of the outer panel 3066. The top and bottom sides are bent back toward the non-metallic inner panel 165. The oblique angle AG1 can be 85 degrees, for example.

The top side 3015 of the outer panel 3066 is shown in FIG. 31A.

Figure 32A:
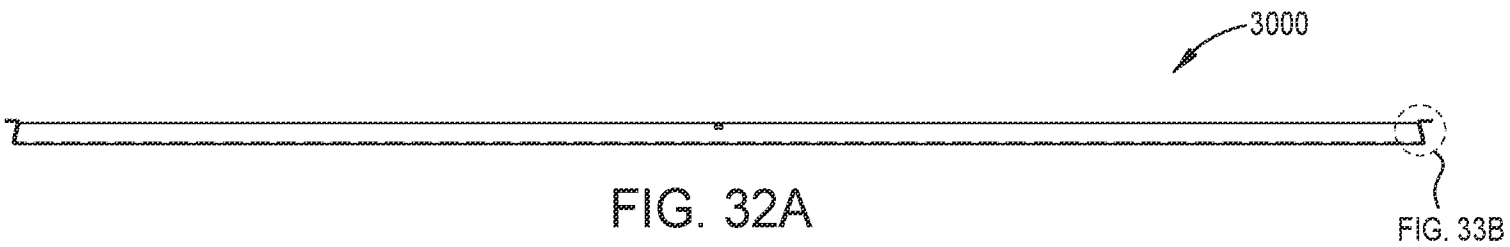
FIG. 32A is a schematic partial top view of the modular wall unit shown in FIG. 30A, according to one implementation.
Figure 32B:
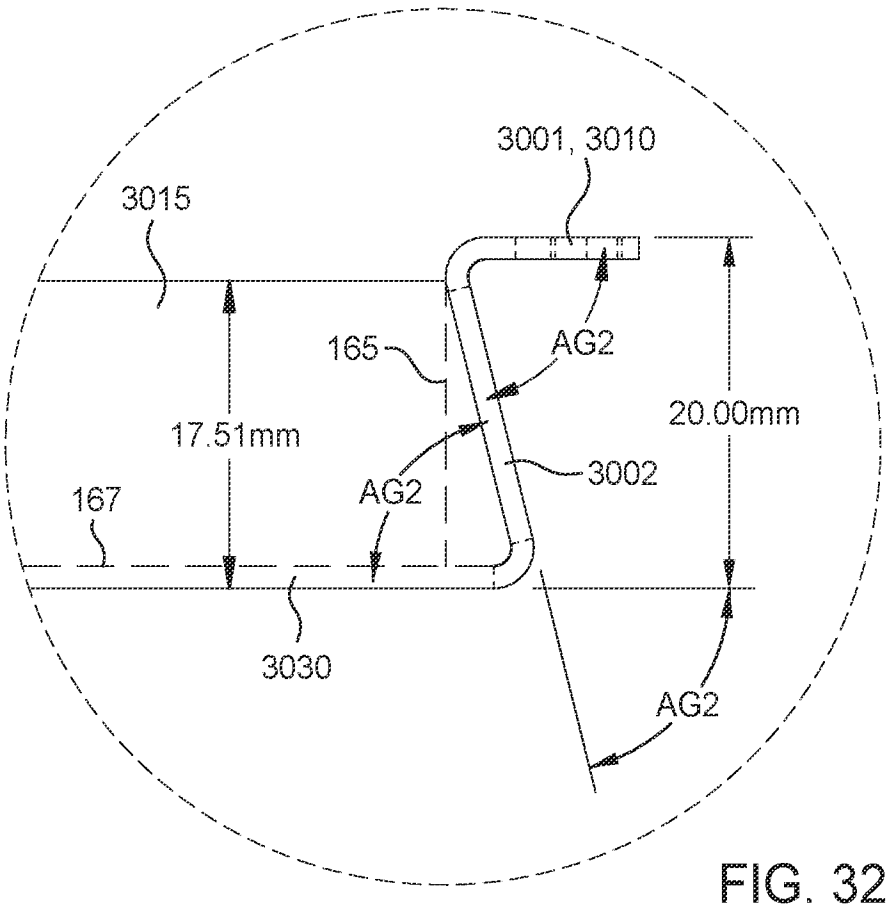
FIG. 32B is a schematic enlarged view of the modular wall unit shown in FIG. 32A, according to one implementation.

FIG. 32A is a schematic partial top view of the modular wall unit 3000 shown in FIG. 30A, according to one implementation. FIG. 32B is a schematic enlarged view of the modular wall unit 3000 shown in FIG. 32A, according to one implementation. The first and second sides 3002, 3005 (of the four sides) of the outer panel 3066 are bent about sides of the non-metallic inner panel 165 at an oblique angle AG2 relative to the front side 3030 of the outer panel 3066. The first and second sides 3002, 3005 are bent back toward the non-metallic inner panel 165. The oblique angle AG2 is within a range of 65 degrees to 85 degrees. The oblique angle AG2 can be 76 degrees, for example. The flanges 3001, 3010 are bent at the oblique angle AG2 relative to the first side 3002.

The first side 3002 of the outer panel 3066 is shown in FIG. 31A.

The present disclosure contemplates that the side walls of the outer panel 166, the first flanges 401, and the second flanges 404 can be bent in a manner similar respectively to the top side 3015, the first side 3002, and the first flanges 3001, 3010.

FIG. 33 is a schematic front isometric view of a gap cover apparatus 3400, according to one implementation. The gap cover apparatus 3400 includes a bracket 3405. The bracket 3405 includes a first portion 3401 and a plurality of first flanges 3010, 3410 extending relative to the first portion 3401. The bracket 3405 includes a second portion 3402 and a plurality of second flanges 3420 extending relative to the second portion 3402. The gap cover apparatus 3400 can be disposed at a corner. For example, the gap cover apparatus 3400 can be used as one or more of the gap cover apparatus 131-133 and be installed between adjacent modular wall units 111-125 that intersect at the corner. The gap cover apparatus 3400 can be formed at an angle such as 90 degrees (as shown in FIG. 33), 45 degrees, and/or 22.5 degrees.

FIG. 34 is a schematic front view of first portion 3401 of the gap cover apparatus 3400 shown in FIG. 33, according to one implementation.

FIG. 35 is a schematic front view of the second portion 3402 of the gap cover apparatus 3400 shown in FIG. 33, according to one implementation.

FIG. 36 is a schematic top view of the gap cover apparatus 3400 shown in FIG. 34, according to one implementation.

FIG. 37 is a schematic back isometric view of the gap cover apparatus 3400 shown in FIG. 33, according to one implementation.

FIG. 38 is a schematic back view of second portion 3402 of the gap cover apparatus 3400 shown in FIG. 37, according to one implementation.

FIG. 39 is a schematic back view of the first portion 3401 of the gap cover apparatus 3400 shown in FIG. 37, according to one implementation.

FIG. 40 is a schematic top view of the gap cover apparatus 3400 shown in FIG. 38, according to one implementation.

Figures 41, 42, 43, 44:
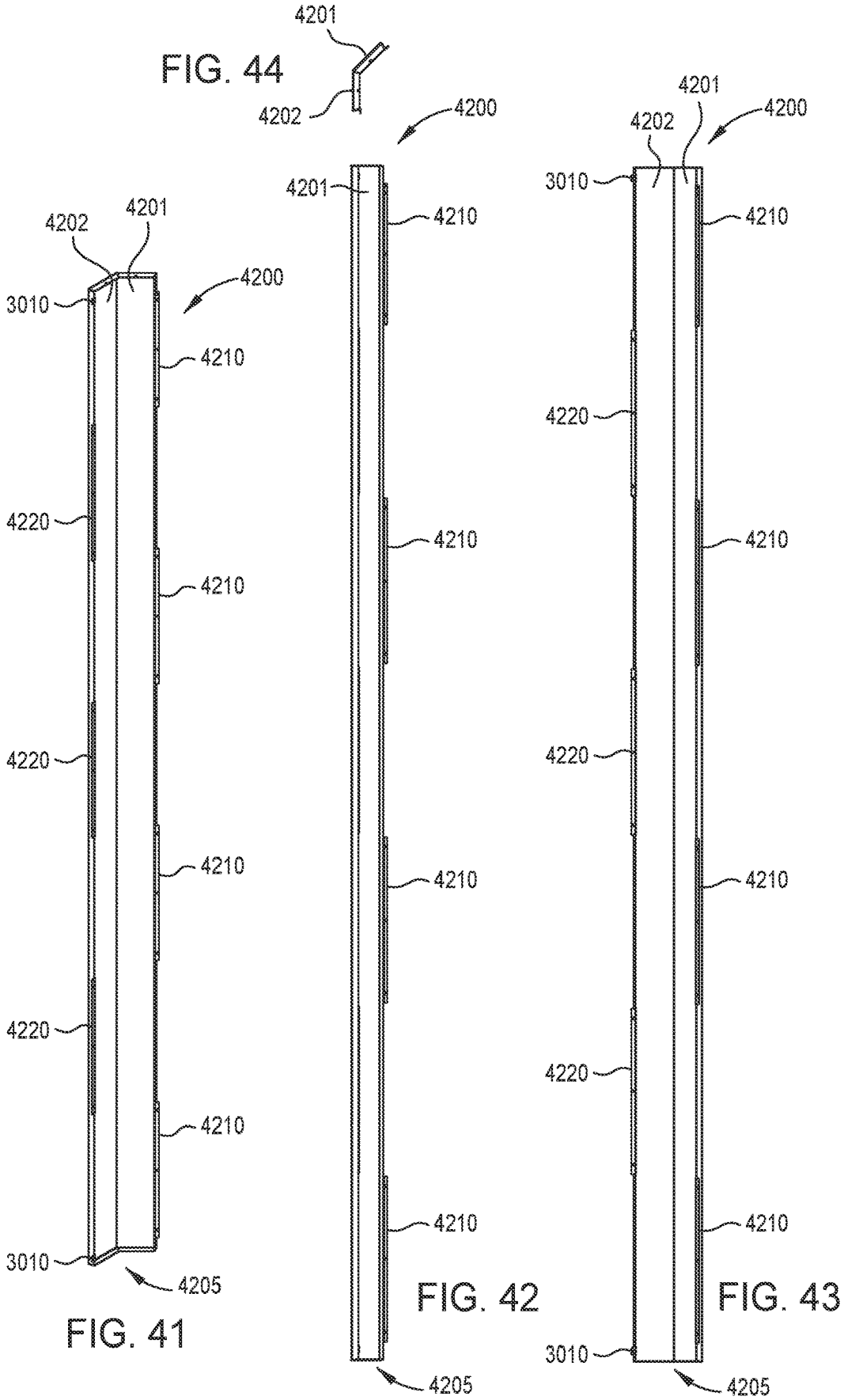
FIG. 41 is a schematic front isometric view of a gap cover apparatus, according to one implementation.
FIG. 42 is a schematic front view of first portion of the gap cover apparatus shown in FIG. 41, according to one implementation.
FIG. 43 is a schematic front view of the second portion of the gap cover apparatus shown in FIG. 41, according to one implementation.
FIG. 44 is a schematic top view of the gap cover apparatus shown in FIG. 42, according to one implementation.

FIG. 41 is a schematic front isometric view of a gap cover apparatus 4200, according to one implementation. The gap cover apparatus 4200 includes a bracket 4205. The bracket 4205 includes a first portion 4201 and a plurality of first flanges 4210 extending relative to the first portion 4201. The bracket 4205 includes a second portion 4202 and a plurality of second flanges 3010, 4220 extending relative to the second portion 4202. The gap cover apparatus 4200 is shown in FIG. 41 as formed at an angle that is 135 degrees.

FIG. 42 is a schematic front view of first portion 4201 of the gap cover apparatus 4200 shown in FIG. 41, according to one implementation.

FIG. 43 is a schematic front view of the second portion 4202 of the gap cover apparatus 4200 shown in FIG. 41, according to one implementation.

FIG. 44 is a schematic top view of the gap cover apparatus 4200 shown in FIG. 42, according to one implementation.

FIG. 45 is a schematic front isometric view of a gap cover apparatus 4600, according to one implementation. The gap cover apparatus 4600 includes a bracket 4605. The bracket 4605 includes a first portion 4601 and a plurality of first flanges 3010, 4610 extending relative to the first portion 4601. The bracket 4605 includes a second portion 4602 and a plurality of second flanges 4620 extending relative to the second portion 4602. The gap cover apparatus 4600 is shown in FIG. 45 as formed at an angle that is 135 degrees.

FIG. 46 is a schematic front view of first portion 4601 of the gap cover apparatus 4600 shown in FIG. 45, according to one implementation.

FIG. 47 is a schematic front view of the second portion 4602 of the gap cover apparatus 4600 shown in FIG. 45, according to one implementation.

FIG. 48 is a schematic top view of the gap cover apparatus 4600 shown in FIG. 46, according to one implementation.

FIGS. 49-53 are schematic views of a gap cover apparatus 5000, according to one implementation. The gap cover apparatus 5000 is U-shaped. The gap cover apparatus 5000 includes a first portion 5001, a second portion 5002, and a third portion 5003 extending between the first portion 5001 and the second portion 5002. The gap cover apparatus 5000 includes a plurality of first flanges 5010 extending relative to the first portion 5001. The 3010, 4610 includes a plurality of second flanges 3010, 5020 extending relative to the second portion 4602.

Figure 53:
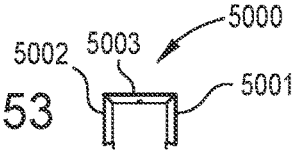
FIGS. 49-53 are schematic views of a gap cover apparatus, according to one implementation.
Figure 49:
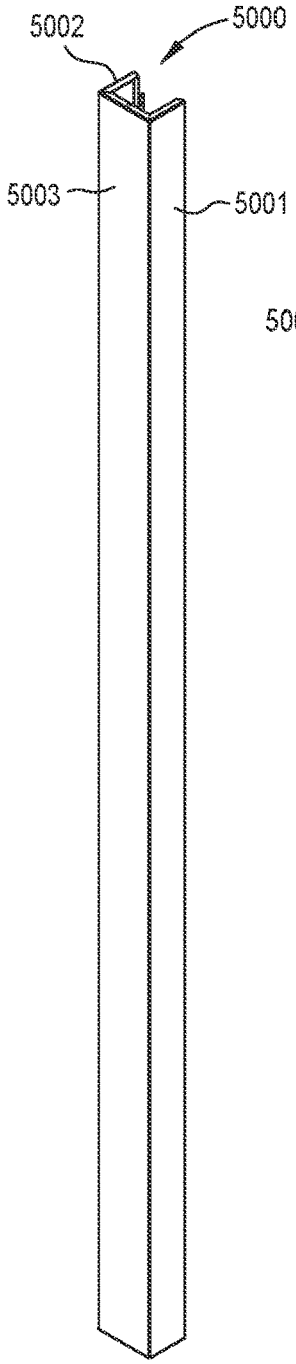
Figure 50:
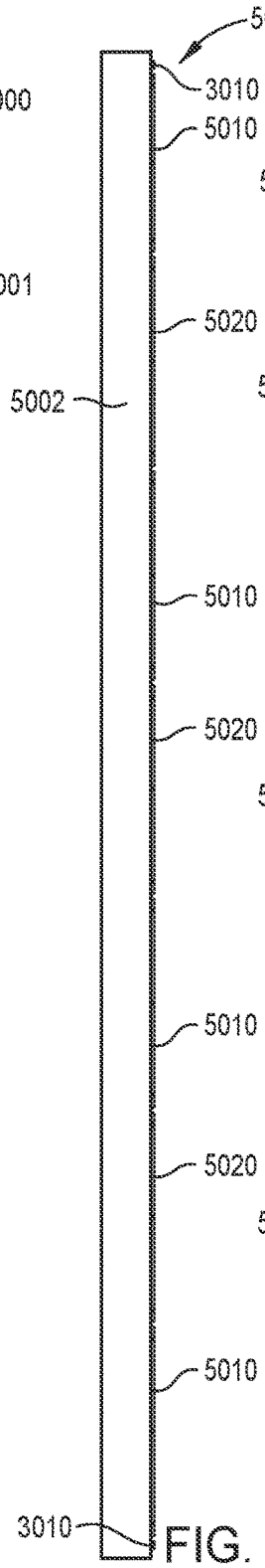
Figure 51:
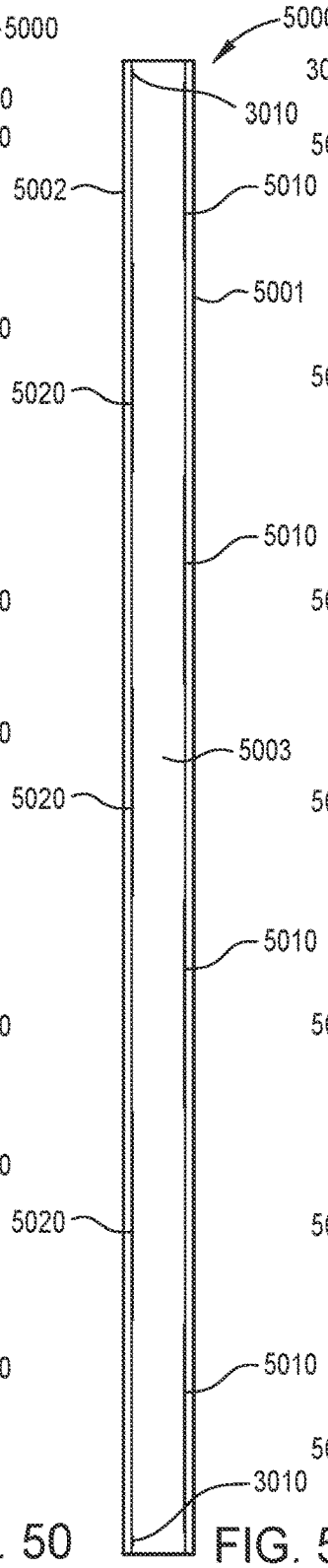
Figure 52:
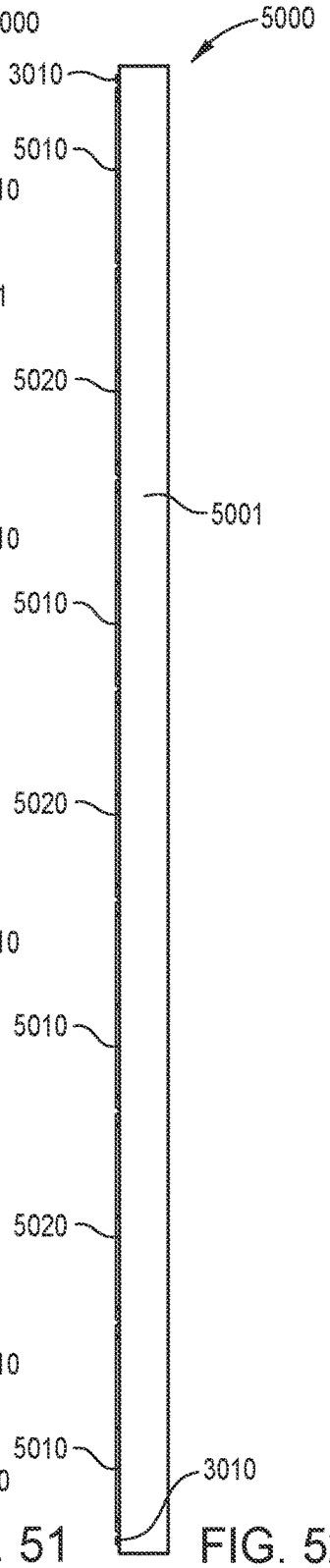

FIG. 49 is a schematic isometric back view of the gap cover apparatus 5000. FIG. 50 is a schematic side view of the second portion 5002. FIG. 51 is a schematic front view of the third portion 5003. FIG. 52 is a schematic side view of the first portion 5001. FIG. 53 is a schematic top view of the gap cover apparatus 5000 shown in FIG. 51.

Figure 56:
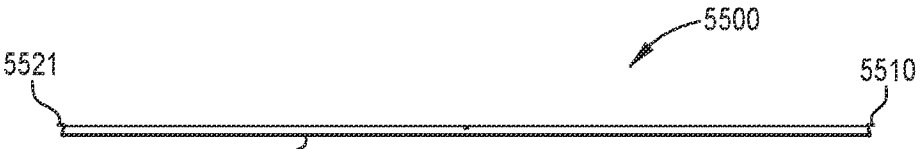
FIG. 56 is a schematic top view of the gap cover apparatus shown in FIG. 55, according to one implementation.
Figure 55:
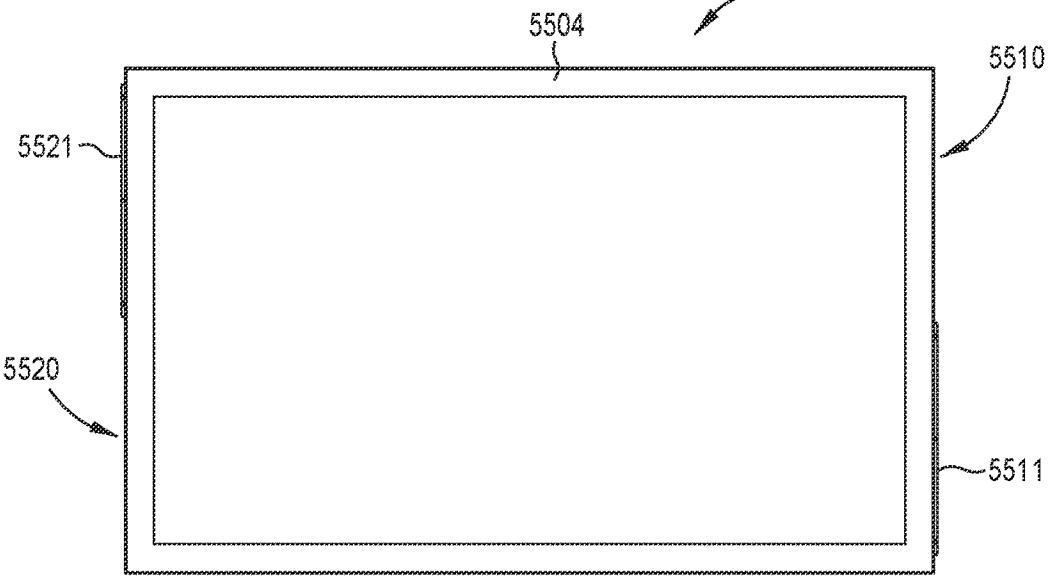
FIG. 55 is a schematic front view of the gap cover apparatus shown in FIG. 54, according to one implementation.
Figure 54:
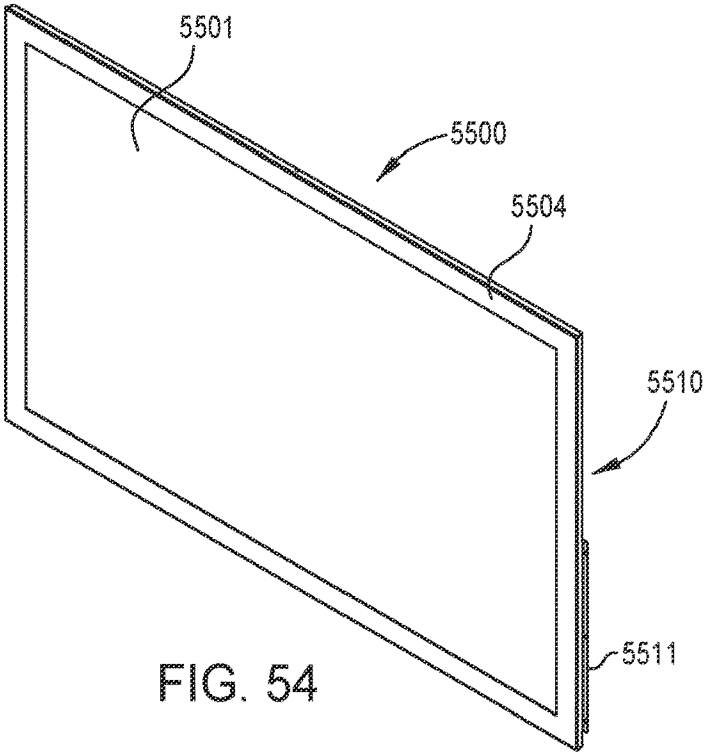
FIG. 54 is a schematic front isometric view of a gap cover apparatus, according to one implementation.

FIG. 54 is a schematic front isometric view of a gap cover apparatus 5500, according to one implementation. FIG. 55 is a schematic front view of the gap cover apparatus 5500 shown in FIG. 54, according to one implementation. FIG. 56 is a schematic top view of the gap cover apparatus 550 shown in FIG. 55, according to one implementation. The gap cover apparatus 5500 includes a frame 5504 that is rectangular in shape. The frame 5504 includes a central opening 5505. The central opening 5505 is a window. The gap cover apparatus 5500 can be used as the gap cover apparatus 134 shown in FIG. 1, for example. The frame 5504 includes a first side 5510 and one or more first flanges 5511 (one is shown) extending relative to the first side 5510. The frame 5504 includes a second side 5520 and one or more second flanges 5521 (one is shown) extending relative to the second side 5520.

FIG. 57 is a schematic front isometric view of a modular wall unit 5800, according to one implementation. FIG. 58 is a schematic front view of the modular wall unit 5800 shown in FIG. 57, according to one implementation. FIG. 59 is a schematic top view of the modular wall unit 5800 shown in FIG. 58, according to one implementation. The modular wall unit 5800 includes an outer panel 5866. The outer panel 5866 includes a first side 5801 and a plurality of first flanges 3010, 5810 extending relative to the first side 5801. The outer panel 5866 includes a second side 5802 and a plurality of second flanges 5820 extending relative to the second side 5802.

Figure 61:
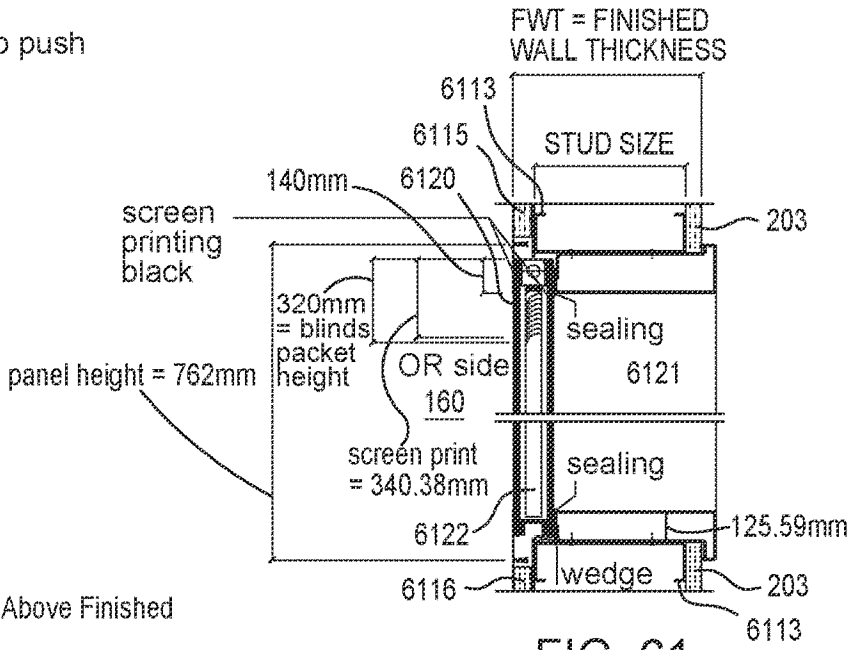
FIG. 61 is a schematic cross-sectional side view of the modular wall system shown in FIG. 60, along Section 61-61, according to one implementation.
Figure 62:
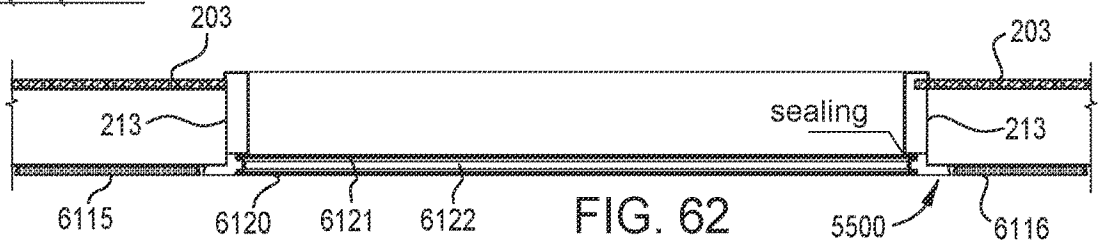
FIG. 62 is a schematic cross-sectional side view of the modular wall system shown in FIG. 60, along Section 62-62, according to one implementation.
Figure 60:
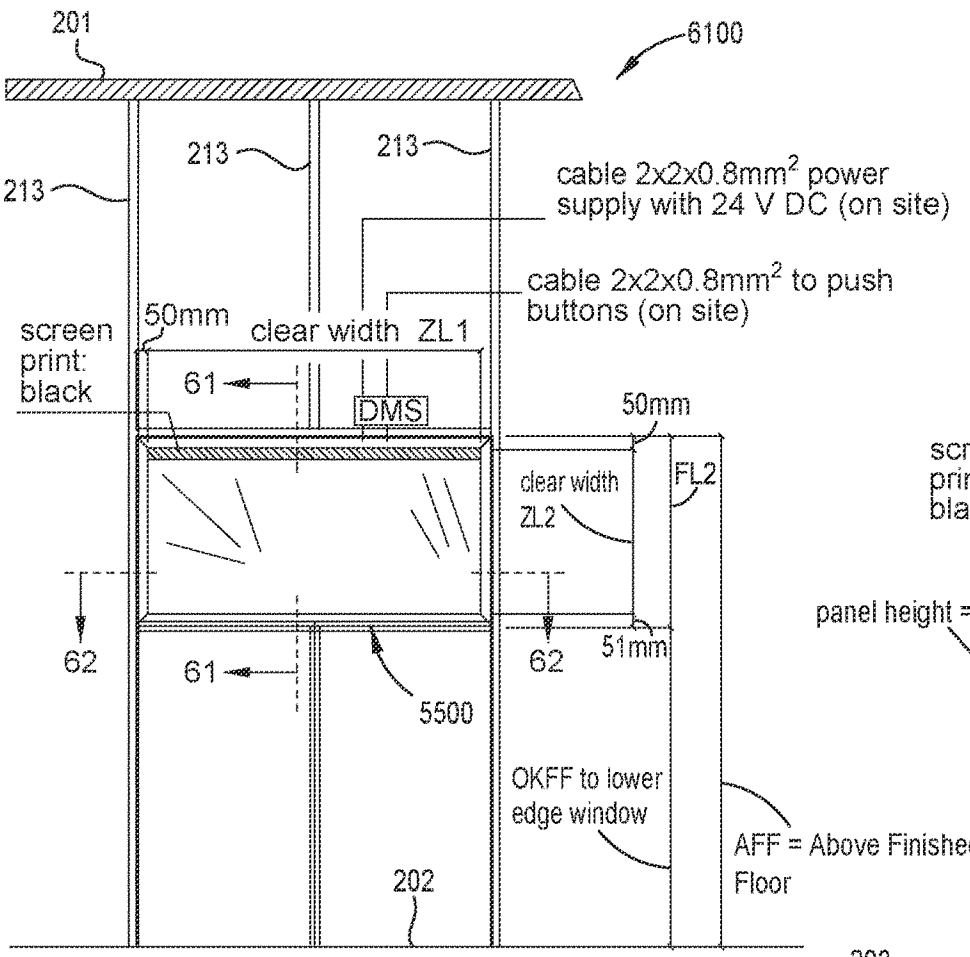
FIG. 60 is a schematic view of a modular wall system during installation, according to one implementation.

FIG. 60 is a schematic view of a modular wall system 6100 during installation, according to one implementation. FIG. 61 is a schematic cross-sectional side view of the modular wall system 6100 shown in FIG. 60, along Section 61-61, according to one implementation. FIG. 62 is a schematic cross-sectional side view of the modular wall system 6100 shown in FIG. 60, along Section 62-62, according to one implementation. The gap cover apparatus 5500 is fastened to the studs 213, and perpendicular studs 6113 that are perpendicular to the studs 213. Pieces of drywall 203 and modular wall units 6115, 6116 are also fastened to the perpendicular studs 6113.

A first glass panel 6120 and a second glass panel 6121 are bonded and sealed to the gap cover apparatus 5500, and blinds 6122 (such as venetian blinds) are disposed between the glass panels 6120, 6121. The glass panels 620, 6121 are formed of toughened safety glass (ESG), and each have a thickness of 6 mm, and can have a width of 25 inches and a length of 15 inches. The frame 5504 has a width that is 51 mm. The blinds 6122 are electrically powered up-down blinds, which can be operated with 24 Volts of direct current (DC) voltage. The slats of the blinds 6122 have a width of 16 mm. The first glass panel 6120 and the second glass panel 6121 can be part of a scrub-sink window.

Figure 63:
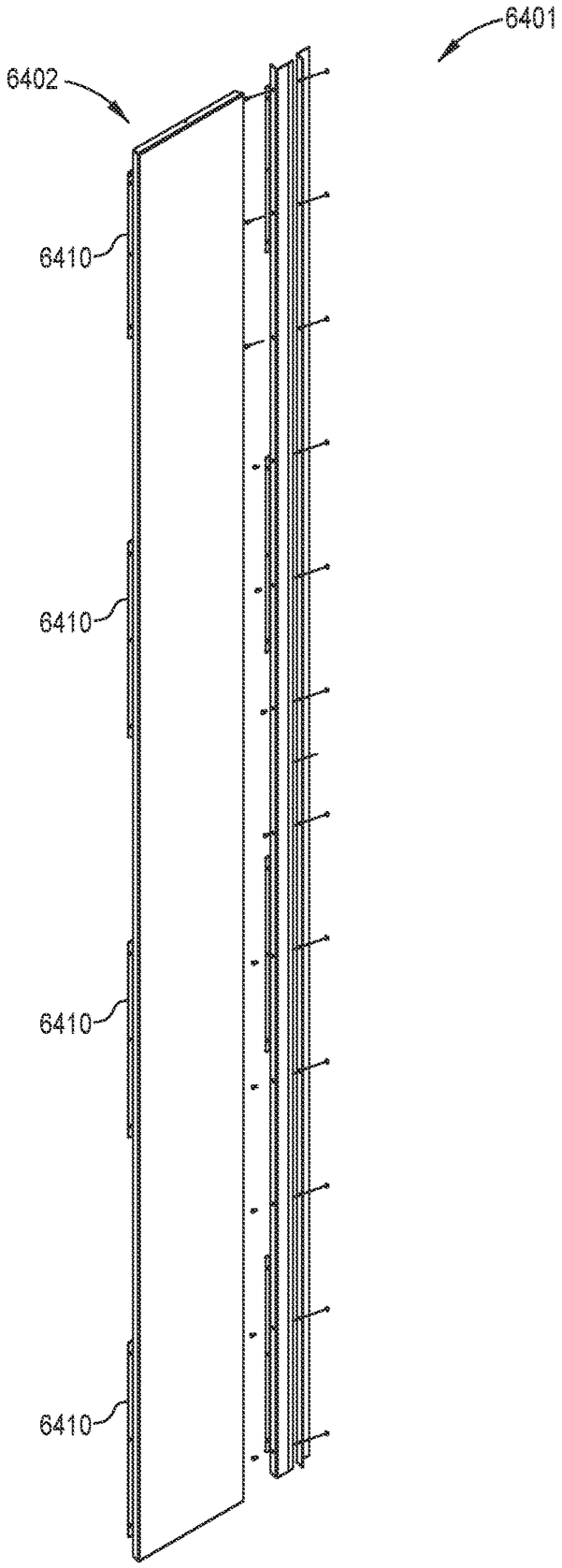
FIG. 63 is a schematic isometric front view of a gap cover apparatus positioned relative to a modular wall unit, according to one implementation.

FIG. 63 is a schematic isometric front view of a gap cover apparatus 6401 positioned relative to a modular wall unit 6402, according to one implementation. The modular wall unit 6402 includes a plurality of flanges 6410.

Figure 64:
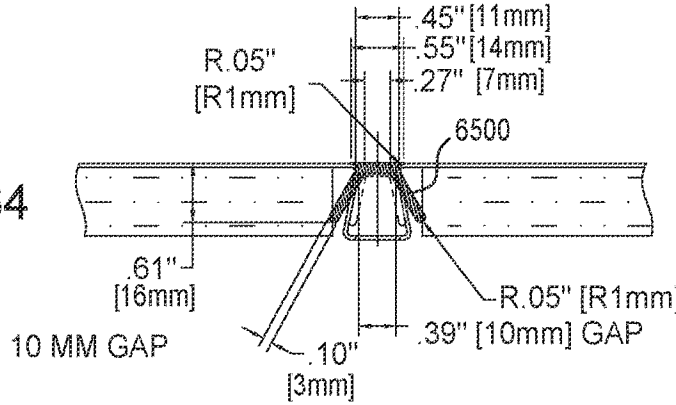
FIGS. 64 and 65 are schematic cross-sectional views of a seal positioned between two adjacent modular wall units, according to one implementation.
Figure 65:
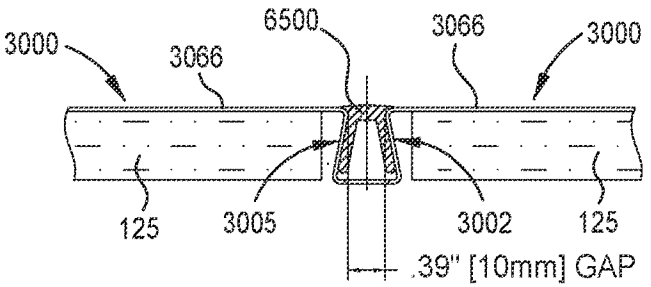

FIGS. 64 and 65 are schematic cross-sectional views of a seal 6500 positioned between two adjacent modular wall units 3000, according to one implementation. FIG. 64 shows the seal 6500 in an unset position and FIG. 65 shows the seal 6500 in a set position. The seal 6500 is configured to seal a gap between the two adjacent outer panels 3066, and the gap has a width of 10 mm.

Figure 67:
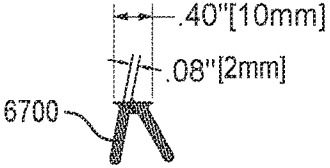
FIG. 67 is a schematic cross-sectional view of the seal shown in FIG. 66, according to one implementation.
Figure 66:
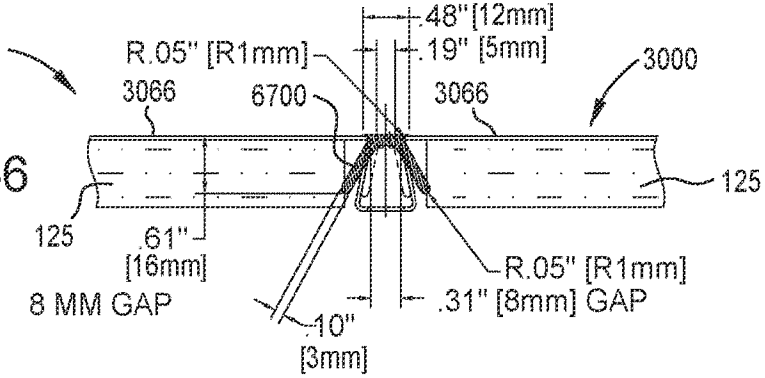
FIG. 66 is a schematic cross-sectional view of a seal positioned between two adjacent modular wall units, according to one implementation.

FIG. 66 is a schematic cross-sectional view of a seal 6700 positioned between two adjacent modular wall units 3000, according to one implementation. FIG. 66 shows the seal 6700 in an unset position, and a set position for the seal 6700 is shown in ghost in FIG. 66. The seal 6700 is configured to seal a gap between the two adjacent outer panels 3066, and the gap has a width of 8 mm. FIG. 67 is a schematic cross-sectional view of the seal 6700 shown in FIG. 66, according to one implementation.

Figure 69:
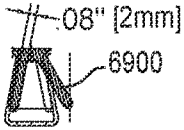
FIG. 69 is a schematic cross-sectional view of the seal shown in FIG. 68, according to one implementation.
Figure 68:
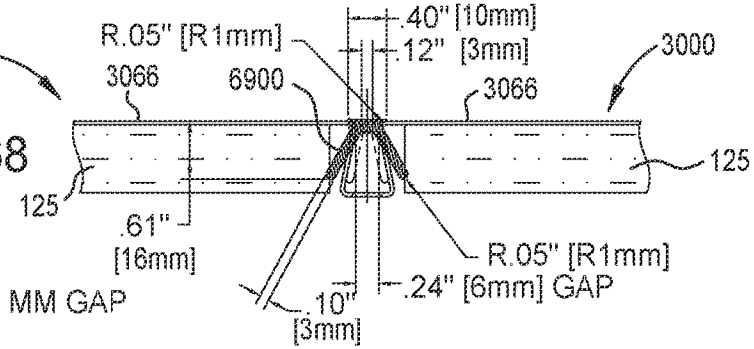
FIG. 68 is a schematic cross-sectional view of a seal positioned between two adjacent modular wall units, according to one implementation.

FIG. 68 is a schematic cross-sectional view of a seal 6900 positioned between two adjacent modular wall units 3000, according to one implementation. FIG. 68 shows the seal 6900 in an unset position, and a set position for the seal 6900 is shown in ghost in FIG. 68. The seal 6900 is configured to seal a gap between the two adjacent outer panels 3066, and the gap has a width of 6 mm. FIG. 69 is a schematic cross-sectional view of the seal 6900 shown in FIG. 68, according to one implementation.

Figure 70:
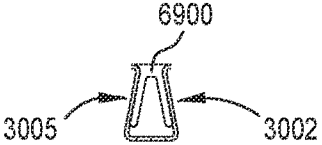
FIG. 70 is a schematic view of the seal shown in FIG. 68 in a set position between the two adjacent outer panels, according to one implementation.

FIG. 70 is a schematic view of the seal 6900 shown in FIG. 68 in a set position between the two adjacent outer panels 3066, according to one implementation.

The present disclosure contemplates that one or more of the seals 6500, 6700, 6900 can be used as one or more of the seals 190-196 shown in FIG. 1.

Figure 71:
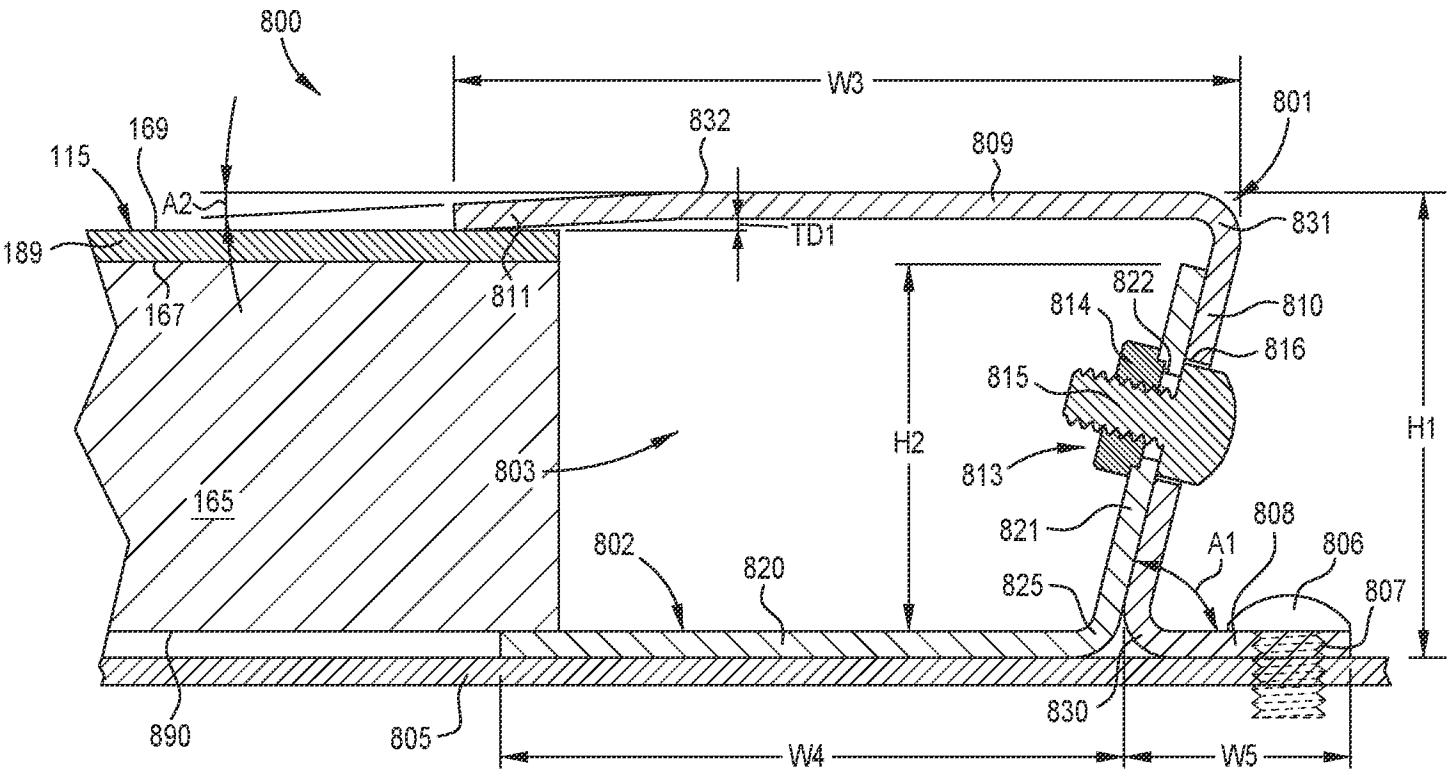
FIG. 71 is a schematic partial cross-sectional view of the gap cover apparatus shown in FIG. 8 in relation to a method of installing the gap cover apparatus, according to one implementation.

FIG. 71 is a schematic partial cross-sectional view of the gap cover apparatus 800 shown in FIG. 8 in relation to a method of installing the gap cover apparatus 800, according to one implementation. At the operating room 160, the gap cover apparatus 800 is provided with the first bracket 801 coupled to the second bracket 802 using the second fasteners 813, with the second fasteners 813 in a loosened state. In one embodiment, which can be combined with other embodiments, a plurality of gap cover apparatus are provided at the operating room 160, with some of the gap cover apparatus having openings 807 and flanges 808 similar to the openings 302 and flanges 401 of the first side 402, and some of the gap cover apparatus having openings 807 and flanges 808 similar to the openings 303 and flanges 404 of the second side 405. The gap cover apparatus 800 is an edge cover apparatus. Portions of the outer panel 166 are removed, such as by using a Jigsaw, at the installation site (e.g., the operating room 160) to facilitate disposing the modular wall unit 115 in the retaining opening 803. In the implementation shown in FIG. 71, the one or more first flanges 401 and one or more side walls of the outer panel 166 disposed on the first side 402 are removed. The present disclosure contemplates that the one or more first flanges 401 the one or more side walls of the outer panel 166 may not be removed, and the one or more first flanges 401 and the one or more side walls of the outer panel 166 can be disposed in the retaining opening 803 such that the base 820 abuts against a back face of the one or more first flanges 401.

The modular wall unit 115 is then disposed in the retaining opening 803. In one embodiment, which can be combined with other embodiments, the first fastener openings 807 are similar to the first fastener openings 302 shown in FIG. 4 (and can include one or more of the same number, dimensions, and/or pattern thereof), and the one or more back flanges 808 are similar to the first flanges 401 shown in FIG. 4 (and can include one or more of the same number, dimensions, and/or pattern thereof). The retaining opening 803 can be referred to as a throat. The first fasteners 806 and the plurality of second fasteners extending through the plurality of second fastener openings 303 are then fastened to the support structure 805. The screws 815 are then tightened to a tightened state. The tightened state abuts the extending flange 821 against the middle portion 810, and abuts the base 820 and the front flange 809 against the non-metallic inner panel 165 and a front wall 189, respectively, of the modular wall unit 115. The front flange 809 abuts against the front face 169 of the outer panel 166. The base 820 abuts against a back face 890 of the non-metallic inner panel 165. The outer panel 166 and the non-metallic inner panel 165 extend into the retaining opening 803 such that at least portions of the non-metallic inner panel 165 and the outer panel 166 are disposed between the front flange 809 and the base 820. The tightened state is shown in FIG. 71. The present disclosure contemplates that in the tightened state, the taper angle A2 can be reduced due to flexing of the tapered section 811. The present disclosure contemplates that a seal may abut against an exterior surface of the second bend 831, and the seal may be positioned between the first bracket 801 and a component (such as a first bracket 801 of a second gap cover apparatus 800 or an outer panel 166 of a second modular wall unit) to create a seal between the first bracket 801 and the component.

Using gap cover apparatus such as the gap cover apparatus 800 facilitates covering gaps in walls of a modular wall system, such as covering gaps adjacent edges of modular wall units. The covering of the gaps facilitates improved aesthetics and improved hygiene, for example by reducing areas in which bacteria can grow and/or by simplifying sanitation. Using the gap cover apparatus 800 also facilitates covering non-uniform gaps (such as non-uniform gaps adjacent to an outer edge of a modular wall unit), facilitating improved aesthetics and improved ease of installation.

The present disclosure contemplates that the second fasteners 813 can be omitted, and that the first bracket 801 and the second bracket 802 can be integrally formed as a single body that is monolithic. Using the first bracket 801 and the second bracket 802 with the fasteners 813 facilitates tightly abutting against the front face 169 and the back face 890, and maintaining a seal of the tapered section 811 against the outer panel 166. The tapered section 811 can seal against the outer panel 166 using the tapered section 811 (such as an interference fit) and not a separate seal (such as the seals 190-196). The present disclosure contemplates that a separate seal can be used in addition to the seal created by the tapered section 811.

Figure 72:
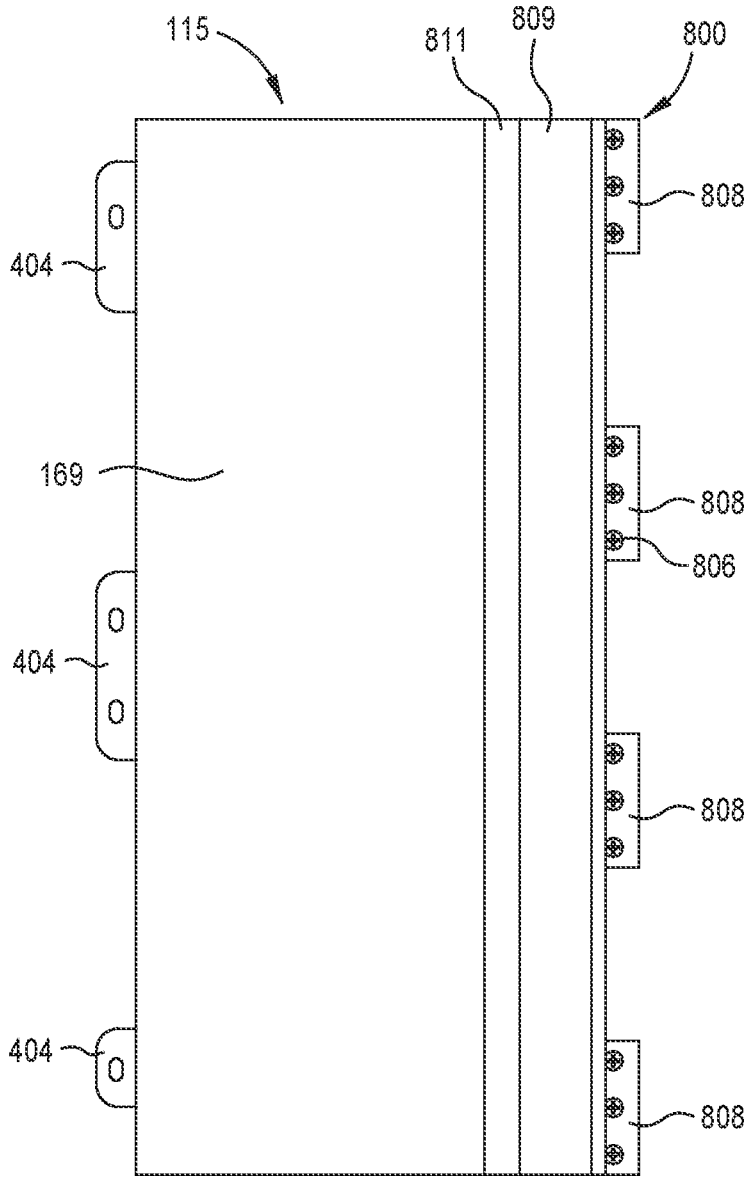
FIG. 72 is a schematic top view of the gap cover apparatus shown in relation to the method of installing the gap cover apparatus in FIG. 71, according to one implementation.

FIG. 72 is a schematic top view of the gap cover apparatus 800 shown in relation to the method of installing the gap cover apparatus 800 in FIG. 71, according to one implementation. The front flange 809 is of a length to abut against the front face 169 of the outer panel 166 across an entire length (such as an entirety of a length LE1 of the outer panel 166) of the modular wall unit 115 to cover an entirety of a gap adjacent the first side 402 or the second side 405.

Figure 73:
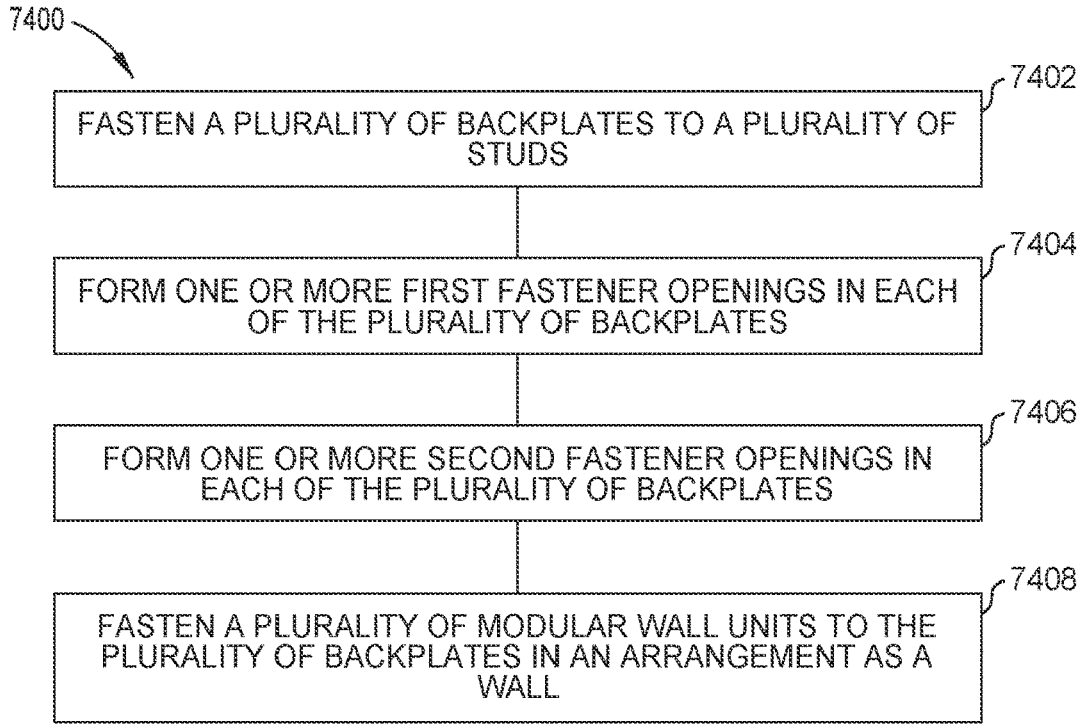
FIG. 73 is a schematic block diagram view of a method of installing a modular wall system for a medical treatment environment, according to one implementation.

FIG. 73 is a schematic block diagram view of a method 7400 of installing a modular wall system for a medical treatment environment, according to one implementation. Operation 7402 of the method 7400 includes fastening a plurality of backplates to a plurality of studs. Each of the plurality of backplates includes a length that is larger than a width, and a longitudinal axis extending along the length. The longitudinal axis includes a center.

Operation 7404 includes forming one or more first fastener openings in each of the plurality of backplates on a first side of the center of the respective backplate.

Operation 7406 includes forming one or more second fastener openings in each of the plurality of backplates on a second side of the center of the respective backplate.

Operation 7408 includes fastening a plurality of modular wall units to the plurality of backplates in an arrangement as a wall. Each of the plurality of modular wall units includes a non-metallic inner panel, and an outer panel disposed about a front face of the non-metallic inner panel. The fastening the plurality of modular wall units to the plurality of back plates includes aligning a plurality of first fastener openings formed in one or more first flanges extending relative to a first side of each outer panel with the one or more first fastener openings in the plurality of backplates. The fastening the plurality of modular wall units to the plurality of back plates includes aligning a plurality of second fastener openings formed in one or more second flanges extending relative to a second side of the outer panel with the one or more second fastener openings in the plurality of backplates.

Figure 74:
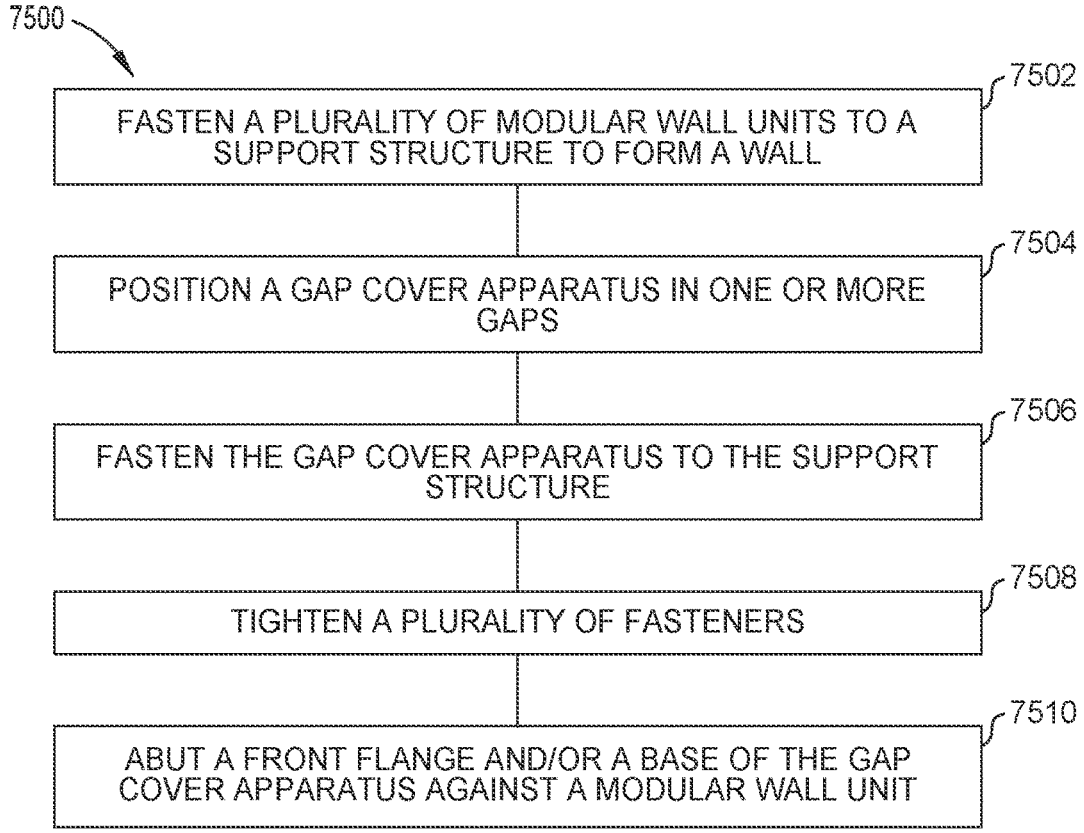
FIG. 74 is a schematic block diagram view of a method of installing a modular wall system for a medical treatment environment, according to one implementation.

FIG. 74 is a schematic block diagram view of a method 7500 of installing a modular wall system for a medical treatment environment, according to one implementation.

Operation 7502 of the method 7500 includes fastening a plurality of modular wall units to a support structure to form a wall. The wall includes one or more gaps. The support structure includes a plurality of studs. The support structure can also include a plurality of backplates fastened to the plurality of studs.

Operation 7504 includes positioning a gap cover apparatus in the one or more gaps. The positioning includes disposing a modular wall unit partially in a retaining opening of the gap cover apparatus. The modular wall unit can be one of the plurality of modular wall units fastened in operation 7502, or can be an additional modular wall unit. The positioning can include at least partially unfastening at least one of the plurality of modular wall units from the support structure to dispose the at least one of the plurality of modular wall units in the retaining opening, and subsequently refastening the at least one of the plurality of modular wall units to the support structure. In one embodiment, which can be combined with other embodiments, the gap cover apparatus includes a first bracket fastened to a second bracket using a plurality of fasteners. Prior to the positioning of operation 7504, a portion of a first side or a second side of the modular wall unit can be removed (such as by using a Jigsaw).

Operation 7506 includes fastening the gap cover apparatus to the support structure. Operation 7506 can also include fastening (and/or refastening as described above) the modular wall unit to the support structure.

Operation 7508 includes, after the fastening the gap cover apparatus to the support structure and fastening the modular wall unit to the support structure, tightening the plurality of fasteners.

Operation 7510 includes abutting a front flange and/or a base of the gap cover apparatus against the modular wall unit. The front flange is abutted against a front face of the modular wall unit. The base of the gap cover apparatus is abutted against a back face of the modular wall unit. The front flange and/or the base can be abutted against one or more of the plurality of modular wall units and/or the additional modular wall unit.

The present disclosure contemplates that the abutting of operation 7510 can occur before or after the fastening of operation 7506. The abutting of operation 7510 can occur during the positioning of operation 7504 and/or the tightening of operation 7508.

Benefits of the present disclosure include at least accurate panel alignment, covering gaps, non-progressive installation, reduced installation time, reduced installation costs, reduced installation complexity, enhanced aesthetics, and enhanced hygiene of hygienic environments. For example, while repairing other wall systems can take days (such as 6 days), making the same repairs on the modular wall system 100 can take a time period that is 30 minutes to 4 hours (or less), which reduces or eliminates costly downtime and delays in patient care. Repairing and/or replacement of modular wall units 111-125 can be conducted outside of normal medical treatment working hours, and need not necessarily be conducted under standard ICRA containment. Components of the present disclosure (such as the gap cover apparatus 800 and the modular wall units 111-125) can be formed on-site and outside of the operating room 160, or can be pre-formed and then delivered and provided at the installation site to reduce or eliminate containment procedures.

As another example, aspects of the present disclosure facilitate providing a cleaner space with superior infection control that may harbor approximately 50% less bacteria than other wall systems, and the ability to seamlessly and continually adapt to the ever-changing healthcare environment. More specifically, in an operating room contamination assessment, a modular wall system using aspects described herein had a total colony count (or heterotrophic plate count (HPC)) of 58 compared to another wall system that had a count of 114. This assessment was done at the same facility, with the same cleaning staff, and testing the same five high-touch surfaces (walls, storage cabinet doors, documentation stations, entry doors, and monitor screens).

It is contemplated that one or more aspects disclosed herein may be combined. As an example, one or more aspects, features, components, and/or properties of the modular wall system 100, the gap cover apparatus 800, the method 7400, and/or the method 7500 may be combined. Moreover, it is contemplated that one or more aspects disclosed herein may include some or all of the aforementioned benefits.

While the foregoing is directed to embodiments of the present disclosure, other and further embodiments of the disclosure may be devised without departing from the basic scope thereof. The present disclosure also contemplates that one or more aspects of the embodiments described herein may be substituted in for one or more of the other aspects described. The scope of the disclosure is determined by the claims that follow.

What is claimed is:

1. A modular wall system for medical treatment environments, comprising:

a plurality of modular wall units configured to be arranged together as a wall, each of the plurality of modular wall units comprising:

a non-metallic inner panel, and an outer panel disposed at least partially about a front face of the non-metallic inner panel; and a gap cover apparatus configured to cover one or more gaps of the wall, the gap cover apparatus comprising:

one or more brackets configured to interface with one or more of the plurality of modular wall units, the one or more brackets defining a retaining opening that at least partially receives the one or more of the plurality of modular wall units therein, the one or more brackets comprising a first bracket, and the first bracket comprising:

one or more back flanges, a front flange parallel to the one or more back flanges, a middle portion extending between the one or more back flanges and the front flange, and a plurality of first fastener openings formed in the one or more back flanges, and a plurality of first fasteners configured to fasten the one or more brackets to a support structure, the plurality of first fastener openings configured to receive the plurality of first fasteners therein.

2. The modular wall system of claim 1, wherein the first bracket is configured to interface with a front face of the one or more of the plurality of modular wall units.

3. The modular wall system of claim 1, wherein the middle portion of the first bracket intersects the one or more back flanges and the front flange at an oblique angle.

4. The modular wall system of claim 3, wherein the front flange of the first bracket comprises a tapered section that tapers away from the front flange and toward the one or more back flanges at a taper angle, wherein the taper angle is 5 degrees or less, and the tapered section at least partially defines the retaining opening.

5. The modular wall system of claim 4, wherein the one or more back flanges of the first bracket comprise a plurality of back flanges protruding from the middle portion and spaced from each other along a length of the middle portion.

6. The modular wall system of claim 5, wherein the one or more brackets further comprise a second bracket, the gap cover apparatus further comprises a plurality of second fasteners to fasten the second bracket to the first bracket, and the first bracket further comprises a plurality of second fastener openings formed in the middle portion and configured to receive the plurality of second fasteners therein.

7. The modular wall system of claim 6, wherein the second bracket comprises a base and an extending flange extending relative to the base, the extending flange of the second bracket extends relative to the base at the oblique angle, and the extending flange comprises a plurality of fastener openings to align with the plurality of second fastener openings formed in the middle portion of the first bracket.

8. A method of installing a modular wall system for a medical treatment environment, comprising:

fastening a plurality of modular wall units to a support structure to form a wall, the wall comprising one or more gaps;

positioning a gap cover apparatus in the one or more gaps, the positioning comprising disposing a modular wall unit partially in a retaining opening of the gap cover apparatus, the gap cover apparatus comprising a first bracket fastened to a second bracket using a plurality of fasteners, the first bracket having a front flange and one or more back flanges, and the second bracket having a base;

fastening the gap cover apparatus to the support structure;

abutting the front flange of the gap cover apparatus against the modular wall unit; and abutting the base of the gap cover apparatus against a back face of the modular wall unit.

9. The method of claim 8, further comprising, after the fastening the gap cover apparatus to the support structure, tightening the plurality of fasteners.

10. The method of claim 8, wherein a front exterior surface of the front flange is formed of stainless steel, has a powder coating, or has a galvanized finish.

11. The method of claim 10, wherein a tapered section of the front flange is abutted against the modular wall unit, and the tapered section tapers away from the front flange and toward the one or more back flanges at a taper angle, wherein the taper angle is 5 degrees or less, and the tapered section at least partially defines the retaining opening.

12. The method of claim 8, wherein the support structure comprises a plurality of studs.

13. The method of claim 12, wherein the support structure further comprises a plurality of backplates fastened to the plurality of studs.

14. A method of installing a modular wall system for a medical treatment environment, comprising:

fastening a plurality of modular wall units to a support structure to form a wall, the wall comprising one or more gaps;

positioning a gap cover apparatus in the one or more gaps, the positioning comprising disposing a modular wall unit partially in a retaining opening of the gap cover apparatus, the gap cover apparatus comprising a front flange and one or more back flanges;

fastening the gap cover apparatus to the support structure; and abutting a tapered section of the front flange of the gap cover apparatus against the modular wall unit, the tapered section tapers away from the front flange and toward the one or more back flanges at a taper angle, the taper angle is 5 degrees or less, and the tapered section at least partially defines the retaining opening.

15. The method of claim 14, wherein a front exterior surface of the front flange is formed of stainless steel, has a powder coating, or has a galvanized finish.

* * * * *